US011931632B2

(12) United States Patent
Willett et al.

(10) Patent No.: US 11,931,632 B2
(45) **Date of Patent: *Mar. 19, 2024**

(54) GOLF CLUB

(71) Applicant: Taylor Made Golf Company, Inc., Carlsbad, CA (US)

(72) Inventors: Kraig Alan Willett, Fallbrook, CA (US); Matthew Greensmith, Vista, CA (US); Andrew James, Carlsbad, CA (US); Jason Andrew Mata, Carlsbad, CA (US); Matthew David Johnson, San Diego, CA (US); David Anderson, Palatine, IL (US); Brandon H. Woolley, Vista, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/950,854

(22) Filed: Sep. 22, 2022

(65) Prior Publication Data

US 2023/0093430 A1 Mar. 23, 2023

Related U.S. Application Data

(63) Continuation of application No. 17/105,043, filed on Nov. 25, 2020, now Pat. No. 11,478,683, which is a (Continued)

(51) Int. Cl.
*A63B 53/04* (2015.01)
*A63B 53/06* (2015.01)

(Continued)

(52) U.S. Cl.
CPC ..... *A63B 53/0466* (2013.01); *A63B 53/06* (2013.01); *A63B 60/52* (2015.10);

(Continued)

(58) Field of Classification Search
CPC ..... A63B 53/0466; A63B 53/06; A63B 60/52; A63B 53/0408; A63B 53/0433; A63B 2053/0491
See application file for complete search history.

(56) References Cited

U.S. PATENT DOCUMENTS 3,606,327 A 9/1971 Gorman
3,652,094 A 3/1972 Glover (Continued)

FOREIGN PATENT DOCUMENTS

JP H06190088 7/1994
JP H10263118 10/1998

(Continued)

OTHER PUBLICATIONS

"Cleveland HiBore Driver Review," http://thesandtrip.com, 7 pages, May 19, 2006.

(Continued)

*Primary Examiner* — William M Pierce
(74) *Attorney, Agent, or Firm* — Klarquist Sparkman, LLP

(57) ABSTRACT

A golf club head includes a golf club body including a crown, a sole, and a skirt connected between the crown and the sole, the golf club body including a front including a leading edge and a back including a trailing edge, and a hosel connected to the golf club body; a face connected to the front of the golf club body, the face including a geometric center, the golf club head including modifiable boundary conditions.

22 Claims, 30 Drawing Sheets

Related U.S. Application Data continuation of application No. 16/193,116, filed on Nov. 16, 2018, now Pat. No. 10,874,916, which is a continuation of application No. 14/573,701, filed on Dec. 17, 2014, now Pat. No. 10,150,016, which is a continuation-in-part of application No. 14/457,883, filed on Aug. 12, 2014, now abandoned.

(60) Provisional application No. 62/027,692, filed on Jul. 22, 2014.

(51) Int. Cl.
*A63B 60/52* (2015.01)
*A63B 60/42* (2015.01)

(52) U.S. Cl.
CPC ..... *A63B 53/0408* (2020.08); *A63B 53/0433* (2020.08); *A63B 53/0437* (2020.08); *A63B 53/0454* (2020.08); *A63B 2053/0491* (2013.01); *A63B 60/42* (2015.10)

(56) References Cited

U.S. PATENT DOCUMENTS 4,085,934 A 4/1978 Churchward
4,432,549 A 2/1984 Zebelean
5,299,807 A 4/1994 Hutin
5,362,055 A 11/1994 Rennie
5,397,126 A 3/1995 Allen
5,492,327 A 2/1996 Biafore, Jr.
5,676,605 A 10/1997 Kobayashi
5,779,560 A 7/1998 Buck
5,797,807 A 8/1998 Moore
5,851,160 A 12/1998 Rugge et al.
5,935,020 A 8/1999 Stites et al.
5,941,782 A 8/1999 Cook
6,086,485 A 7/2000 Hamada
6,139,445 A 10/2000 Werner et al.
6,193,614 B1 2/2001 Sasamoto
6,309,310 B1 10/2001 Shira
6,344,002 B1 2/2002 Kajita
6,368,231 B1 4/2002 Chen
6,602,149 B1 8/2003 Jacobson
6,605,007 B1 8/2003 Bissonnette
6,776,723 B2 8/2004 Bliss et al.
6,800,038 B2 10/2004 Willett et al.
7,025,695 B2 4/2006 Mitsuba
7,029,403 B2 4/2006 Rice
7,166,038 B2 1/2007 Williams et al.
7,582,024 B2 9/2009 Shear
7,674,187 B2 3/2010 Cackett et al.
7,674,189 B2 3/2010 Beach et al.
7,731,603 B2 6/2010 Beach et al.
7,749,096 B2 * 7/2010 Gibbs ..... A63B 53/0466 473/335
7,771,291 B1 8/2010 Willett et al.
7,927,229 B2 4/2011 Jertson et al.
8,012,038 B1 9/2011 Beach et al.
8,012,039 B2 9/2011 Greaney et al.
8,221,261 B2 7/2012 Curtis
8,366,566 B1 2/2013 Rollinson
8,403,771 B1 * 3/2013 Rice ..... A63B 53/0466 473/328
8,430,763 B2 4/2013 Beach et al.
8,496,544 B2 7/2013 Curtis et al.
8,506,415 B2 8/2013 Franklin
8,517,859 B2 8/2013 Golden
8,523,705 B2 9/2013 Breier et al.
8,529,368 B2 9/2013 Rice et al.
8,663,029 B2 3/2014 Beach et al.
8,753,222 B2 6/2014 Beach et al.
8,821,312 B2 9/2014 Burnett
8,827,831 B2 9/2014 Burnett
8,888,607 B2 11/2014 Harbert et al.
8,900,069 B2 12/2014 Beach et al.
8,911,301 B1 12/2014 Allen
8,911,302 B1 12/2014 Ivanova
8,956,240 B2 2/2015 Beach et al.
8,986,133 B2 3/2015 Bennett et al.
9,033,818 B2 5/2015 Myrhum
9,162,115 B1 10/2015 Beach et al.
9,192,825 B2 11/2015 Nakamura
9,211,448 B2 * 12/2015 Bezilla ..... A63B 53/0466
9,636,552 B2 5/2017 Cleghorn et al.
9,662,545 B2 5/2017 Beach et al.
9,770,633 B2 9/2017 Fossum et al.
9,802,086 B2 * 10/2017 Kato ..... A63B 53/0466
9,849,357 B2 12/2017 Wahl et al.
9,914,030 B2 3/2018 Cleghorn et al.
9,937,390 B2 4/2018 Luttrell et al.
10,150,016 B2 12/2018 Willett et al.
10,213,662 B2 2/2019 Seluga et al.
10,646,756 B2 5/2020 Beach et al.
10,653,927 B2 5/2020 Murphy et al.
11,235,208 B2 * 2/2022 Yamamoto ..... A63B 60/02
2002/0183134 A1 12/2002 Allen et al.
2003/0114239 A1 6/2003 Mase
2004/0121852 A1 6/2004 Tsurumaki
2004/0157678 A1 8/2004 Kohno
2004/0162156 A1 8/2004 Kohno
2004/0192463 A1 9/2004 Tsurumaki
2005/0181888 A1 8/2005 Hou
2006/0116218 A1 6/2006 Burnett et al.
2007/0072698 A1 3/2007 Juang
2008/0119303 A1 5/2008 Bennett
2008/0146374 A1 6/2008 Beach et al.
2008/0318705 A1 12/2008 Clausen
2009/0124411 A1 5/2009 Rae et al.
2009/0137338 A1 5/2009 Kajita
2009/0149275 A1 6/2009 Rae et al.
2009/0163292 A1 6/2009 Chao
2009/0170632 A1 7/2009 Beach et al.
2009/0191980 A1 7/2009 Greaney et al.
2010/0087269 A1 4/2010 Snyder
2010/0255930 A1 10/2010 Rice
2010/0267463 A1 10/2010 Stites
2011/0021284 A1 1/2011 Stites
2011/0053703 A1 3/2011 Stites
2011/0124432 A1 5/2011 Oldknow
2011/0312437 A1 12/2011 Sargent
2012/0021849 A1 1/2012 Gibbs
2012/0122601 A1 5/2012 Beach et al.
2012/0142447 A1 6/2012 Boyd
2012/0165115 A1 6/2012 Matsunaga
2012/0202615 A1 8/2012 Beach et al.
2012/0289360 A1 11/2012 Breier
2012/0289361 A1 11/2012 Beach et al.
2012/0302368 A1 * 11/2012 Nishio ..... A63B 53/0466 473/345
2013/0109487 A1 * 5/2013 Stokke ..... A63B 60/00 473/291
2013/0130831 A1 5/2013 Morales
2013/0165252 A1 6/2013 Rice
2013/0165254 A1 6/2013 Rice
2013/0165257 A1 6/2013 Dipert
2013/0210542 A1 8/2013 Harbert et al.
2013/0225306 A1 8/2013 David
2013/0331201 A1 12/2013 Wahl
2013/0344990 A1 12/2013 Slaughter
2014/0024475 A1 1/2014 Motokawa
2014/0080623 A1 3/2014 de la Cruz
2014/0080624 A1 3/2014 Galvan
2014/0080626 A1 3/2014 Bezilla
2014/0080627 A1 3/2014 Bennett
2014/0080634 A1 3/2014 Golden
2014/0106903 A1 * 4/2014 Nakamura ..... A63B 53/0466 473/346
2014/0141904 A1 5/2014 Deshmukh
2014/0274454 A1 9/2014 Snyder
2014/0274457 A1 * 9/2014 Beach ..... A63B 53/02 473/335
2015/0011328 A1 1/2015 Harbert et al.
2015/0065265 A1 * 3/2015 Motokawa ..... A63B 53/04 473/335

(56) References Cited

U.S. PATENT DOCUMENTS

| | | | | |
|---|---|---|---|---|
| 2015/0094164 | A1 | 4/2015 | Galvan | |
| 2015/0094166 | A1 | 4/2015 | Taylor | |
| 2015/0105177 | A1 | 4/2015 | Beach et al. | |
| 2015/0119163 | A1 | 4/2015 | de la Cruz | |
| 2015/0126304 | A1 | 5/2015 | Cleghorn | |
| 2015/0133233 | A1 | 5/2015 | Bezilla | |
| 2015/0165283 | A1 | 6/2015 | Martens | |
| 2015/0174461 | A1 | 6/2015 | Bennett | |
| 2015/0217167 | A1 | 8/2015 | Frame | |
| 2015/0231453 | A1 | 8/2015 | Harbert et al. | |
| 2015/0231454 | A1 | 8/2015 | Parsons | |
| 2015/0231806 | A1 | 8/2015 | Parsons | |
| 2015/0238826 | A1 | 8/2015 | Llewellyn | |
| 2015/0265885 | A1* | 9/2015 | Hettinger | A63B 53/04 473/290 |
| 2015/0367198 | A1 | 12/2015 | Seagram | |
| 2015/0375064 | A1 | 12/2015 | Hasegawa | |
| 2016/0023062 | A1* | 1/2016 | Willett | A63B 60/52 473/329 |
| 2016/0023063 | A1* | 1/2016 | Willett | A63B 53/0466 29/401.1 |
| 2016/0067561 | A1 | 3/2016 | Golden | |
| 2016/0096082 | A1 | 4/2016 | Boggs | |
| 2016/0096085 | A1 | 4/2016 | Boggs | |
| 2016/0193508 | A1 | 7/2016 | Issertell | |
| 2016/0250534 | A1 | 9/2016 | Solheim | |
| 2016/0296808 | A1 | 10/2016 | Harrington | |
| 2016/0310809 | A1 | 10/2016 | Boggs | |
| 2016/0317880 | A1 | 11/2016 | Boggs | |
| 2016/0346644 | A1 | 12/2016 | Larson | |
| 2016/0367876 | A1 | 12/2016 | Taylor | |
| 2017/0028270 | A1 | 2/2017 | Westrum | |
| 2017/0072277 | A1 | 3/2017 | Mata | |
| 2017/0100649 | A1 | 4/2017 | Seluga | |
| 2017/0144034 | A1 | 5/2017 | Seluga | |
| 2017/0151472 | A1* | 6/2017 | Beach | A63B 60/00 |
| 2017/0173417 | A1 | 6/2017 | Seluga | |
| 2017/0182381 | A1 | 6/2017 | Seluga | |
| 2018/0071591 | A1 | 3/2018 | Seluga | |
| 2018/0078833 | A1* | 3/2018 | Johnson | A63B 53/0466 |
| 2018/0104547 | A1 | 4/2018 | Hall | |
| 2018/0126228 | A1 | 5/2018 | Penney | |
| 2019/0015713 | A1* | 1/2019 | Kato | A63B 53/0466 |
| 2019/0022472 | A1 | 1/2019 | Del Rosario | |
| 2019/0046845 | A1 | 2/2019 | Greensmith et al. | |
| 2019/0046846 | A1 | 2/2019 | Sargent et al. | |
| 2019/0046848 | A1 | 2/2019 | Kato | |
| 2019/0091524 | A1 | 3/2019 | Slaughter | |
| 2019/0091526 | A1 | 3/2019 | Bacon | |
| 2019/0168087 | A1 | 6/2019 | Martens | |
| 2019/0184246 | A1 | 6/2019 | Harbert et al. | |
| 2021/0128993 | A1 | 5/2021 | Willett et al. | |
| 2023/0074992 | A1* | 3/2023 | Mizutani | A63B 53/0454 |

FOREIGN PATENT DOCUMENTS

| | | |
|---|---|---|
| JP | H11114102 | 4/1999 |
| JP | H11155982 | 6/1999 |
| JP | 2002-052099 | 2/2002 |
| JP | 2002136625 | 5/2002 |
| JP | 200393554 | 4/2003 |
| JP | 2003135632 | 5/2003 |
| JP | 2003210621 | 7/2003 |
| JP | 2003524487 | 8/2003 |
| JP | 2003320061 | 11/2003 |
| JP | 2004174224 | 6/2004 |
| JP | 2004232397 | 8/2004 |
| JP | 2004261451 | 9/2004 |
| JP | 2004265992 | 9/2004 |
| JP | 2004271516 | 9/2004 |
| JP | 2004313762 | 11/2004 |
| JP | 2004-351173 | 12/2004 |
| JP | 2004351054 | 12/2004 |
| JP | 2005073736 | 3/2005 |
| JP | 2005111172 | 4/2005 |
| JP | 2005137494 | 6/2005 |
| JP | 2005137788 | 6/2005 |
| JP | 2020124360 A * | 8/2020 |
| JP | 7275611 B2 * | 5/2023 |
| WO | WO 2005/009543 A2 | 2/2005 |

OTHER PUBLICATIONS

First Office Action for related Japanese Application No. 2015-142657, dated Apr. 24, 2019, 7 pages (with English translation).

"Invalidity Search Report for Japanese Registered Patent No. 4128970," 4 pp. (dated Nov. 29, 2013).

Lindsey, "Info—Build a Better Blade," https://www.golfworks.com/build-a-better-blade/a/527/, 3 pages (May 2008).

Myspygolf, How This Tiny Thing Can Make a Huge Difference in Your Next Driver, CG Defined, https://mygolfspy.com/u golf-club-center-of-gravity-cg/ (May 2015).

* cited by examiner

GOLF CLUB

REFERENCE TO RELATED APPLICATIONS

This application is a continuation of U.S. patent application Ser. No. 17/105,043, filed Nov. 25, 2020, now U.S. Pat. No. 11,478,683, which is a continuation of U.S. patent application Ser. No. 16/193,116, filed Nov. 16, 2018, now U.S. Pat. No. 10,874,916, which is a continuation of U.S. patent application Ser. No. 14/573,701, filed Dec. 17, 2014, now U.S. Pat. No. 10,150,016, which is a continuation-in-part of U.S. patent application Ser. No. 14/457,883, filed Aug. 12, 2014, now abandoned, which claims priority to and benefit of U.S. Provisional Patent Application No. 62/027,692, filed Jul. 22, 2014, all of which are incorporated herein by reference in their entirety. This application references Application for U.S. Patent bearing Ser. No. 13/839,727, entitled "GOLF CLUB WITH COEFFICIENT OF RESTITUTION FEATURE," filed Mar. 15, 2013, which is incorporated by reference herein in its entirety and with specific reference to discussion of center of gravity location and the resulting effects on club performance. This application also references U.S. Pat. No. 7,731,603, entitled "GOLF CLUB HEAD," filed Sep. 27, 2007, which is incorporated by reference herein in its entirety and with specific reference to discussion of moment of inertia. This application also references U.S. Pat. No. 7,887,431, entitled "GOLF CLUB," filed Dec. 30, 2008, which is incorporated by reference herein in its entirety and with specific reference to discussion of adjustable loft and lie technology described therein and with reference to removable shaft technology and hosel sleeve connection systems. This application also references Application for U.S. Patent bearing Ser. No. 13/718,107, entitled "HIGH VOLUME AERODYNAMIC GOLF CLUB HEAD," filed Dec. 18, 2012, which is incorporated by reference herein in its entirety and with specific reference to discussion of aerodynamic golf club heads. This application also references U.S. Pat. No. 7,874,936, entitled "COMPOSITE ARTICLES AND METHODS FOR MAKING THE SAME," filed Dec. 19, 2007, which is incorporated by reference herein in its entirety and with specific reference to discussion of composite face technology. This application also references Application for U.S. Patent bearing Ser. No. 14/144,105, entitled "GOLF CLUB," filed Dec. 30, 2013, which is incorporated by reference herein in its entirety and with specific reference to discussion of moment of inertia, center of gravity placement, and the effect of center of gravity placement on mechanics of golf club heads. This Application also references Application for U.S. Patent bearing Ser. No. 12/813,442, entitled "GOLF CLUB," filed Jun. 10, 2010, which is incorporated by reference herein in its entirety and with specific reference to discussion of variable face thickness. This Application references Application for U.S. Patent bearing Ser. No. 12/791,025, entitled "HOLLOW GOLF CLUB HEAD," filed Jun. 1, 2010, and Application for U.S. Patent bearing Ser. No. 13/338,197, entitled "FAIRWAY WOOD CENTER OF GRAVITY PROJECTION," filed Dec. 27, 2011, which are incorporated by reference herein in their entirety and with specific reference to slot technology and coefficient of restitution features. This Application also references U.S. Pat. No. 6,773,360, entitled "GOLF CLUB HEAD HAVING A REMOVABLE WEIGHT," filed Nov. 8, 2002, which is incorporated by reference herein in its entirety and with specific reference to discussion of removable weight. This Application also references U.S. Pat. No. 7,166,040, entitled "REMOVABLE WEIGHT AND KIT FOR GOLF CLUB HEAD," filed Feb. 23, 2004, which is a continuation-in-part of U.S. Pat. No. 6,773,360, entitled "GOLF CLUB HEAD HAVING A REMOVABLE WEIGHT," and which is incorporated by reference herein in its entirety and with specific reference to removable weight technology. This application also references Application for U.S. Patent bearing Ser. No. 13/841,325, entitled "GOLF CLUB HEAD," filed Mar. 15, 2013, Application for U.S. Patent bearing Ser. No. 13/946,918, entitled "GOLF CLUB HEAD," filed Jul. 19, 2013, and U.S. Pat. No. 7,775,905, entitled "GOLF CLUB HEAD WITH REPOSITIONABLE WEIGHT," filed Dec. 19, 2006, which are incorporated by reference herein in their entirety and with specific reference to sliding fasteners.

TECHNICAL FIELD

The current disclosure relates to golf club heads. More specifically, the current disclosure relates to golf club heads with features for improving playability, including at least one of relocation of center of gravity and boundary condition features.

SUMMARY

A golf club head includes a golf club body including a crown, a sole, and a skirt connected between the crown and the sole, the golf club body including a front including a leading edge and a back including a trailing edge, and a hosel connected to the golf club body; a face connected to the front of the golf club body, the face including a geometric center, the golf club head including modifiable boundary conditions.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1B:
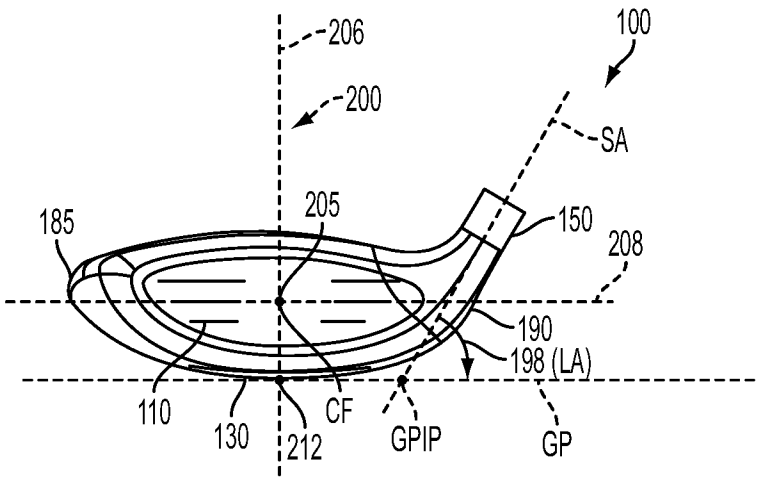
FIG. 1B is a face side view of the golf club head of FIG. 1A.

Disclosed is a golf club including a golf club head and associated methods, systems, devices, and various apparatus. It would be understood by one of skill in the art that the disclosed golf club is described in but a few exemplary embodiments among many. No particular terminology or description should be considered limiting on the disclosure or the scope of any claims issuing therefrom. For the sake of simplicity, standard unit abbreviations may be used, including but not limited to, "mm" for millimeters, "in." for inches, "lb." for pounds force, "mph" for miles per hour, and "rps" for revolutions per second, among others.

Portions of the following disclosure are coincident with application for U.S. patent bearing Ser. No. 13/839,727, entitled "GOLF CLUB WITH COEFFICIENT OF RESTITUTION FEATURE," filed Mar. 15, 2013, which is incorporated by reference herein in its entirety. Although portions of the disclosure have been omitted from the current disclosure in the interest of efficiency, one of skill in the art would understand that the features and designs disclosed in the referenced application would apply to the descriptions of the technology of the current disclosure, and the full incorporation of application for U.S. patent bearing Ser. No. 13/839,727 is beneficial for a complete understanding of the scope of the current disclosure. Additionally, claimed subject matter may include features or descriptions supplied in more full detail by the incorporation of application for U.S. patent bearing Ser. No. 13/839,727, and claims covering content in the reference application are related to the disclosure such application.

In the game of golf, when a player increases his or her distance with a given club, the result nearly always provides an advantage to the player. While golf club design aims to maximize the ability of a player to hit a golf ball as far as possible, the United States Golf Association—a rulemaking body in the game of golf—has provided a set of rules to govern the game of golf. These rules are known as The Rules of Golf and are accompanied by various Decisions on The Rules of Golf. Many rules promulgated in The Rules of Golf affect play. Some of The Rules of Golf affect equipment, including rules designed to indicate when a club is or is not legal for play. Among the various rules are maximum and minimum limits for golf club head size, weight, dimensions, and various other features. For example, no golf club head may be larger than 460 cubic centimeters in volume. No golf club face may have a coefficient of restitution (COR) of greater than 0.830, wherein COR describes the efficiency of the golf club head's impact with a golf ball.

COR is a measure of collision efficiency. COR is the ratio of the velocity of separation to the velocity of approach. In this model, therefore, COR is determined using the following formula:

$$COR=(v_{club\text{-}post}-v_{ball\text{-}post})\div(v_{ball\text{-}pre}-v_{club\text{-}pre})$$

where, $v_{club\text{-}post}$ represents the velocity of the club after impact;

$v_{ball\text{-}post}$ represents the velocity of the ball after impact;

$v_{club\text{-}pre}$ represents the velocity of the club before impact (a value of zero for USGA COR conditions); and $v_{ball\text{-}pre}$ represents the velocity of the ball before impact.

Although the USGA specifies the limit for maximum COR, there is no specified region in which COR may be maximized. While multiple golf club heads have achieved the maximum 0.830 COR, the region in which such COR may be found has generally been limited—typically, in a region at a geometric center of the face of the golf club head or in a region of maximum COR that is in relatively small proximity thereto. Many golf club heads are designed to launch a golf ball as far as possible within The Rules of Golf when properly struck. However, even the greatest of professional golfers do not strike each and every shot perfectly. For the vast majority of golfers, perfectly struck golf shots are an exception if not a rarity.

There are several methods to address a particular golfer's inability to strike the shot purely. One method involves the use of increased Moment of Inertia (MOI). Increasing MOI prevents the loss of energy for strikes that do not impact the center of the face by reducing the ability of the golf club head to twist on off-center strikes. Particularly, most higher-MOI designs focus on moving weight to the perimeter of the golf club head, which often includes moving a center of gravity of the golf club head back in the golf club head, toward a trailing edge.

Another method involves use of variable face thickness (VFT) technology. With VFT, the face of the golf club head is not a constant thickness across its entirety, but rather varies. For example, as described in application for U.S. patent bearing Ser. No. 12/813,442, entitled "GOLF CLUB," filed Jun. 10, 2010—which is incorporated herein by reference in its entirety—the thickness of the face varies in an arrangement with a dimension as measured from the center of the face. This allows the area of maximum COR to be increased as described in the reference.

While VFT is excellent technology, it can be difficult to implement in certain golf club designs. For example, in the design of fairway woods, the height of the face is often too small to implement a meaningful VFT design. Moreover, there are problems that VFT cannot solve. For example, edges of the golf club face tend to be more rigid than the center of the golf club face because the edges include connection features to the sole, crown, or skirt of the golf club head. Because the edges of the typical golf club face are integrated (either through a welded construction or as a single piece), a strike that is close to an edge of the face necessarily results in poor COR as it is proximate the rigid edge. It is common for a golfer to strike the golf ball at a location on the golf club head other than the center of the face. Typical locations may be high on the face or low on the face for many golfers. Both situations result in reduced COR. However, particularly with low face strikes, COR decreases very quickly. In various embodiments, the COR for strikes 5 mm below center face may be 0.020 to 0.035 difference. Further off-center strikes may result in greater COR differences.

To combat the negative effects of off-center strikes, certain designs have been implemented. For example, as described in application for U.S. patent bearing Ser. No. 12/791,025, entitled "HOLLOW GOLF CLUB HEAD," filed Jun. 1, 2010, and application for U.S. patent bearing Ser. No. 13/338,197, entitled "FAIRWAY WOOD CENTER OF GRAVITY PROJECTION," filed Dec. 27, 2011—both of which are incorporated by reference herein in their entirety—coefficient of restitution features located in various locations of the golf club head provide advantages. In particular, for strikes low on the face of the golf club head, the coefficient of restitution features allow greater flexibility than would typically be seen otherwise from a region low on the face of the golf club head. In general, the low point on the face of the golf club head is not flexible and, although not entirely rigid, does not experience the COR that may be seen in the geometric center of the face.

Although coefficient of restitution features allow for greater flexibility, they can often be cumbersome to implement. For example, in the designs above, the coefficient of restitution features are placed in the body of the golf club head but proximal to the face. While the close proximity enhances the effectiveness of the coefficient of restitution features, it creates challenges from a design perspective. Manufacturing the coefficient of restitution features may be difficult in some embodiments. Particularly with respect to application for U.S. patent bearing Ser. No. 13/338,197, entitled "FAIRWAY WOOD CENTER OF GRAVITY PROJECTION," filed Dec. 27, 2011, the coefficient of restitution feature includes a sharp corner at the vertical extent of the coefficient of restitution feature that experiences extremely high stress under impact conditions. It may become difficult to manufacture such features without compromising their structural integrity in use. Further, the coefficient of restitution features necessarily extend into the golf club body, thereby occupying space within the golf club head. The size and location of the coefficient of restitution features may make mass relocation difficult in various designs, particularly when it is desirous to locate mass in the region of the coefficient of restitution feature.

In particular, one challenge with current coefficient of restitution feature designs is the ability to locate the center of gravity (CG) of the golf club head proximal to the face. As described in application for U.S. patent bearing Ser. No. 13/839,727, entitled "GOLF CLUB WITH COEFFICIENT OF RESTITUTION FEATURE," filed Mar. 15, 2013 and application for U.S. patent bearing Ser. No. 14/144,105, entitled "GOLF CLUB," filed Dec. 30, 2013, it has been discovered that it is desirous to locate the CG low in the golf club head. Such location of CG provides a low projection of CG onto the face of the golf club head, which results in reduced spin, leading to greater distance. In certain types of heads, it may still be the most desirable design to locate the CG of the golf club head as low as possible regardless of its location within the golf club head. However, for reasons explained in the references cited, it has unexpectedly been determined that a low and forward CG location may provide some benefits not seen in prior designs or in comparable designs without a low and forward CG.

For reference, within this disclosure, reference to a "fairway wood type golf club head" means any wood type golf club head intended to be used with or without a tee. For reference, "driver type golf club head" means any wood type golf club head intended to be used primarily with a tee. In general, fairway wood type golf club heads usually have lofts of greater than 14 degrees. In general, driver type golf club heads have lofts of 14 degrees or less, and, more usually, 12 degrees or less. In general, fairway wood type golf club heads have a length from leading edge to trailing edge of 73-97 mm. Various definitions distinguish a fairway wood type golf club head form a hybrid type golf club head, which tends to resemble a fairway wood type golf club head but be of smaller length from leading edge to trailing edge. In general, hybrid type golf club heads are 38-73 mm in length from leading edge to trailing edge. Hybrid type golf club heads may also be distinguished from fairway wood type golf club heads by weight, by lie angle, by volume, and/or by shaft length. Fairway wood type golf club heads of the current disclosure preferably are 16 degrees of loft. In various embodiments, fairway wood type golf club heads of the current disclosure may be from 15-19.5 degrees. In various embodiments, fairway wood type golf club heads of the current disclosure may be from 13-17 degrees. In various embodiments, fairway wood type golf club heads of the current disclosure may be from 13-19.5 degrees. In various embodiments, fairway wood type golf club heads of the current disclosure may be from 13-26 degrees. Additionally, most fairway wood type golf club heads are between 150 cc and 250 cc in volume as measured according to methods of the USGA. See U.S.G.A. "Procedure for Measuring the Club Head Size of Wood Clubs," Revision 1.0.0, Nov. 21, 2003, for the methodology to measure the volume of a wood-type golf club head. Exemplary fairway wood type golf club heads of the current disclosure may be between 180 cc and 240 cc. In various embodiments, fairway wood type golf club heads of the current disclosure are between 200 cc and 220 cc. Driver type golf club heads of the current disclosure preferably are 12 degrees or less of loft in various embodiments. Driver type golf club heads of the current disclosure may be 10.5 degrees or less in various embodiments. Driver type golf club heads of the current disclosure may be between 9 degrees and 14 degrees of loft in various embodiments. In various embodiments, driver type golf club heads may be as much as 16 degrees of loft. Additionally, most driver-type golf club heads are over 375 cc in volume. Exemplary driver-type golf club heads of the current disclosure may be over 425 cc in volume. In some embodiments, driver-type golf club heads of the current disclosure are between 440 cc and 460 cc in volume.

One embodiment of a golf club head 100 is disclosed and described with reference to FIGS. 1A-1D. As seen in FIG. 1A, the golf club head 100 includes a face 110, a crown 120, a sole 130, a skirt 140, and a hosel 150. Major portions of the golf club head 100 not including the face 110 are considered to be the golf club body for the purposes of this disclosure. A coefficient of restitution feature (CORF) 300 is seen in the sole 130 of the golf club head 100. In various embodiments, features of the golf club head 100 may include CORF 300 or may be found without CORF 300. In various embodiments, modifications to CORF 300 may be included and would be understood by one of skill in the art to be intended to be included within the scope of the current disclosure.

A three dimensional reference coordinate system 200 is shown. An origin 205 of the coordinate system 200 is located at the geometric center of the face (CF) of the golf club head 100. See U.S.G.A. "Procedure for Measuring the Flexibility of a Golf Clubhead," Revision 2.0, Mar. 25, 2005, for the methodology to measure the geometric center of the striking face of a golf club. The coordinate system 200 includes a z-axis 206, a y-axis 207, and an x-axis 208 (shown in FIG. 1B). Each axis 206,207,208 is orthogonal to each other axis 206,207,208. The golf club head 100 includes a leading edge 170 and a trailing edge 180. For the purposes of this disclosure, the leading edge 170 is defined by a curve, the curve being defined by a series of forwardmost points, each forwardmost point being defined as the point on the golf club head 100 that is most forward as measured parallel to the y-axis 207 for any cross-section taken parallel to the plane formed by the y-axis 207 and the z-axis 206. The face 110 may include grooves or score lines in various embodiments. In various embodiments, the leading edge 170 may also be the edge at which the curvature of the particular section of the golf club head departs substantially from the roll and bulge radii.

As seen with reference to FIG. 1B, the x-axis 208 is parallel to a ground plane (GP) onto which the golf club head 100 may be properly soled—arranged so that the sole 130 is in contact with the GP. The y-axis 207 is also parallel to the GP and is orthogonal to the x-axis 208. The z-axis 206 is orthogonal to the x-axis 208, the y-axis 207, and the GP. The golf club head 100 includes a toe 185 and a heel 190. The golf club head 100 includes a shaft axis (SA) defined along an axis of the hosel 150. When assembled as a golf club, the golf club head 100 is connected to a golf club shaft (not shown). Typically, the golf club shaft is inserted into a shaft bore 245 defined in the hosel 150. As such, the arrangement of the SA with respect to the golf club head 100 can define how the golf club head 100 is used. The SA is aligned at an angle 198 with respect to the GP. The angle 198 is known in the art as the lie angle (LA) of the golf club head 100. A ground plane intersection point (GPIP) of the SA and the GP is shown for reference. In various embodiments, the GPIP may be used a point of reference from which features of the golf club head 100 may be measured or referenced. As shown with reference to FIG. 1A, the SA is located away from the origin 205 such that the SA does not directly intersect the origin or any of the axes 206,207,208 in the current embodiment. In various embodiments, the SA may be arranged to intersect at least one axis 206,207,208 and/or the origin 205. A z-axis ground plane intersection point 212 can be seen as the point that the z-axis intersects the GP.

Figure 1D:
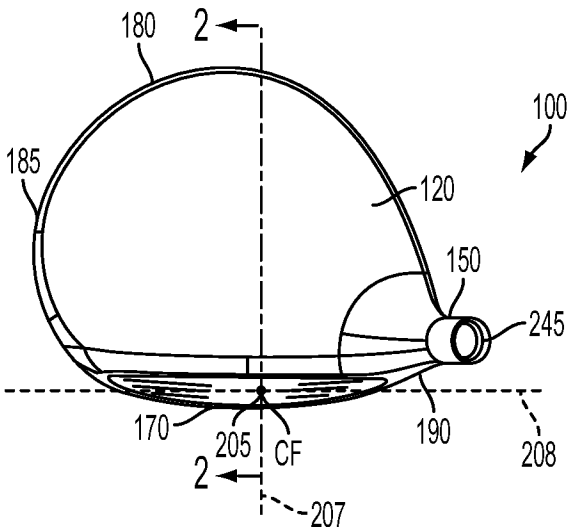
FIG. 1D is a top view of the golf club head of FIG. 1A.
Figure 1A:
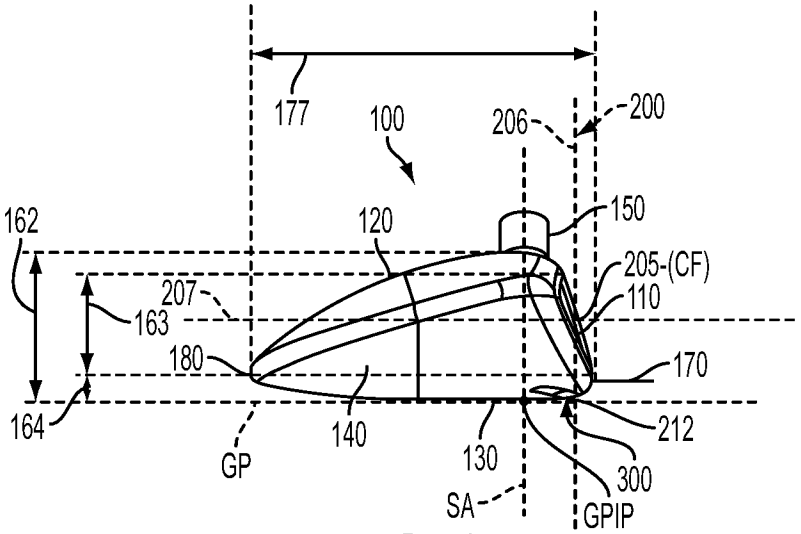
FIG. 1A is a toe side view of a golf club head in accord with one embodiment of the current disclosure.
Figure 1C:
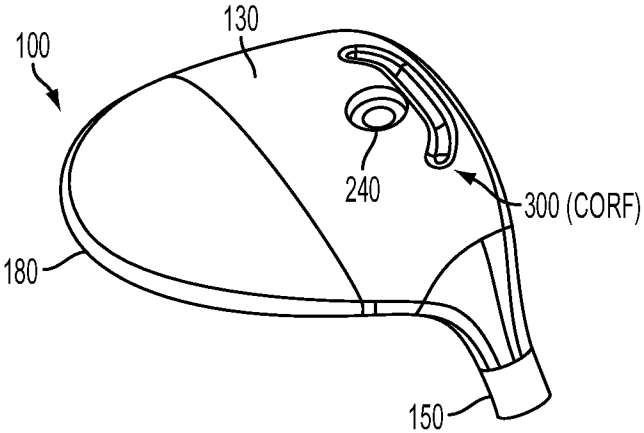
FIG. 1C is a perspective view of the golf club head of FIG. 1A.

As seen with reference to FIG. 1C, the coefficient of restitution feature 300 (CORF) is shown defined in the sole 130 of the golf club head 100. A modular weight port 240 is shown defined in the sole 130 for placement of removable weights. Various embodiments and systems of removable weights and their associated methods and apparatus are described in greater detail with reference to U.S. Pat. No. 6,773,360, entitled "GOLF CLUB HEAD HAVING A REMOVABLE WEIGHT," filed Nov. 8, 2002, and U.S. Pat. No. 7,166,040, entitled "REMOVABLE WEIGHT AND KIT FOR GOLF CLUB HEAD," filed Feb. 23, 2004, which are incorporated by reference herein in their entirety. The top view seen in FIG. 1D shows another view of the golf club head 100. The shaft bore 245 can be seen defined in the hosel 150. The cutting plane or cross section for FIG. 2 can also be seen in FIG. 1D. The cutting plane for FIG. 2 coincides with the y-axis 207.

Referring back to FIG. 1A, a crown height 162 is shown and measured as the height from the GP to the highest point of the crown 120 as measured parallel to the z-axis 206. In the current embodiment, the crown height 162 is about 36 mm. In various embodiments, the crown height 162 may be 34-40 mm. In various embodiments, the crown height may be 32-44 mm. In various embodiments, the crown height may be 30-50 mm. The golf club head 100 also has an effective face height 163 that is a height of the face 110 as measured parallel to the z-axis 206. The effective face height 163 measures from a highest point on the face 110 to a lowest point on the face 110 proximate the leading edge 170. A transition exists between the crown 120 and the face 110 such that the highest point on the face 110 may be slightly variant from one embodiment to another. In the current embodiment, the highest point on the face 110 and the lowest point on the face 110 are points at which the curvature of the face 110 deviates substantially from a roll radius. In some embodiments, the deviation characterizing such point may be a 10% change in the radius of curvature. In the current embodiment, the effective face height 163 is about 27.5 mm. In various embodiments, the effective face height 163 may be 2-7 mm less than the crown height 162. In various embodiments, the effective face height 163 may be 2-12 mm less than the crown height 162. An effective face position height 164 is a height from the GP to the lowest point on the face 110 as measured in the direction of the z-axis 206. In the current embodiment, the effective face position height 164 is about 4 mm. In various embodiments, the effective face position height 164 may be 2-6 mm. In various embodiments, the effect face position height 164 may be 0-10 mm. A length 177 of the golf club head 177 as measured in the direction of the y-axis 207 is seen as well with reference to FIG. 1A. In the current embodiment, the length 177 is about 85 mm. In various embodiments, the length 177 may be 80-90 mm. In various embodiments, the length 177 may be 73-97 mm. The distance 177 is a measurement of the length from the leading edge 170 to the trailing edge 180. The distance 177 may be dependent on the loft of the golf club head in various embodiments. In one embodiment, the loft of the golf club head is about 15 degrees and the distance 177 is about 91.6 mm. In one embodiment, the loft of the golf club head is about 18 degrees and the distance 177 is about 87.4 mm. In one embodiment, the loft of the golf club head is about 21 degrees and the distance 177 is about 86.8 mm.

Figure 2:
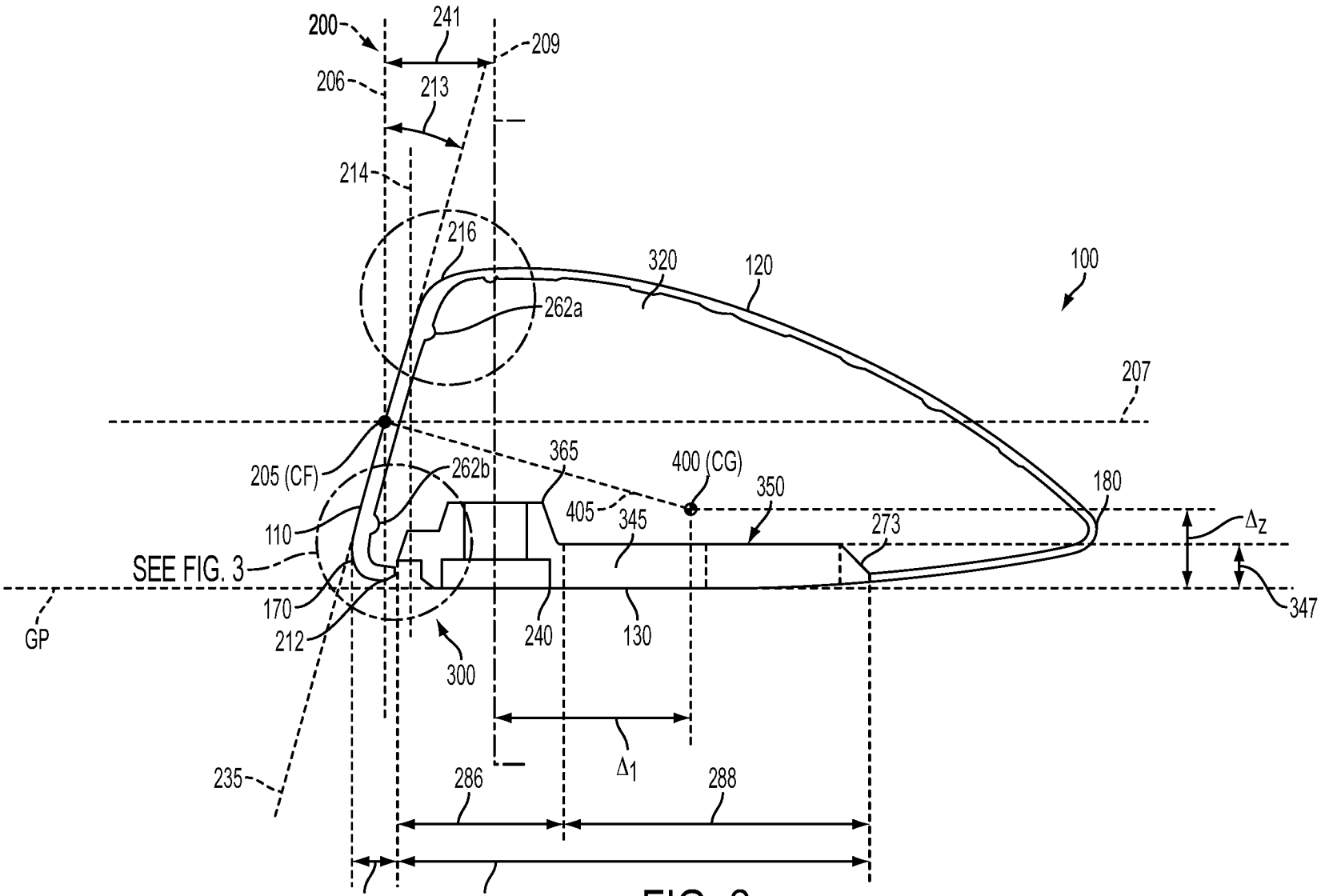
FIG. 2 is a cross-sectional view of the golf club head taken in the plane indicated by line 2-2 of FIG. 1D.

The cutaway view of FIG. 2 shows the hollow nature of the golf club head 100. The golf club head 100 of the current embodiment defines an interior 320 that is bounded by the portions of the golf club head 100 already discussed, including the face 110, crown 120, sole 130, and skirt 140, among other possible features that may provide a boundary to the interior. In the current embodiment, the modular weight port 240 provides access from any region exterior of the golf club head 100 to the interior 320. In various embodiments, the weight port 240 may be omitted. One object among many of the current embodiment is to provide at least one of a low center of gravity and a forward center of gravity while maintaining a CORF 300. In various embodiments, low center of gravity may be achieved without the inclusion of a CORF 300 and may provide at least one object of the current disclosure. In the current embodiment, a second weight pad portion 345 provides a region of increased mass low inside the golf club head 100. Both a first weight pad portion 365 and the second weight pad portion 345 are portions of a weight pad 350 of the current embodiment. The weight pad 350 is integral with the golf club head 100 in the current embodiment. In various embodiments, the weight pad 350 may be of various materials and may be joined to the golf club head 350. For example, in various embodiments, the weight pad 350 may be of tungsten, copper, lead, various alloys, and various other high density materials if a relocation of mass in the direction of the weight pad 350 is desired. If the weight pad 350 is a separate part joined to the golf club head 100, the weight pad 350 may be joined to the golf club head 100 via welding, gluing, epoxy, mechanical fixing such as with fasteners or with key fit arrangements, or various other interface joining methods. In various embodiments, the weight pad 350 may be arranged on the inside or on the outside of the golf club head 100. The first weight pad portion 365 extends a distance 286 in the direction of the y-axis 207; the second weight pad portion 345 extends a distance 288 in the direction of the y-axis 207; together, a length 290 defines the entirety of the weight pad 350 in the direction of the y-axis 207 and preferably is about 55 mm. In various embodiments, the length 290 may be 50-60 mm. In various embodiments, the length 290 may be 45-62 mm. As seen, the weight pad 350 is offset from the leading edge 170 a distance 361, as discussed in further detail below with reference to FIG. 3. In the current embodiment, the distance 361 is 5.3 mm, and in various embodiments it may be desired for the distance 361 to be as small as possible. In various embodiments, the distance 361 may be 4.5-6.5 mm. The second weight pad portion 345 is of a thickness 347 as measured in the direction of the z-axis. In the current embodiment, the thickness 347 is about 3.6 mm. In various embodiments, the thickness 347 may be 2-4 mm. In various embodiments, the thickness 347 may be up to 5 mm. An end 273 of the weight pad 350 is seen in the cutaway view (further detail seen in FIG. 5). The end 273 is sloped for weight distribution and manufacturability.

For reference, a center line 214 that is parallel to the z-axis 206 is shown at the center of the CORF 300 in the view of FIG. 2. The location of the center line 214 is provided in greater detail below with reference to FIG. 3. A face-to-crown transition point 216 is also seen in the view. The face-to-crown transition point 216 is the point at which the face 110 stops and the crown 120 begins in a plane cut along the y-axis 207, which is at the origin 205 in the current embodiment or, globally, at CF. It is understood that the face 110 and crown 120 transition along a curve, and the face-to-crown transition point 216 is located only in the plane of the y-axis 207 in the current embodiment, or, globally, in a plane intersecting CF under any coordinate system. Because of roll radius and bulge radius of the face 110, the face-to-crown transition point 216 the transition between the face 110 and crown 120 is no closer to the origin 205 in any geometric space than at the face-to-crown transition point 216 in the current embodiment. Additionally, no part of the transition from face 110 to crown 120 is closer to the z-axis 206 as measured parallel to the y-axis 207. As can be seen in the view of FIG. 2, the center line 214 is closer to the z-axis 206 at all points as measured parallel to the y-axis 207 than the face-to-crown transition point 216. As such, no point of the transition between the face 110 and crown 120 is closer to the z-axis 206 than a center line passing through the center of the CORF 300 as measured parallel to the y-axis 207, and, as such the CORF 300 is closer to the origin 205 (CF) than the transition of the face 110 to the crown 120 at any point in the current embodiment. It should be noted that, as loft of the golf club head 100 reduces, the face-to-crown transition point 206 may approach the center line 214—for example, in driver-type golf club heads. However, the disclosure is accurate for the current embodiment and for all lofts of 13 degrees or greater.

Also seen in FIG. 2, a shaft plane z-axis 209 is seen. The shaft plane z-axis 209 is parallel to z-axis 206 but is in the same plane as the SA. For reference the view of FIG. 6 shows the location of the shaft plane z-axis 209 in the same cutting plane as the SA. The shaft plane z-axis 209 is located a distance 241 from the z-axis 206 as measured in the direction of the y-axis 207. In the current embodiment, the distance 241 is 13.25 mm. In various embodiments, the distance 241 may be 13-14 mm. In various embodiments, the distance 241 may be 10-17 mm. In various embodiments, the distance 241 may be as little as 1 mm and as large as 24 mm. In the current embodiment, the shaft plane z-axis 209 is located collinearly with a center of the modular weight port 240. The location of the modular weight port 240 need not be correlated to the shaft plane z-axis 209 for all embodiments.

With returning reference to FIG. 2, in the current embodiment, the CORF 300 is defined in the sole 130 of the golf club head 100 such that the interior 320 of the golf club head 100 is not physically bounded by metal on all sides of the golf club head 100. In the current embodiment, the CORF 300 is a through-slot, thereby being defined as an open region such that the interior 320 of the golf club head 100 is not separated from the exterior at the CORF 300. The CORF 300 of the current embodiment decouples the face 110 from the sole 130. Such a feature provides multiple unexpected advantages, as will be described in greater detail with reference to application for U.S. patent bearing Ser. No. 13/839,727, entitled "GOLF CLUB WITH COEFFICIENT OF RESTITUTION FEATURE," filed Mar. 15, 2013, which is incorporated by reference herein in its entirety. In various embodiments, the various features of the CORF 300 may include various shapes, sizes, and various embodiments to achieve desired results. In multiple embodiments, the golf club head 100 includes a face 110 that is fabricated separately and is secured to the golf club head 100 after fabrication. In the current embodiment, the face 110 is secured to the golf club head 100 by welding. Weld beads 262*a,b* are seen in the current embodiment. A tangent face plane 235 (TFP) can be seen in the profile view as well. The TFP 235 is a plane tangent to the face 110 at the origin 205 (at CF).

The TFP 235 approximates a plane for the face 110, even though the face 110 is curved at a roll radius and a bulge radius. The TFP 235 is angled at an angle 213 with respect to the z-axis 206. The angle 213 in the current embodiment is the same as a loft angle of the golf club head as would be understood by one of ordinary skill in the art. For the current embodiment, the SA is entirely within a plane parallel to the plane formed by the x-axis 208 and the z-axis 206. In some embodiments, the SA will not be in a plane parallel to the plane formed by the x-axis 208 and the z-axis 206. In such embodiments, the shaft plane z-axis 209 will be a plane parallel to the plane formed by the x-axis 208 and the z-axis 206 and intersecting the GPIP.

A center of gravity 400 (CG) of the golf club head 100 is seen in FIG. 2. Because the weight pad 350 makes up a large portion of the mass of the golf club head 100, the CG 400 is located relatively proximate the weight pad 350. The distance of the CG 400 from the GP as measured in the direction of the z-axis 206 is seen and labeled as $\Delta_z$ in the current view. In the current embodiment, $\Delta_z$ is about 12 mm. In at least one embodiment, $\Delta_z$ is between 9 mm and 10 mm. In various embodiments, $\Delta_z$ may be 11-13 mm. In various embodiments, $\Delta_z$ may be 10-14 mm. In various embodiments, $\Delta_z$ may be 8-12 mm. In various embodiments, $\Delta_z$ may be 8-16 mm. Similarly, a distance labeled as $\Delta_1$ is seen as the distance from the shaft plane z-axis 209 to the CG 400 as measured in the direction of the y-axis 207. In the current embodiment, $\Delta_1$ is about 11.5 mm. In various embodiments, $\Delta_1$ may be between and including 11 mm and 13 mm. In various embodiments, $\Delta_1$ may be between and including 10 mm and 14 mm. In various embodiments, $\Delta_1$ may be between and including 8 mm and 16 mm.

The location of the CG 400 and the actual measurements of $\Delta_z$ and $\Delta_1$ affect the playability of the golf club head 100. A projection 405 of the CG 400 can be seen orthogonal to the TFP 235. A projection point (not labeled in the current embodiment) is a point at which the projection 405 intersects the TFP 235. In the current embodiment, the location of the CG 400 places the projection point at about the center of the face 110, which is the location of the origin 205 (at CF) in the current embodiment. In various embodiments, the projection point may be in a location other than the origin 205 (at CF).

The location of the CG 400—particularly the dimensions $\Delta_z$ and $\Delta_1$—affect the use of the golf club head 100. Particularly with fairway wood type golf club heads similar to the golf club head 100, small $\Delta_z$ has been used in various golf club head designs. Many designs have attempted to maximize $\Delta_1$ within the parameters of the particular golf club head under design. Such a design may focus on MOI, as rearward movement of the CG can increase MOI in some designs.

However, there are several drawbacks to rearward CG location. One such drawback is dynamic lofting. Dynamic lofting occurs during the golf swing when the $\Delta_1$ (for any club, $\Delta_1$ is the distance from the shaft plane to the CG measured in the direction of the y-axis 207) is particularly large. Although the loft angle (seen in the current embodiment as angle 213) is static, when the $\Delta_1$ is large, the CG of the golf club head is in position to cause the loft of the club head to increase during use. This occurs because, at impact, the offset CG of the golf club head from the shaft axis creates a moment of the golf club head about the x-axis 208 that causes rotation of the golf club head about the x-axis 208. The larger $\Delta_1$ becomes, the greater the moment arm to generate moment about the x-axis 208 becomes. Therefore, if $\Delta_1$ is particularly large, greater rotation is seen of the golf club head about the x-axis 208. The increased rotation leads to added loft at impact.

Dynamic lofting may be desired in some situations, and, as such, low and rearward CG may be a desired design element. However, dynamic lofting causes some negative effects on the resulting ball flight. First, for each degree of added dynamic loft, launch angle increases by 0.5-0.8°. Second, for each degree of added dynamic loft, spin rate increases by about 200-250 rpm. The increased spin rate is due to several factors. First, the dynamic lofting simply creates higher loft, and higher loft leads to more backspin. However, the second and more unexpected explanation is gear effect. The projection of a rearward CG onto the face of the golf club head creates a projection point above center face (center face being the ideal impact location for most golf club heads). Gear effect theory states that, when the projection point is offset from the strike location, the gear effect causes rotation of the golf ball toward the projection point. Because center face is an ideal impact location for most golf club heads, offsetting the projection point from the center face can cause a gear effect on perfectly struck shots. Particularly with rearward CG fairway woods, loft of the golf club head causes the projection point to be above the center face—or, above the ideal strike location. This results in a tumbling motion of the head such that the gear effect increases backspin on center strikes, generating even greater backspin. Backspin may be problematic in some designs because the ball flight will "balloon"—or, in other words, rise too quickly—and the distance of travel of the resultant golf shot will be shorter than for optimal spin conditions. A third problem with dynamic lofting is that, in extreme cases, the trailing edge of the golf club head may contact the ground, causing poor golf shots; similarly, the leading edge may raise off the ground, causing thin golf shots. It should be noted that the paragraph above assumes an ideal strike location of centerface. However, center face is not necessarily the predicted or ideal strike location, and in various embodiments the CG projection may be above center face but still below the intended strike location.

A further consideration with offsetting the CG such that the projection point is not aligned with center face is the potential loss of energy due to spin. Because of the aforementioned gear effect problem, moving the projection point anywhere other than the ideal strike location reduces the energy transfer on ideal strikes, as more energy is turned into spin. As such, golf club heads for which the projection point is offset from the ideal strike location may experience less distance on a given shot than golf club heads for which the projection point is aligned with the ideal strike location (assumed to be at center face).

As stated previously, in some embodiments, the events described above are desired outcomes of the design process. In the current embodiment, the location of the CG 400 creates a projection point (not labeled) that is closely aligned to the CF (at the origin 205).

As can be seen, the golf club head 100 of the current embodiment is designed to produce a small $\Delta_z$ and, thereby, to have a relatively low CG 400. In various embodiments, however, the size of $\Delta_1$ may become more important to the goal to achieve ideal playing conditions for a given set of design considerations.

A measurement of the location of the CG from the origin 205 (CF) along the y-axis 207—termed $CG_y$ distance—is a sum of $\Delta_1$ and the distance 241 between the z-axis 206 and the shaft plane z-axis 209. In the current embodiment of the golf club head 100, distance 241 is nominally 13.25 mm, and $\Delta_1$ is nominally 11.5 mm, although variations on the $CG_y$ distance are described herein. In the current embodiment, the $CG_y$ distance is 24.75 mm, although in various embodiments of the golf club head 100 the $CG_y$ distance may be as little as 18 mm and as large as 32 mm.

Knowing the $CG_y$ distance allows the use of a CG effectiveness product to describe the location of the CG in relation to the golf club head space. The CG effectiveness product is a measure of the effectiveness of locating the CG low and forward in the golf club head. The CG effectiveness product ($CG_{eff}$) is calculated with the following formula and, in the current embodiment, is measured in units of the square of distance ($mm^2$):

$$CG_{eff}=CG_y \times \Delta_z$$

With this formula, the smaller the $CG_{eff}$, the more effective the club head is at relocating mass low and forward. This measurement adequately describes the location of the CG within the golf club head without projecting the CG onto the face. As such, it allows for the comparison of golf club heads that may have different lofts, different face heights, and different locations of the CF. For the current embodiment, $CG_y$ is 24.75 mm and $\Delta_z$ is about 12 mm. As such, the $CG_{eff}$ of the current embodiment is about 297 $mm^2$. In various embodiments, $CG_{eff}$ is below 300 $mm^2$, as will be shown elsewhere in this disclosure. In various embodiments, $CG_{eff}$ of the current embodiments is below 310 $mm^2$. In various embodiments, $CG_{eff}$ of the current embodiments is below 315 $mm^2$. In various embodiments, $CG_{eff}$ of the current embodiments is below 325 $mm^2$.

Further, $CG_y$ distance informs the distance of the CG to the face as measured orthogonally to the TFP 235. The distance to the CG measured orthogonally to the TFP 235 is the distance of the projection 405. For any loft θ of the golf club head (which is the same as angle 213 for the current embodiment), the distance of the golf club face to the CG ($D_{CG}$) as measured orthogonally to the TFP 235 is described by the equation below:

$$D_{CG}=CG_y \times \cos(\theta)$$

For the current embodiment, a loft of 15 degrees and $CG_y$ of 24.75 mm means the $D_{CG}$ is about 23.9 mm. In various embodiments, $D_{CG}$ may be 20-25 mm. In various embodiments, $D_{CG}$ may be 15-30 mm. In various embodiments, $D_{CG}$ may be less than 35 mm. In various embodiments, $D_{CG}$ may be governed by its relationship to previously determined $CG_y$, $\Delta_1$, $\Delta_z$, or some other physical aspect of the golf club head 100.

Figure 3:
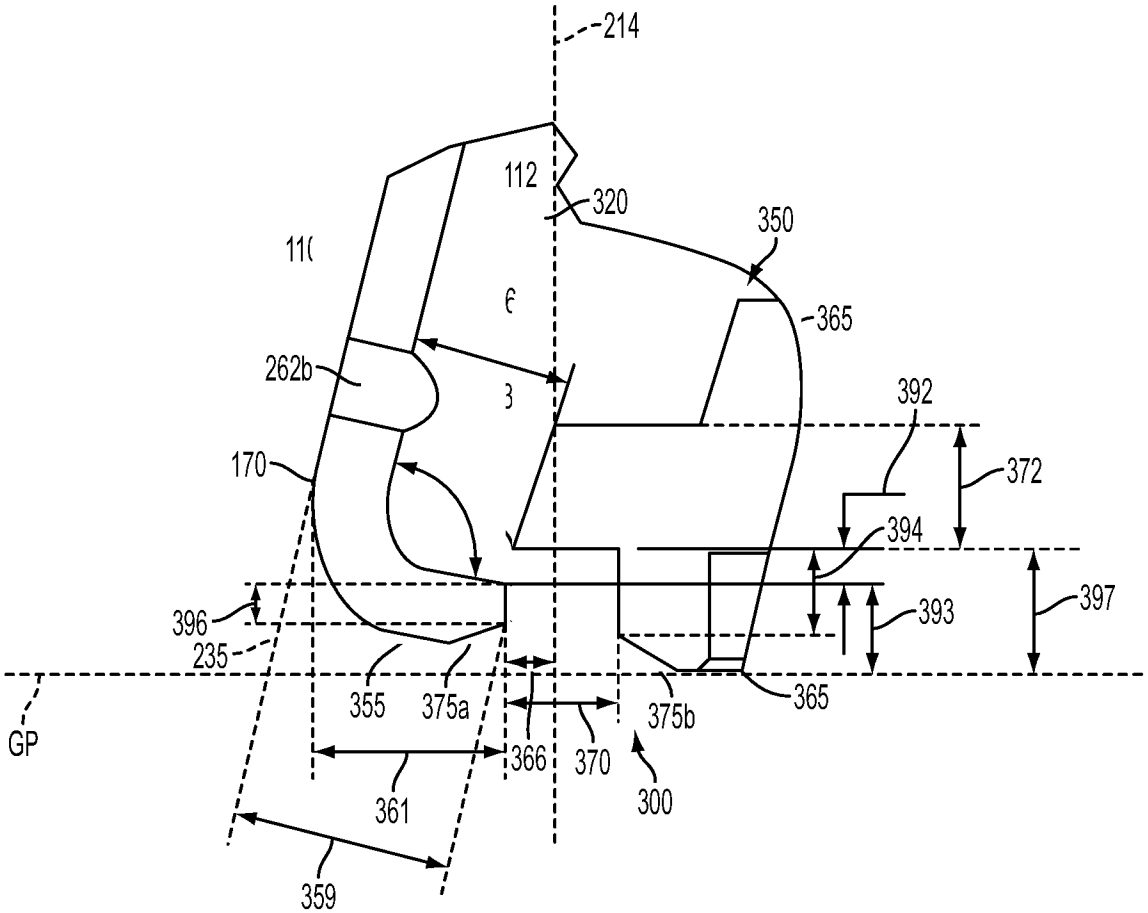
FIG. 3 is a detail view of detail 3 of FIG. 2.

The CORF 300 of the current embodiment is defined proximate the leading edge 170 of the golf club head 100, as seen with reference to FIG. 3. As previously discussed, the CORF 300 of the current embodiment is a through-slot providing a port from the exterior of the golf club head 100 to the interior 320. The CORF 300 is defined on one side by a first sole portion 355. The first sole portion 355 extends from a region proximate the face 110 to the sole 130 at an angle 357, which is acute in the current embodiment. In various embodiments, the first sole portion 355 is coplanar with the sole 130; however, it is not coplanar in the current embodiment. In the current embodiment, the angle 357 is about 88 degrees. In various embodiments, the angle 357 may be 85-90 degrees. In various embodiments, the angle 357 may be 82-92 degrees. The first sole portion 355 extends from the face 110 a distance 359 of about 5.6 mm as measured orthogonal to the TFP 235. In various embodiments, the distance 359 may be 5-6 mm. In various embodiments, the distance 359 may be 4-7 mm. In various embodiments, the distance 359 may be up to 12.5 mm. The first sole portion 355 projects along the y-axis 207 the distance 361 as measured to the leading edge 170, which is the same distance that the weight pad 350 is offset from the leading edge 170. In the current embodiment, the distance 361 is about 5 mm. In various embodiments, the distance 361 is 4.5-5.5 mm. In various embodiments, the distance 361 is 3-7 mm. In various embodiments, the distance 361 may be up to 10 mm. In the current embodiment, the distances 359,361 are measured at the cutting plane, which is coincident with the y-axis 207 and z-axis 206. In various embodiments, measurements—including angles and distances such as distances 359,361—may vary depending on the location where measured and as based upon the shape of the CORF 300.

The CORF 300 is defined over a distance 370 from the first sole portion 355 to the first weight pad portion 365 as measured along the y-axis. In the current embodiment, the distance 370 is about 3.0 mm. In various embodiments, the distance 370 may be larger or smaller. In various embodiments, the distance 370 may be 2.0-5.0 mm. In various embodiments, the distance 370 may be variable along the CORF 300. It would be understood by one of skill in the art that, in various embodiments, the first sole portion 355 may extend in a location for which no rearward vertical surface 385*b* is immediately adjacent and, as such, the distance 370 may become large if measured along the y-axis 207. As previously discussed, the center line 214 passes through the center of the CORF 300. The center of the CORF 300 is defined by a distance 366, which is exactly one half the distance 370. In the current embodiment, the distance 366 is 1.5 mm.

The CORF 300 is defined distal the leading edge 170 by the first weight pad portion 365. The first weight pad portion 365 in the current embodiment includes various features to address the CORF 300 as well as the modular weight port 240 defined in the first weight pad portion 365. In various embodiments, the first weight pad portion 365 may be various shapes and sizes depending upon the specific results desired. In the current embodiment, the first weight pad portion 365 includes an overhang portion 367 over the CORF 300 along the y-axis 207. The overhang portion 367 includes any portion of the weight pad 350 that overhangs the CORF 300. For the entirety of the disclosure, overhang portions include any portion of weight pads overhanging the CORFs of the current disclosure. The overhang portion 367 includes a faceward most point 381 that is the point of the overhang portion 367 furthest toward the leading edge 170 as measured in the direction of the y-axis 207.

The overhang portion 367 overhangs a distance that is about the same as the distance 370 of the CORF 300 in the current embodiment. In the current embodiment, the weight pad 350 (including the first weight pad portion 365 and the second weight pad portion 345) are designed to provide the lowest possible center of gravity of the golf club head 100. A thickness 372 of the overhang portion 367 is shown as measured in the direction of the z-axis 206. The thickness 372 may determine how mass is distributed throughout the golf club head 100 to achieve desired center of gravity location. The overhang portion 367 includes a sloped end 374 that is about parallel to the face 110 (or, more appropriately, to the TFP 235, not shown in the current view) in the current embodiment, although the sloped end 374 need not be parallel to the face 110 in all embodiments. A separation distance 376 is shown as the distance between an inner surface 112 of the face 110 and the sloped end 374 as measured orthogonally to the TFP 235. In the current embodiment, the separation distance 376 of about 4.5 mm is seen as the distance between the inner surface 112 of the face 110 and the sloped end 374 of the overhang portion 367 as measured orthogonal to the TFP 235. In various embodiments, the separation distance 376 may be 4-5 mm. In various embodiments, the separation distance 376 may be 3-6 mm. The CORF 300 includes a beveled edge 375 (shown as 375*a* and 375*b* in the current view). In the current embodiment, the beveled edge 375 provides some stress reduction function, as will be described in more detail later. In various embodiments, the distance that the overhang portion 367 overhangs the CORF 300 may be smaller or larger, depending upon the desired characteristics of the design.

As can be seen, an inside surface 382 of the first sole portion 355 extends downward toward the sole 130. The inside surface 382 terminates at a low point 384. The CORF 300 includes a vertical surface 385 (shown as 385*a,b* in the current view) that defines the edges of the CORF 300. The CORF 300 also includes a termination surface 390 that is defined along a lower surface of the overhang portion 367. The termination surface 390 is offset a distance 392 from the low point 384 of the inside surface 382. The offset distance 392 provides clearance for movement of the first sole portion 355, which may deform in use, thereby reducing the distance 370 of the CORF 300. Because of the offset distance 392, the vertical surface 385 is not the same for vertical surface 385*a* and vertical surface 385*b*. However, the vertical surface 385 is continuous around the CORF 300. In the current embodiment, the offset distance 392 is about 0.9 mm. In various embodiments, the offset distance 392 may be 0.2-2.0 mm. In various embodiments, the offset distance 392 may be up to 4 mm. An offset to ground distance 393 is also seen as the distance between the low point 384 and the GP. The offset to ground distance 393 is about 2.25 mm in the current embodiment. The offset to ground distance 393 may be 2-3 mm in various embodiments. The offset to ground distance 393 may be up to 5 mm in various embodiments. A rearward vertical surface height 394 describes the height of the vertical surface 385*b* and a forward vertical surface height 396 describes the height of the vertical surface 385*a*. In the current embodiment, the forward vertical surface height 396 is about 0.9 mm and the rearward vertical surface height 394 is about 2.2 mm. In various embodiments, the forward vertical surface height 396 may be 0.5-2.0 mm. In various embodiments, the rearward vertical surface height 394 may be 1.5-3.5 mm. A termination surface to ground distance 397 is also seen and is about 3.2 mm in the current embodiment. The termination surface to ground distance 397 may be 2.0-5.0 mm in various embodiments. The termination surface to ground distance 397 may be up to 10 mm in various embodiments.

In various embodiments, the vertical surface 385*b* may transition into the termination surface 390 via fillet, radius, bevel, or other transition. One of skill in the art would understand that, in various embodiments, sharp corners may not be easy to manufacture. In various embodiments, advantages may be seen from transitions between the vertical surface 385*b* and the termination surface 390. Relationships between these surfaces (385, 390) are intended to encompass these ideas in addition to the current embodiments, and one of skill in the art would understand that features such as fillets, radii, bevels, and other transitions may substantially satisfy such relationships. For the sake of simplicity, relationships between such surfaces shall be treated as if such features did not exist, and measurements taken for the sake of relationships need not include a surface that is fully vertical or horizontal in any given embodiment.

The thickness 372 of the overhang portion 567 of the current embodiment can be seen. The thickness 372 in the current embodiment is about 3.4 mm. In various embodiments, the thickness 372 may be 3-5 mm. In various embodiments, the thickness 372 may be 2-10 mm. As shown with relation to other embodiments of the current disclosure, the thickness 372 maybe greater if combined with features of those embodiments. Additionally, the rearward vertical surface height 394 defines the distance of the CORF 300 from the termination of the bevel 375 to the termination surface 390 as well as the distance of the vertical surface 385*b*, although such a relationship is not necessary in all embodiments. As can be seen, each of the offset distance 392, the offset to ground distance 393, and the vertical surface height 394 is less than the thickness 372. As such, a ratio of each of the offset distance 392, the offset to ground distance 393, and the vertical surface height 394 to the thickness 372 is less than or equal to 1. In various embodiments, the CORF 300 may be characterized in terms of the termination surface to ground distance 397. For the current embodiment, a ratio of the termination surface to ground distance 397 as compared to the thickness 372 is about 1, although it may be less in various embodiments. For the sake of this disclosure, the ratio of termination surface to ground distance 397 as compared to the thickness 372 is termed the "CORF mass density ratio." While the CORF mass density ratio provides one potential characterization of the CORF, it should be noted that all ratios cited in this paragraph and throughout this disclosure with relation to dimensions of the various weight pads and CORFs may be utilized to characterize various aspects of the CORFs, including mass density, physical location of features, and potential manufacturability. In particular, the CORF mass density ratio and other ratios herein at least provide a method of describing the effectiveness of relocating mass to the area of the CORF, among other benefits.

The CORF 300 may also be characterized in terms of distance 370. A ratio of the offset distance 392 as compared to the distance 370 is about equal to 1 in the current embodiment and may be less than 1 in various embodiments.

In various embodiments, the CORF 300 may be plugged with a plugging material (not shown). Because the CORF 300 of the current embodiment is a through-slot (providing a void in the golf club body), it is advantageous to fill the CORF 300 with a plugging material to prevent introduction of debris into the CORF 300 and to provide separation between the interior 320 and the exterior of the golf club head 100. Additionally, the plugging material may be chosen to reduce or eliminate unwanted vibrations, sounds, or other negative effects that may be associated with a through-slot. The plugging material may be various materials in various embodiments depending upon the desired performance. In the current embodiment, the plugging material is polyurethane, although various relatively low modulus materials may be used, including elastomeric rubber, polymer, various rubbers, foams, and fillers. The plugging material should not substantially prevent deformation of the golf club head 100 when in use (as will be discussed in more detail later).

Figure 4:
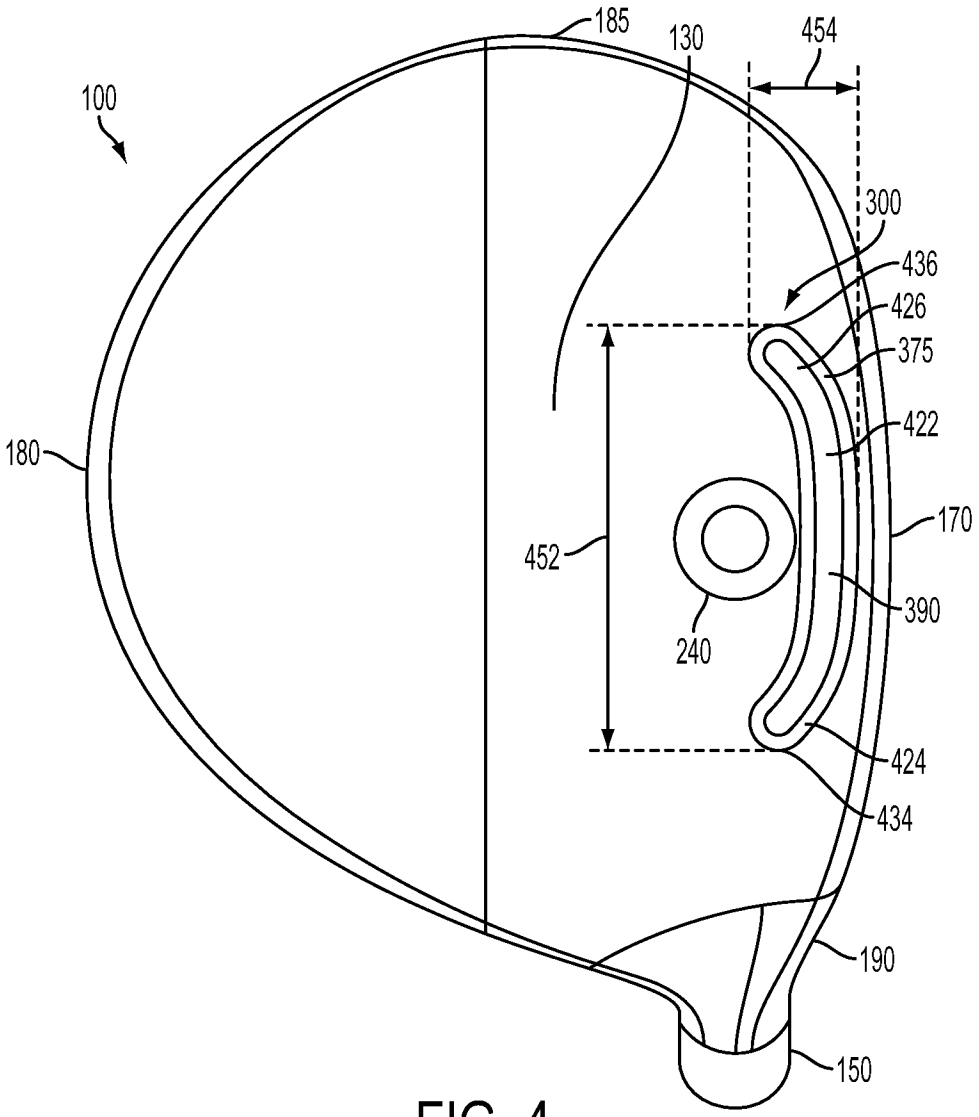
FIG. 4 is a bottom view of the golf club head of FIG. 1A.

The CORF 300 is shown in the view of FIG. 4. The CORF 300 of the current embodiment includes multiple portions that define its shape. The CORF 300 includes a central portion 422 that preferably extends most of the length of the CORF 300. The central portion 422 is relatively straight as compared to other portions of the CORF 300. In the current embodiment, the central portion 422 is a curve of a radius of about 100 mm. A profile of the central portion 422 approximately follows the profile of the leading edge 170 such that the curvature of the central portion 422 does not substantially deviate from a curvature of the leading edge 170. The distance 370 can be seen as the defining width of the CORF 300. The defining width is measured orthogonally to the vertical surface 385 such that the defining width is not necessarily at a constant angle with respect to any axis (x-axis 208, y-axis 207, z-axis 206). The CORF 300 includes two additional portions. A heelward return portion 424 and a toeward return portion 426 are seen. The heelward return portion 424 and toeward return portion 426 diverge from the leading edge 170 such that a curvature of the CORF 300 in the region of the heelward return portion 424 and the toeward return portion 426 is not substantially the same as the curvature of the leading edge 170. In the current embodiment, the defining width of the CORF 300 remains constant such that the distance 370 defines the defining width of the CORF 300 throughout all portions (central portion 422, heelward return portion 424, toeward return portion 426). In various embodiments, the defining width of at least one of the heelward return portion 424 and the toeward return portion 426 may be variable with respect to the defining with of the central portion 422. In the current embodiment, the divergence of the heelward return portion 424 and the toeward return portion 426 from the leading edge 170 provides additional stress reduction to avoid potential failure—such as cracking or permanent deformation—of the golf club head 100 along the CORF 300. In the current embodiment, the heelward return portion 424, central portion 422, and toeward return portion 426 are not constant radius between the three portions. Instead, the CORF 300 of the current embodiment is a multiple radius (hereinafter "MR") CORF 300. Because of the arrangement of the view of FIG. 4, the termination surface 390 can be seen under the CORF 300.

The CORF 300 includes a heelward end 434 and a toeward end 436. Each end 434,436 of the CORF 300 is identified at the end of the beveled edge 375. In various embodiments, the beveled edge 375 may be omitted, and the ends 434,436 may be closer together as a result. A distance 452 is shown between the toeward end 436 and the heelward end 434 as measured in the direction of the x-axis 208. In the current embodiment, the distance 452 is 40-43 mm. In various embodiments, the distance 452 may be 33-50 mm. In various embodiments, the distance 452 may be larger or smaller than the ranges cited herein and is limited only by the size of the golf club head. The CORF 300 includes a distance 454 as measured in the direction of the y-axis 207. In the current embodiment, the distance 454 is 9-10 mm. In various embodiments, the distance 454 may be 7-12 mm. In various embodiments, the distance 454 may be larger or smaller than ranges cited herein and is limited only by the size of the golf club head.

As indicated previously, the disclosure of application for U.S. patent bearing Ser. No. 13/839,727, entitled "GOLF CLUB WITH COEFFICIENT OF RESTITUTION FEATURE," filed Mar. 15, 2013, is incorporated by reference herein in its entirety. The remaining embodiments of application for U.S. patent bearing Ser. No. 13/839,727 have been omitted for efficiency. However, the entire disclosure of application for U.S. patent bearing Ser. No. 13/839,727 should be considered included herewith as if reproduced within the body of this disclosure.

As can be understood with reference to application for U.S. patent bearing Ser. No. 13/839,727, the inclusion of a CORF such as CORF 300 leads to increased flexibility of the golf club face 110, particularly on low face shots. One of skill in the art would understand that such a low face flexibility can increase COR for the entire golf club face 110, leading to higher energy transfer on any shot. Additionally, features described in the application for U.S. patent bearing Ser. No. 13/839,727 provide for low and/or forward CG location, explaining the spin-lowering effect of such arrangement of mass.

However, what is less understood by review of the application for U.S. patent bearing Ser. No. 13/839,727 is the effect of the CORF 300 and similar features on resultant spin, nor was it well understood how modifications to various CORF features would affect spin. Features of the current disclosure discuss, among other items, the effect of various modifications on the golf club head to alter spin.

In short, it has been surprisingly discovered that boundary conditions of the face of a golf club head dramatically influence spin profiles in addition to COR. As such, COR features (CORFs) are more appropriately termed "boundary condition features," or BCFs, because the presence of such features alters spin in addition to COR and, perhaps, other features. BCFs of the current disclosure may include elements to soften the boundary condition along the face in various embodiments. BCFs of the current disclosure may include elements to stiffen the boundary condition along the face in various embodiments. One of skill in the art would understand that the CORFs of the application for U.S. patent bearing Ser. No. 13/839,727 are but a few exemplary embodiments of softening BCFs. Both softening BCFs and stiffening BCFs will be described in greater detail herein.

As generally understood by one of skill in the art, the boundary of any golf club face can be represented as the location that the face of the golf club head meets portions of the golf club body. Given the speed and intensity of impact of the golf club face with a golf ball, the boundaries may be relatively rigid as compared with the center of the golf club face, where the face may be thinner than the edges where reinforcement occurs. The relative flexibility of a particular boundary of the face is referred to herein as the "boundary condition."

As noted, the manipulation of the boundary condition of the face of the golf club head can result in altered spin profiles given the same conditions of impact of the golf club head. In the most simple form, the rigidity of any boundary of the face can alter the resulting golf shot. As previously noted, it became advantageous to increase COR in certain golf club heads by freeing the boundary condition with CORFs such as CORF 300. However, such a CORF does not appear to have a material impact on the resultant shot if the boundary condition of the opposite side of the face is symmetrical—or, the same relative flexibility as the boundary condition proximate the CORF.

To increase COR low on the face, golf club heads of the disclosure of application for U.S. patent bearing Ser. No. 13/839,727 included a boundary softening feature—namely, CORFs such as CORF 300. Such features provided a reduction in the rigidity of the leading edge of the golf club heads of that disclosure, leading to increased flexibility low on the face. However, it was not understood at the time that rigidity of the top of the golf club face also had an impact on the resultant shot. Were a CORF to be included in the crown of the golf club head—for example, as described in application for U.S. patent bearing Ser. No. 12/791,025, entitled "HOLLOW GOLF CLUB HEAD," filed Jun. 1, 2010—the crown region would be relatively less rigid than previously. The resulting effect would be that the face would flex similarly to its behavior without CORFs because both the crown boundary condition and the sole boundary condition of the face would be about the same flexibility—or, in other words, symmetrical. With a symmetrical boundary condition, the resulting impact is similar, regardless of whether the boundary condition is rigid or relatively more flexible.

When a golf club head includes one boundary condition as relatively rigid and another boundary condition as relatively less rigid or more ductile, the resulting boundary condition is termed "asymmetrical." An asymmetrical boundary condition alters shot performance dramatically as compared to the symmetrical boundary condition. CORFs that result in asymmetrical boundary conditions provide greater impact on COR than CORFs that result in symmetrical boundary conditions. Further, creating an asymmetrical boundary condition has a material impact on golf ball spin characteristics, while creating a symmetrical boundary condition has almost no impact on golf ball spin characteristics as compared to a golf club head without a modified boundary condition.

In general, when one side of the boundary is rigid and one side is relatively ductile (asymmetrical boundary condition), it has been surprisingly discovered that the resulting spin profile will be altered in a direction consistent with the relatively more ductile boundary. For example, if the boundary condition of the face proximate the crown (the "crown boundary condition" or "CBC") is generally more rigid than the boundary condition of the face proximate the sole (the "sole boundary condition" or "SBC"), then, upon impact with a golf ball, the ball will tend to spin in a direction toward the sole, thereby reducing backspin on the golf shot. If the CBC is more flexible than the SBC, then, upon impact with a golf ball, the ball will tend to spin in a direction toward the crown, thereby increasing backspin on the golf shot.

With this unexpected discovery comes the ability to manipulate the spin characteristics of various golf club heads. For example, it is generally desirable in driver-type golf club heads to provide a golf club head with as low spin as possible. Similarly, in some clubs used to approach a green (for example, hybrid type golf club heads), it may be desirable to reduce spin in some scenarios—which will generally increase distance—or to increase spin in other scenarios—which will allow for greater ability to hold greens on long approach shots. Many features of the current disclosure will be particularly described with reference to features of the sole of the golf club head. However, in various embodiments, features seen on the sole may be modified or relocated to provide similar interactions on the crown of the various golf club heads. One of skill in the art would understand that the descriptions provided herein are not intended to rely on placement in one location unless described in a manner commensurate with that location only, as would be understood by one of skill in the art.

Figure 5:
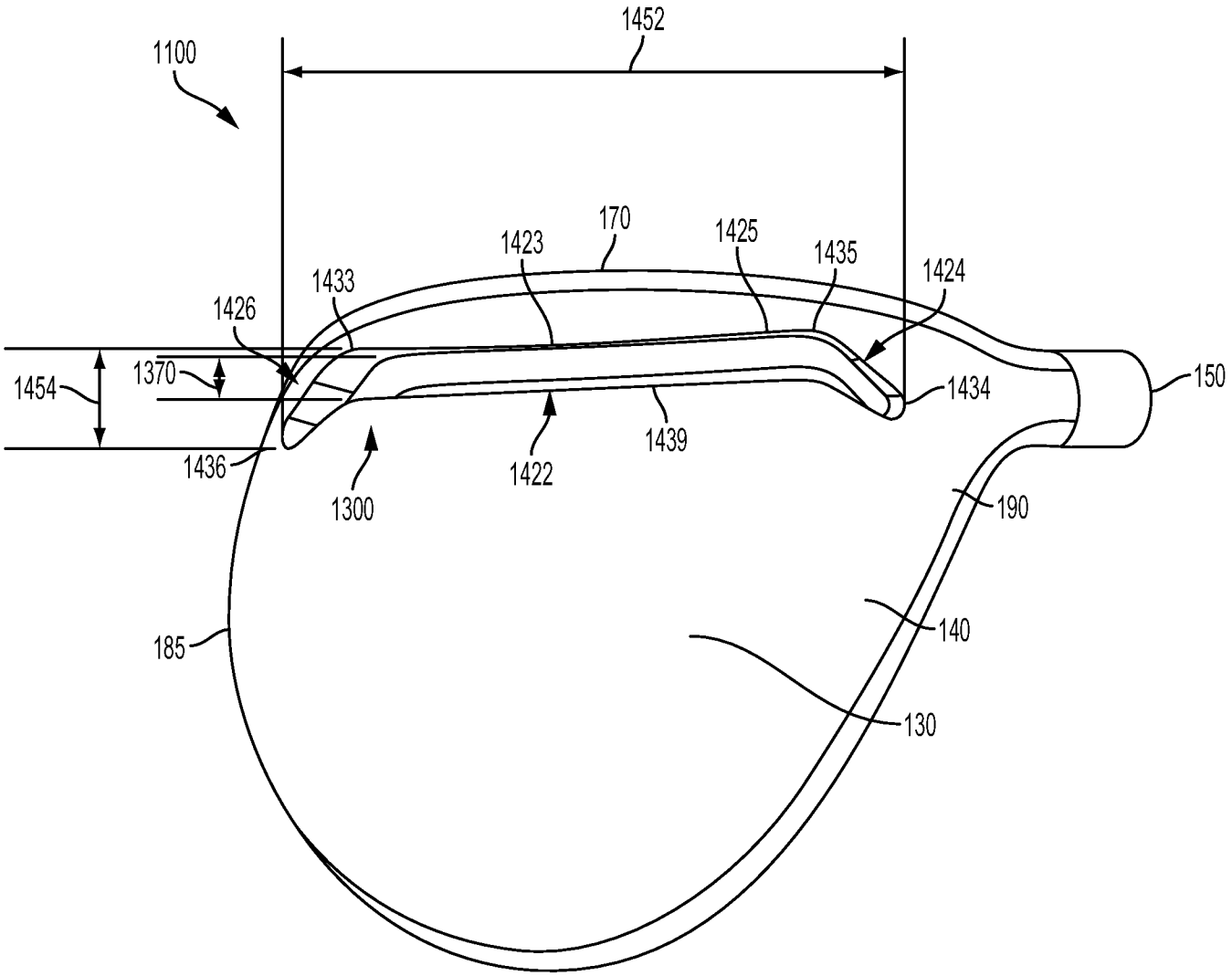
FIG. 5 is a bottom perspective view of a golf club head in accord with one embodiment of the current disclosure.

As seen with reference to FIG. 5, a golf club head 1100 includes features and components generally similar to those of golf club head 100. The sole 130 of the golf club head 1100 includes a BCF 1300. The BCF 1300 of the current embodiment is a softening BCF, as described previously in this disclosure.

The BCF 1300 of the current embodiment includes multiple portions that define its shape. The BCF 1300 includes a central portion 1422 that comprises a plurality of the BCF 1300. In the current embodiment, the central portion 1422 includes a curved shape. In contrast to some features of various embodiments discussed herein, the BCF 1300 includes a curvature that is opposite of the curvature of the leading edge 170. As such, a central point 1423 of a forwardmost edge 1425 of the BCF 1300 is further from the leading edge 170 than a first central portion end point 1433 or a second central portion end point 1435. In the current embodiment, central point 1423 is removed from the leading edge 170 to reduce stress concentration, which can cause weakening or failure of the golf club head. The BCF 1300 includes two additional portions. A heelward return portion 1424 and a toeward return portion 1426 are seen. The heelward return portion 1424 and toeward return portion 1426 diverge from the leading edge 170. In the current embodiment, the defining width of the BCF 1300 remains about constant, as the curvature of a rearwardmost edge 1439 generally follows the curvature of the forwardmost edge 1425. In various embodiments, the defining width of at least one of the heelward return portion 1424 and the toeward return portion 1426 may be variable with respect to the defining with of the central portion 1422. In the current embodiment, the divergence of the heelward return portion 1424 and the toeward return portion 1426 from the leading edge 170 provides additional stress reduction to avoid potential failure—such as cracking or permanent deformation—of the golf club head 1100 along the BCF 1300. In the current embodiment, the heelward return portion 1424, central portion 1422, and toeward return portion 1426 are not constant radius between the three portions. Instead, the BCF 1300 of the current embodiment is a multiple radius (hereinafter "MW") BCF 1300.

The BCF 1300 includes a heelward end 1434 and a toeward end 1436. A distance 1452 is shown between the toeward end 1436 and the heelward end 1434 as measured in the direction of the x-axis 208. In the current embodiment, the distance 1452 is about 83 mm. In various embodiments, the distance 1452 may be 80-85 mm. In various embodiments, the distance 1452 may be 75-95 mm. In various embodiments, the distance 1452 may be larger or smaller than the ranges cited herein and is limited only by the size of the golf club head. The BCF 1300 includes a distance 1454 as measured in the direction of the y-axis 207. In the current embodiment, the distance 1454 is 10-14 mm. In various embodiments, the distance 1454 may be 7-20 mm. In various embodiments, the distance 1454 may be larger or smaller than ranges cited herein and is limited only by the size of the golf club head. In various embodiments, the distance 1452 is between 70% and 95% of the heel-to-toe length of the golf club head 1100, which is a length from the toe 185 to the heel 190. In various embodiments, the distance 1452 is 80% to 90% of the heel-to-toe length of the golf club head. In various embodiments, the distance 1452 may be compared as a percentage of the length 177.

Figure 6A:
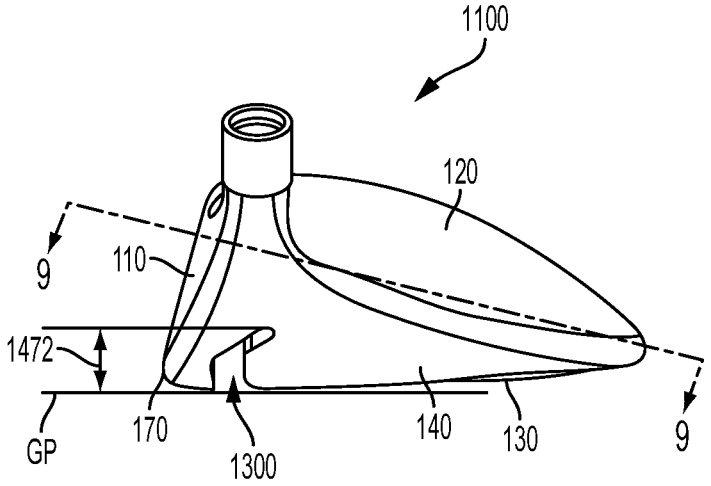
FIG. 6A is a heel side view of the golf club head of FIG. 5.
Figure 6B:
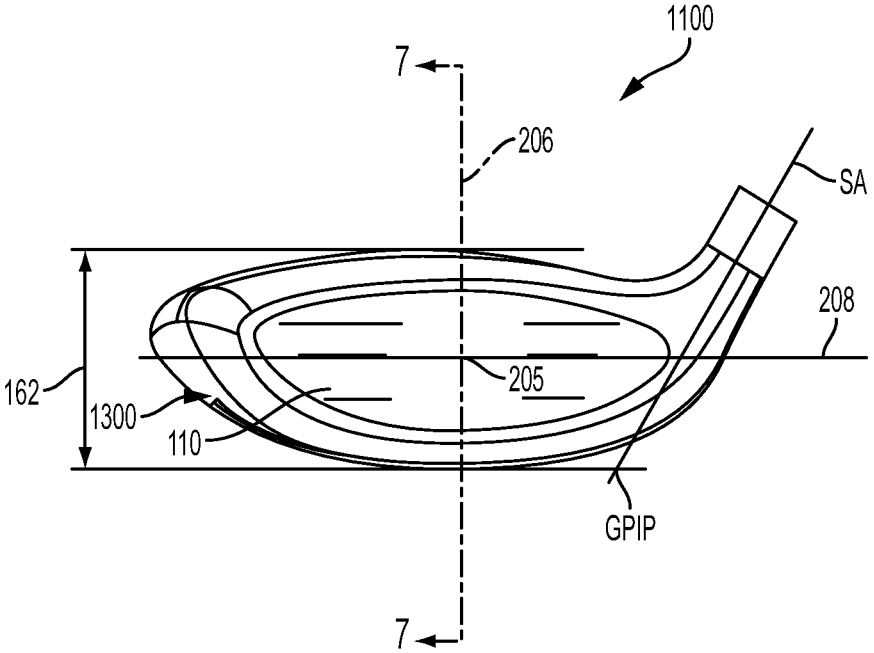
FIG. 6B is a face side view of the golf club head of FIG. 5.

As can be seen with reference to FIGS. 5, 6B, portions of the BCF 1300 extend onto the skirt 140 of the golf club head 1100 proximate the toe 185 and the heel 190. The size of the BCF 1300 is much larger than the size of the CORF 300 and various CORFs disclosed in application for U.S. patent bearing Ser. No. 13/839,727.

With specific reference to FIG. 6A, the BCF 1300 extends to a height 1472 above the GP that is about 8.5 mm. In various embodiments, the BCF 1300 may extend between 8-9 mm. In various embodiments, the BCF 1300 may extend 6-11 mm. In various embodiments, the BCF 1300 may extend 4.5-11.5 mm. The BCF 1300 extends into the skirt 140 of the golf club head 1100.

Figure 7:
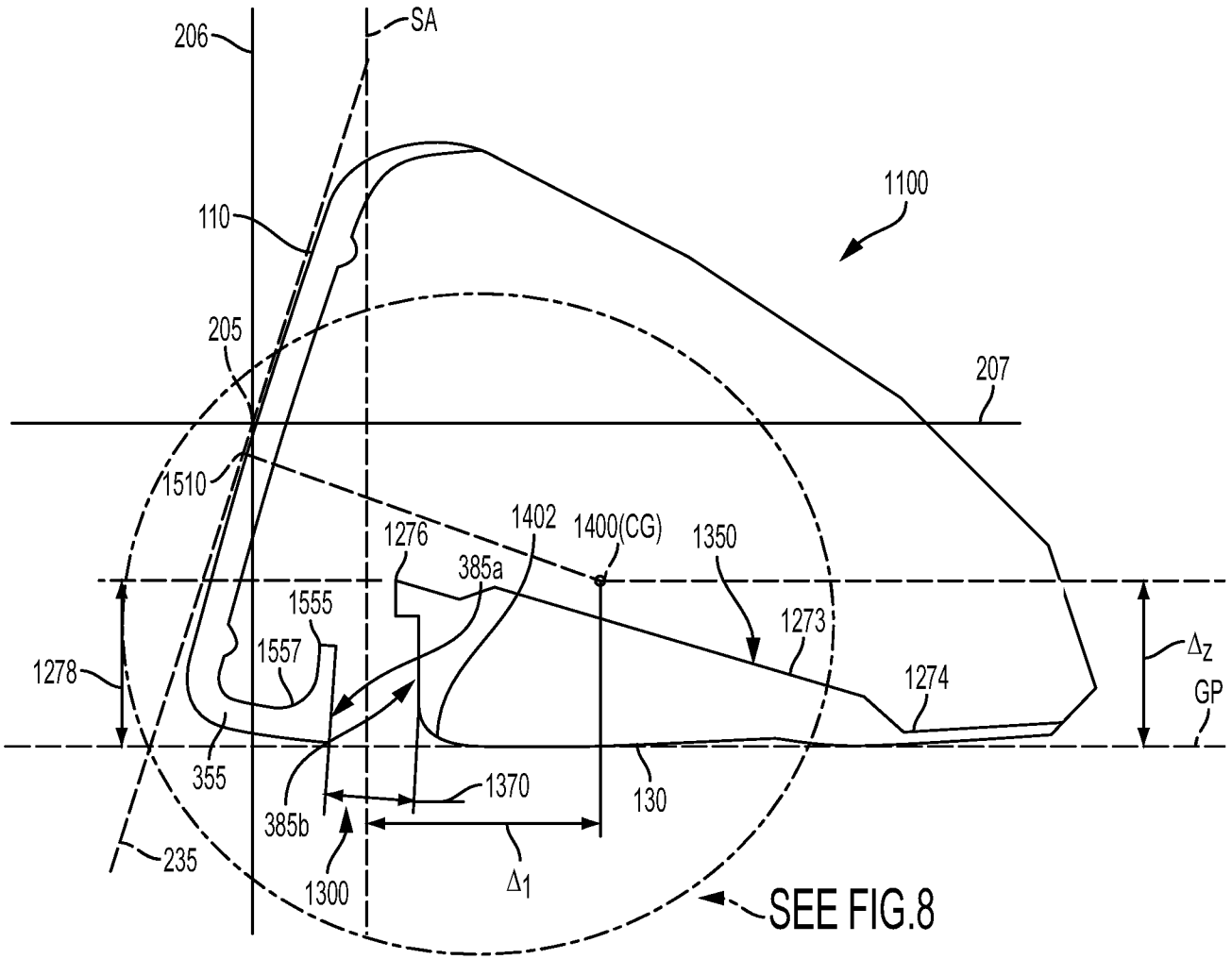
FIG. 7 is a cross-sectional view of the golf club head taken in the plane indicated by line 7-7 of FIG. 6B.

As seen with reference to FIG. 7, a weight pad 1350 is included with the golf club head 1100 as similar to prior embodiments and those disclosed in application for U.S. patent bearing Ser. No. 13/839,727. The weight pad 1350 includes an inclined surface 1273 providing generally increasing thickness from a rearwardmost end 1274 to a forwardmost end 1276 of the weight pad 1350. A thickness

1278 of the mass pad 1350 is measured parallel to the z-axis 206 at the forwardmost end 1276. In the current embodiment, the thickness 1278 is about 10.3 mm. In various embodiments the thickness 1278 may range from 9 to 12 mm. In various embodiments, the thickness 1278 may range from 6 to 15 mm. It should be noted that features of the weight pad 1350 proximate the face 110 may provide for decreased thickness in various locations. A center of gravity 1400 is seen in the view. The center of gravity 1400 provides a projection point 1510 that is below the CF 205. In the current embodiment, the projection point 1510 is about 0.1 mm below CF 205. In various embodiments, various mass placement may result in projection points such as projection point 1510 being below the CF 205 by 0.5 mm, by 1.0 mm, by 1.5 mm, by 2.0 mm, and by about 4 mm below CF 205 in various embodiments. In various embodiments, the projection point 1510 may be up to 7 mm below CF 205. In various embodiments, the projection point 1510 may be above center face by up to 2 mm while still below the intended strike location. Additionally, projection points may be as discussed with respect to various other embodiments of the current disclosure and with respect to the various embodiments of application for U.S. patent bearing Ser. No. 13/839,727. Distances for $\Delta_z$ and $\Delta_1$ in the current embodiment are 12.1 mm and 9.4 mm, respectively. In various embodiments, distances for $\Delta_z$ may be 11-13 mm, 10-13.5 mm, and 8-11.5 mm. In various embodiments, distances for $\Delta_z$ may be as little as 6 mm and as great as 18 mm. In various embodiments, $\Delta_1$ may be 9-10 mm, 8-11 mm, 7-11.5 mm, and 6.5-13 mm. In various embodiments, $\Delta_1$ may be as little as 2 mm. All ranges cited in the current disclosure are intended to be inclusive except where indicated otherwise. Ranges for $\Delta_z$ and $\Delta_1$ may also be as discussed with respect to various other embodiments of the current disclosure and with respect to the various embodiments of application for U.S. patent bearing Ser. No. 13/839,727.

In the current embodiment, an absolute width 1370 of the BCF 1300 is provided. In the current embodiment, the absolute width 1370 is about 5.5 mm. In various embodiments, the absolute width 1370 may be between 4 mm to 7 mm. In various embodiments, the absolute width 1370 may be up to 10 mm. Prior embodiments provide other limits for the width 1370 of various types of BCFs and CORFs such that one of skill in the art would understand that different sized BCFs may be created in accord with the current disclosure. In the current embodiment, the absolute width 1370 is measured orthogonally to the vertical surfaces 385*a,b*, which, in the current embodiment, are not parallel to the SA or the z-axis 206. However, in the current embodiment, the distance of the BCF as measured parallel to the y-axis is about the same as the absolute distance. For ranges as to distances provided as absolute distances in the current disclosure, one of skill in the art would understand that measurements as attained in a particular coordinate system would not be substantially different if the angle of measurement is not a great angle with respect to the coordinate system. As such, in the current instance, the absolute width 1370 is about the same as a width as measured parallel to the y-axis. The BCF 1300 includes a radius 1402 connecting the sole 130 to the rearward vertical surface 385*b*. The radius 1402 may provide better turf interaction on shots wherein a filler material may not cover such a transition region between the rearward vertical surface 385*b* and the sole 130.

In the current embodiment, the first sole portion 355 includes a lip feature 1555. The lip feature 1555 provides a physical extension of the vertical surface 385*a* above what would be possible merely from the thickness of the first sole portion 355. As such, the lip feature 1555 is a thickened portion, and includes a thickness greater than the first sole portion 355. A fillet 1557 is included between the first sole portion 355 and the lip feature 1555. The lip feature 1555 of the current embodiment terminates without connecting to other features of the golf club head 1100, although various embodiments may include various connection features.

As can be seen, the first sole portion 355 is of a moderate thickness. As previously noted (with specific reference to FIG. 5), the distance 1452 of the BCF 1300 is much larger than disclosed in prior embodiments. As such, portions of the BCF 1300 can experience much larger flexing and much higher concentration of stress. The inclusion of the lip feature 1555 provides reinforcement of increased material thickness at the location of most stress concentrations, which would tend to locate along the walls of the BCF 1300. Such features can reinforce the BCF 1300 against cracking or other failure without increasing the thickness of the first sole portion 355, thereby maintaining much of the flexibility of the BCF 1300 to allow greater flexure of the face 110 of the golf club head.

Figure 8:
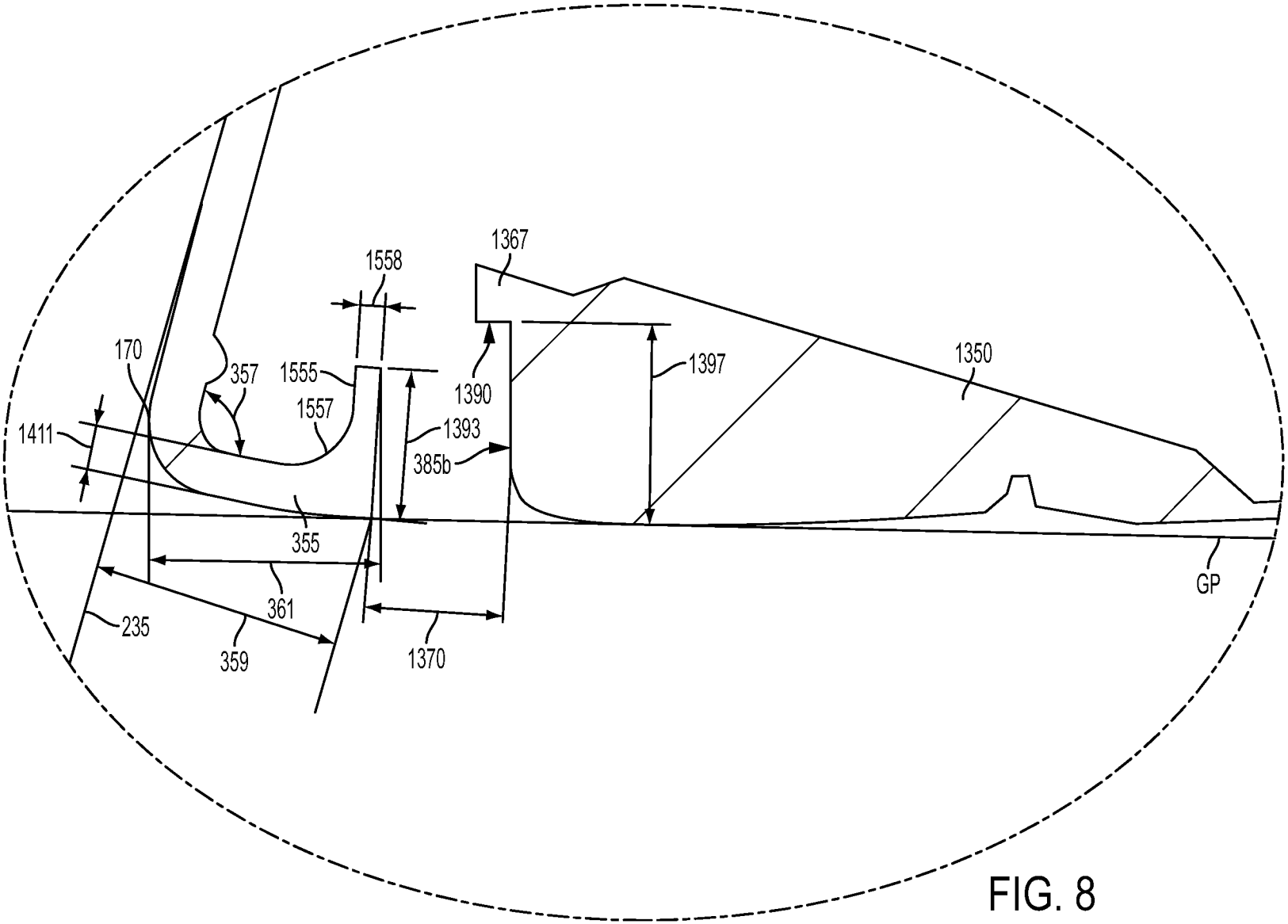
FIG. 8 is a close-up view of detail 8 in FIG. 7.

With reference to FIG. 8, distances 359 and 361 are seen, with distance 359 measured orthogonal to the TFP 235 and distance 361 measured parallel to the y-axis 207. In the current embodiment, both distances 359 and 361 are between 9 mm and 9.5 mm. In various embodiments, the distances 359 and 361 may be substantially different from each other or may be substantially the same depending on the angle 357 of the first sole portion 355. In various embodiments, the distances 359, 361 may be between 7 mm and 11 mm. In various embodiments, the distances 359,361 may be up to 15 mm. In the current embodiment, the first sole portion 355 is of an absolute thickness 1411 of about 1.80 mm. In various embodiments, the first sole portion 355 may be 1 mm to 2 mm in thickness 1411. In various embodiments, the first sole portion 355 may be as little as 0.5 mm, and in various embodiments the first sole portion 355 may be up to 4 mm in thickness 1411. In various embodiments, the first sole portion 355 may be of various thicknesses along its profile in the directions of the x-axis 208, the y-axis 207, and the z-axis 206. In various embodiments, the first sole portion 355 may be of constantly varying profile or of consistently varying profiles. One of skill in the art would understand that modifications in view of other embodiments of the current disclosure and of the disclosure of application for U.S. patent bearing Ser. No. 13/839,727 may be implemented without departing substantially from the general scope of the disclosure.

The lip feature 1555 extends into the golf club head 1100 by a distance 1393 of about 6 mm in the current embodiment. The distance 1393 is an absolute distance, although the distance as measured parallel to the TFP 235 or the z-axis 206 would not be substantially different in the current embodiment. In various embodiments, the lip feature 1555 may be between 4 mm and 8 mm. In various embodiments, the lip feature 1555 may be as little as 2 mm and as large as 15 mm. A thickness 1558 of the lip feature 1555 is about 1.0 mm. In various embodiments, the thickness 1558 may be as little as 0.5 mm and as large as 4 mm. A termination surface 1390 of an overhang portion 1367 is located a distance 1397 above the GP of about 8 mm in the current embodiment. In various embodiments, the distance 1397 may be 4 mm to 18 mm. In various embodiments, the distance 1397 may be 6 mm to 12 mm. In various embodiments, the termination surface 390 may be omitted, and in various embodiments the overhang portion 1367 may be omitted in its entirety or may be enlarged.

Figure 9:
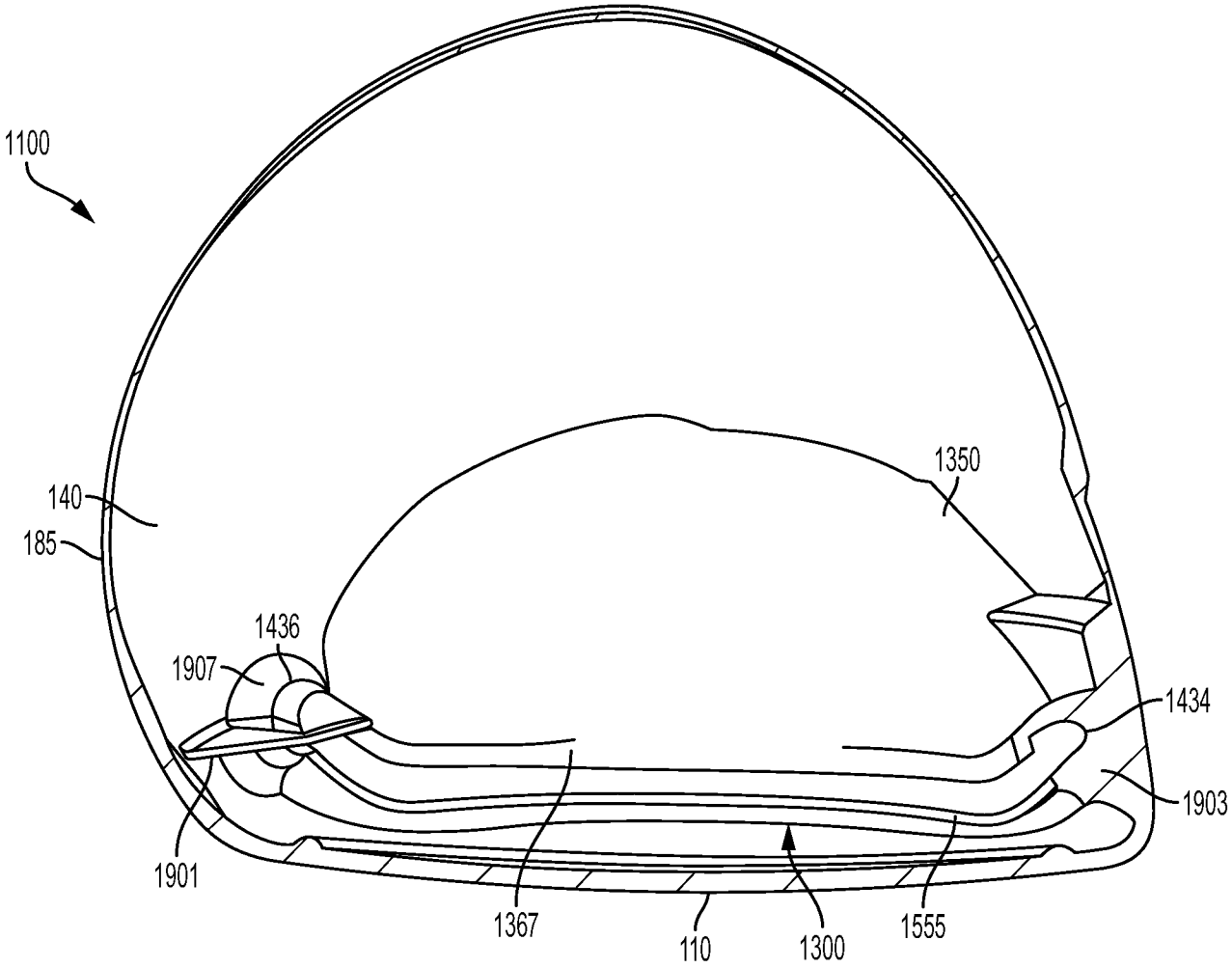
FIG. 9 is a cross-sectional view of the golf club head taken in the plane indicated by line 9-9 in FIG. 6A.

As seen with reference to FIG. 9, portions of the overhang portion 1367 are coincident with the weight pad 1350. However, proximate the heelward end 1434 and the toeward end 1436, the overhang portion 1367 diverges from the weight pad 1350. As can be seen, in the current embodiment, matter has been added in proximate the heelward end 1434 and the toeward end 1436 to reinforce the BCF 1300 against mechanical failure. A heelward reinforced region 1903 and a toeward reinforced region 1907 are areas of increased thickness of material in the current embodiment. In the current embodiment, a rib 1901 connects the BCF 1300 with the skirt 140 proximate the toe 185. Such a feature may be included for mechanical reinforcement and/or for sound performance.

Figure 10:
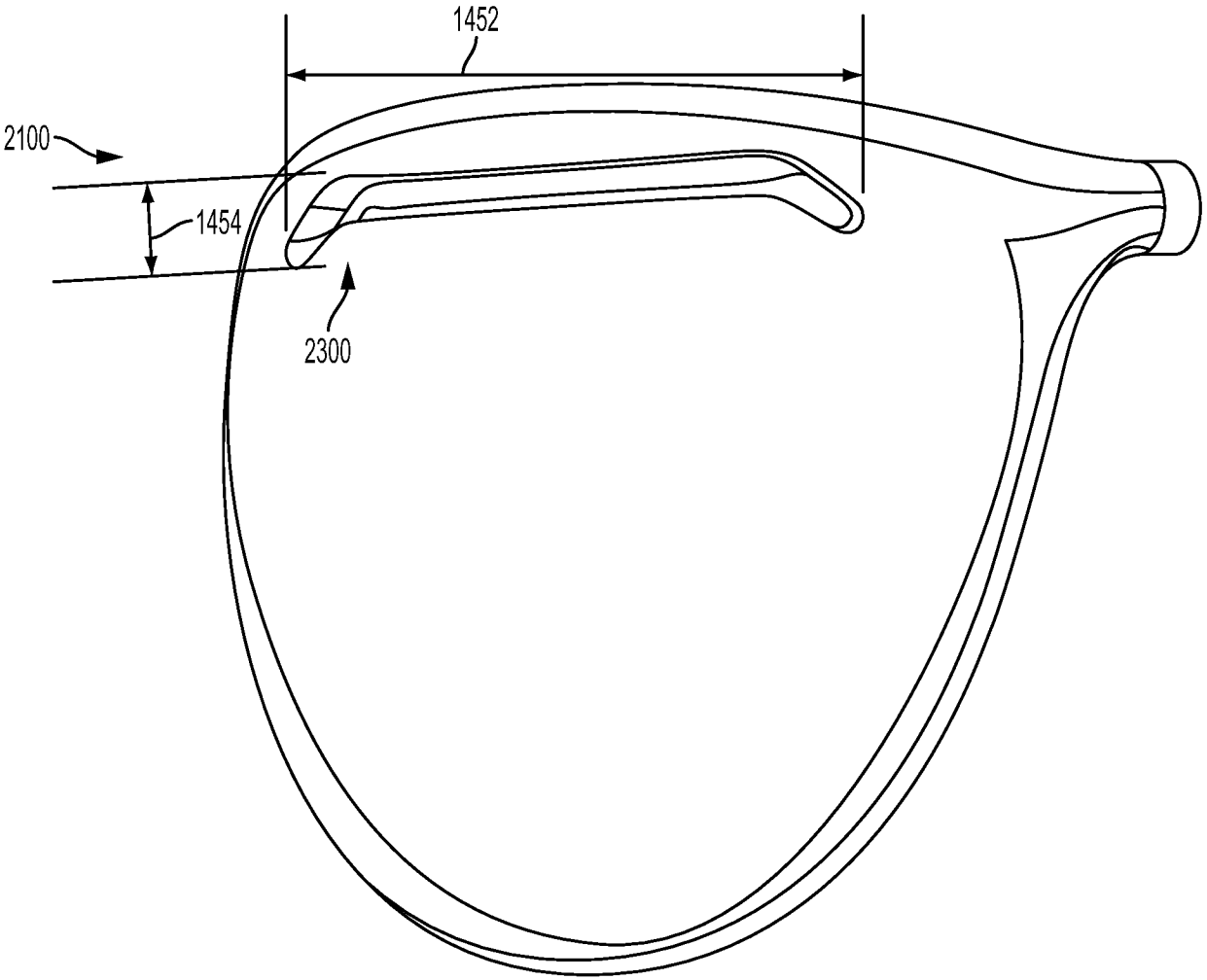
FIG. 10 is a bottom perspective view of a golf club head in accord with one embodiment of the current disclosure.

As seen with reference to FIG. 10, a BCF 2300 may be implemented into a golf club head 2100 that is a driver-type head in the current embodiment. The size of the BCF 2300 implemented into golf club head 2100 is about the same as the BCF 1300 for the golf club head 1100, although various features may change by the implementation of the BCF 2300 into the driver type golf club head 2100.

Figure 11A:
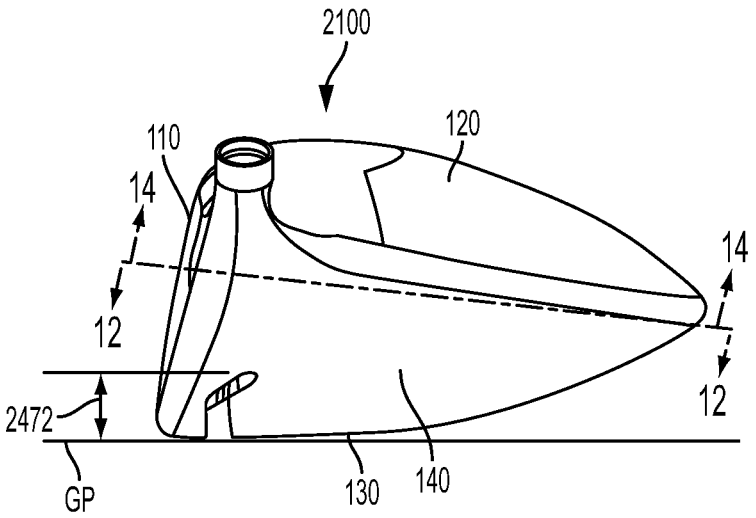
FIG. 11A is a heel side view of the golf club head of FIG. 10.
Figure 11B:
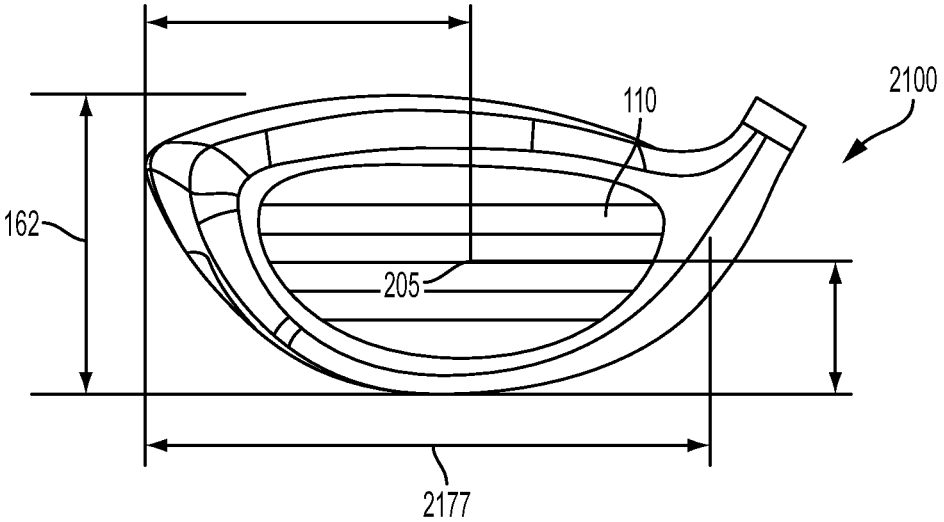
FIG. 11B is a face side view of the golf club head of FIG. 10.
Figure 11C:
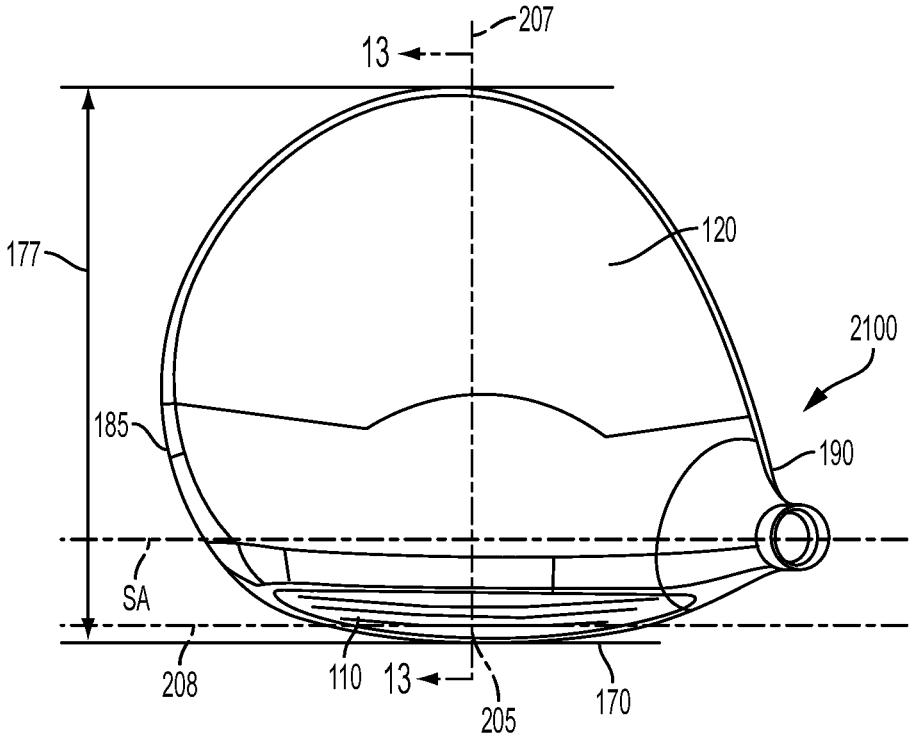
FIG. 11C is a top side view of the golf club head of FIG. 10.

With specific reference to FIG. 11A, the BCF 2300 extends to a height 2472 above the GP that is about 14.0 mm. In various embodiments, the height 2472 is about 12-16 mm. In various embodiments, the height 2472 is 10-20 mm. In various embodiments, the height 2472 is greater than 11 mm. The BCF 2300 is extends into the skirt 140 of the golf club head 2100. The BCF 2300 may have somewhat different dimensions than BCF 1300 or may be substantially the same as BCF 1300 in various embodiments. As can be seen with reference to FIGS. 11B-11C, the length 177 of the golf club head 2100 in the current embodiment is about 116 mm. In various embodiments, the length 177 of the golf club head 2100 may be 110-120 mm. In various embodiments, the length 177 may be 105-125 mm. In various embodiments, the length 177 of the golf club head 2100 may be greater than 100 mm. The golf club head 2100 includes a heel-toe length 2177 of about 120 mm. In various embodiments, the heel-toe length 2177 may be 110 mm to 130 mm. In various embodiments, the heel-toe length 2177 may be greater than 100 mm. The golf club head 2100 includes a crown height 162 of about 64 mm. In various embodiments, the crown height 162 may be 60-70 mm. In various embodiments, the crown height may be greater than 55 mm.

Figure 12:
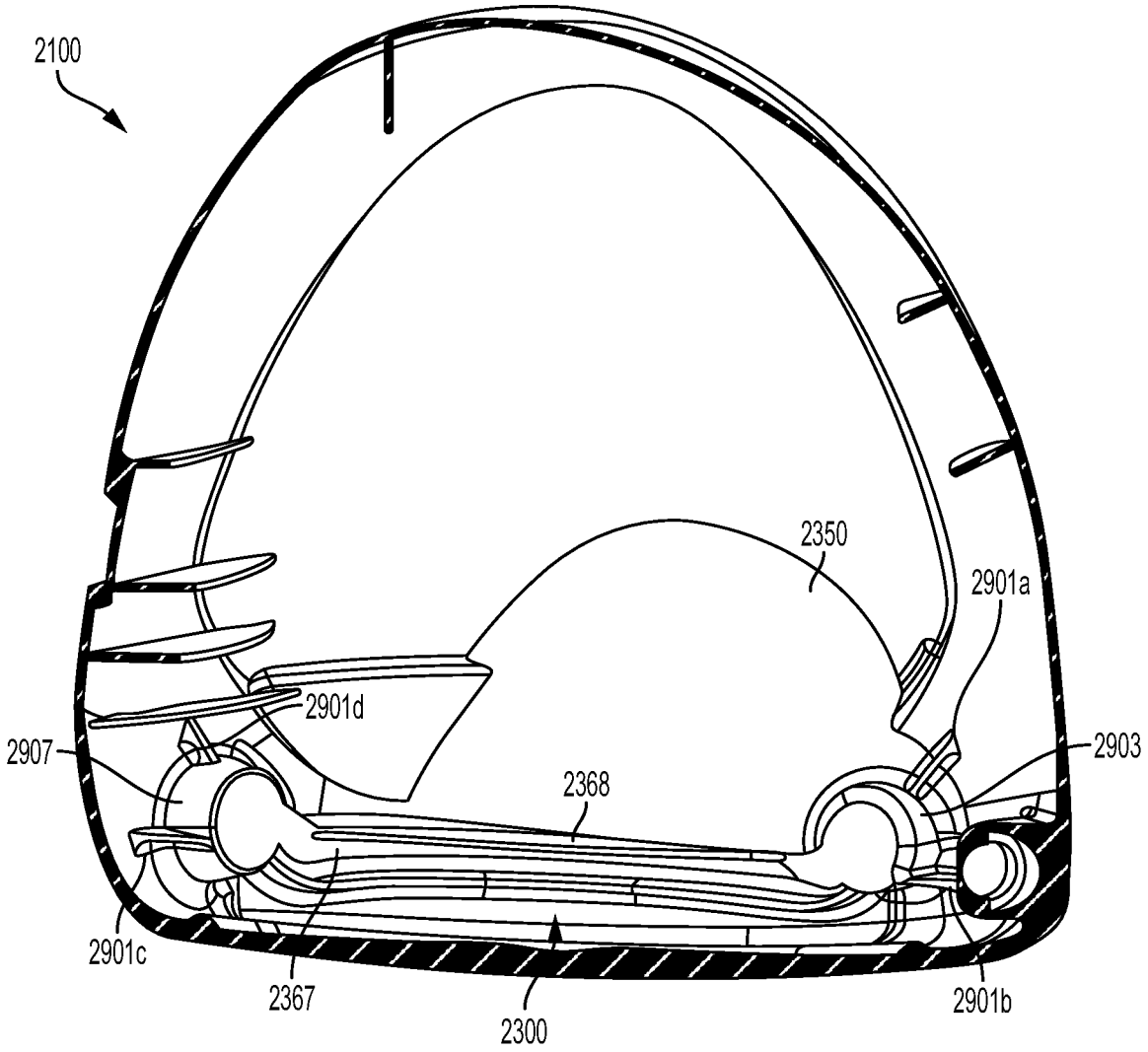
FIG. 12 is a cross-sectional view of the golf club head taken in the plane indicated by line 12-12 in FIG. 11A.

The golf club head 2100 is seen in greater detail with reference to FIG. 12. The golf club head 2100 includes weight pad 2350. A heelward reinforced region 2903 and a toeward reinforced region 2907 are areas of increased thickness of material in the current embodiment. Each reinforced region 2903,2907 includes a plurality of ribs 2901*a,b,c,d* to aid in durability and sound performance. The BCF 2300 of the current embodiment includes an overhang portion 2367 that is similar in shape and function as the overhang portion 1367. However, in the current embodiment, the overhang portion 2367 includes a rib 2368 extending from a top of the overhang portion 2367 into the hollow space of the golf club body. Various additional ribs are seen connecting the skirt and sole of the golf club head 2100 for additional sound performance.

Figure 13:
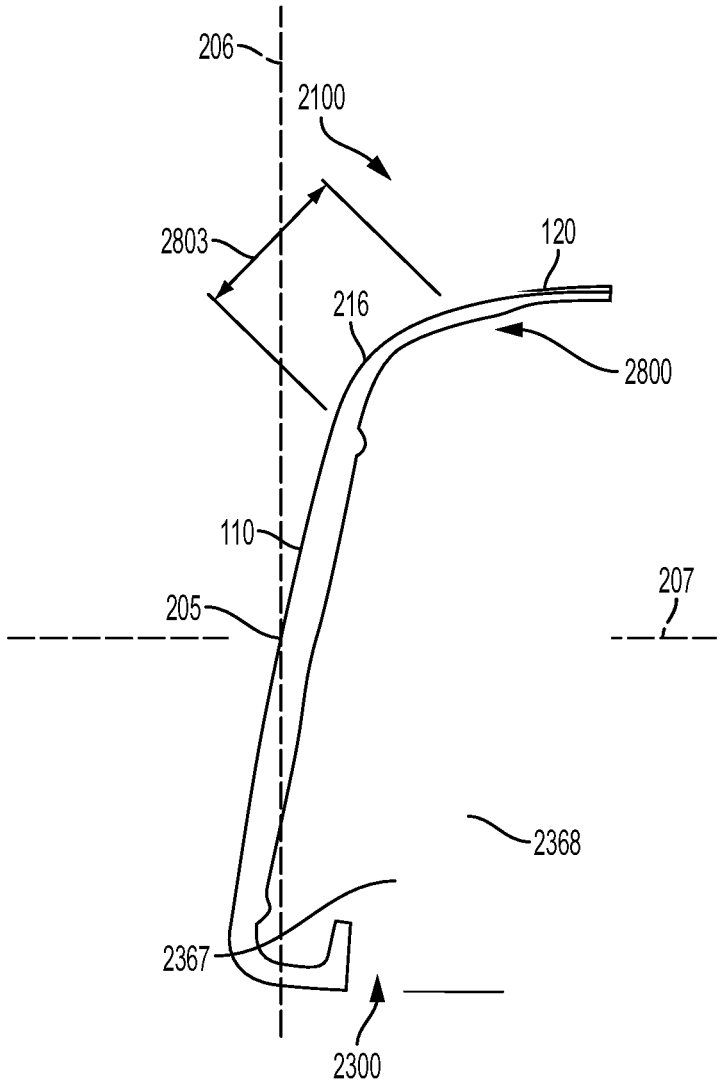
FIG. 13 is a cross-sectional view of the golf club head taken in the plane indicated by line 13-13 in FIG. 11C.

The view of FIG. 13 includes a second view of the rib 2368 to show the location in the golf club head. As can be seen, the rib 2368 is generally triangular and has its upwardmost extent of the projection at a location about consistent with the CF 205—or, in other words, intersecting the plane formed by the y-axis 207 and the z-axis 206—with the rib 2368 tapering along its length toward both the heel 190 and the toe 185. The rib 2368 provides improved sound performance.

Also seen in the view of FIG. 13 is a second BCF 2800 located proximate to the crown 120 of the golf club head 2100. The BCF 2800 is a stiffening BCF in the current embodiment. The BCF 2800 is a plurality of ribs located centrally to the golf club head proximate the face-to-crown transition point 216. The BCF 2800 has a length 2803 of about 14 mm in the current embodiment. In various embodiments, the length 2803 may be larger or smaller as needed to tune the stiffness of the BCF 2800 and the portion of the face 110 proximate the crown 120. As one of skill in the art would understand, a smaller length 2803 of BCF 2800 will generally be less stiff than a larger length 2803 when all materials, angles, joints, and various thicknesses are the same. In various embodiments, the length 2803 may be 12-16 mm. In various embodiments, the length 2803 may be 10-20 mm. In various embodiments, the length 2803 may be greater than 5 mm.

Figure 14:
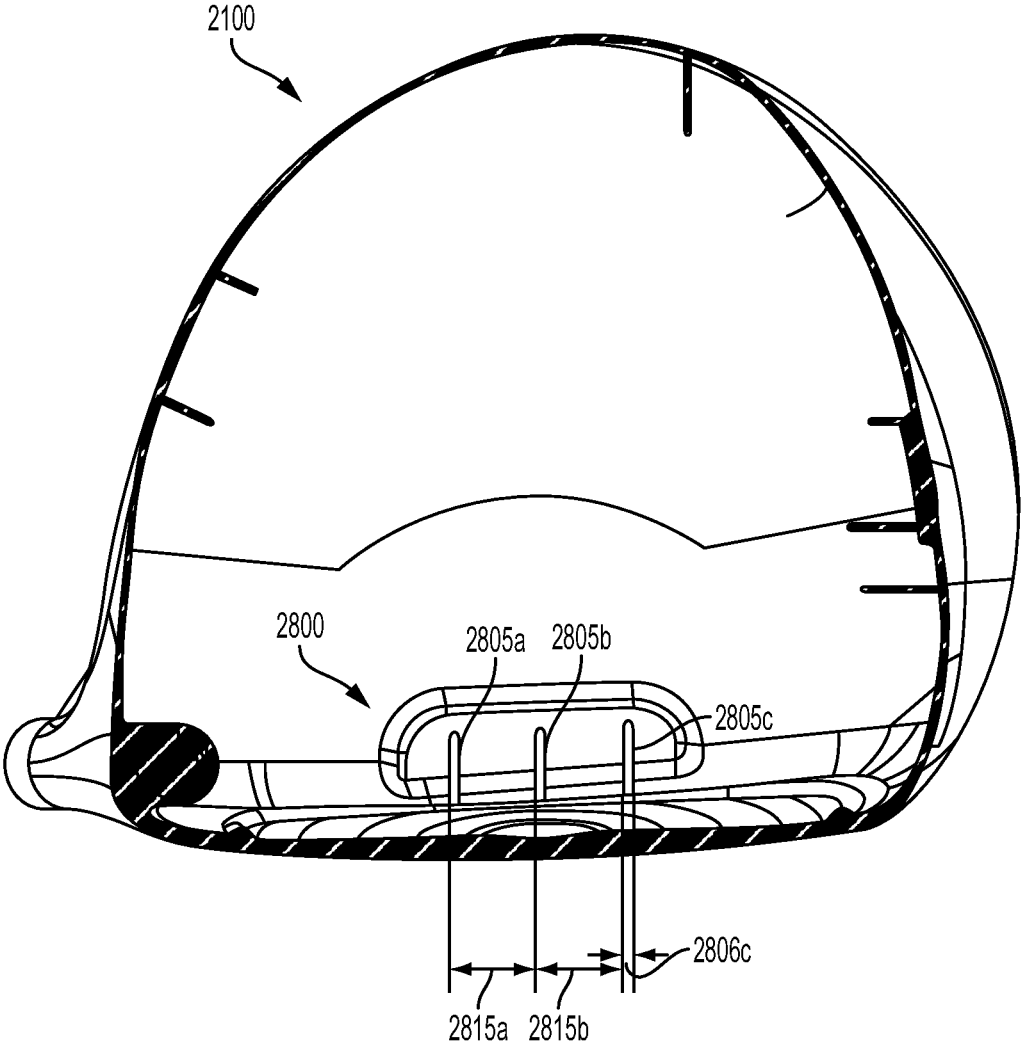
FIG. 14 is a cross-sectional view of the golf club head taken in the plane indicated by line 14-14 in FIG. 11A.

As seen with reference to FIG. 14, the BCF 2800 includes three ribs 2805*a,b,c*. In various embodiments, any number of ribs 2805 may be utilized. In various embodiments, ribs may be of different sizes and shapes. Each rib 2805*a,b,c* is separated from the next rib 2805*a,b,c* by a distance 2815*a,b*. Each distance 2815*a,b*, is about 12 mm in the current embodiment. In various embodiments, the distances 2815*a,b* may be greater or smaller depending on the goal of the design to stiffen or soften the BCF 2800. Each rib 2805 is of a thickness 2806*a,b,c* (2806*a,b* omitted for ease of view). In the current embodiment, the thickness 2806 is about 1 mm, although in various embodiments the thickness may be 0.25 mm to 4 mm in various embodiments. In various embodiments, stiffening BCFs may include thickened regions, multi-material implementations, various bosses or other features as may be understood by one of skill in the art.

Figure 15:
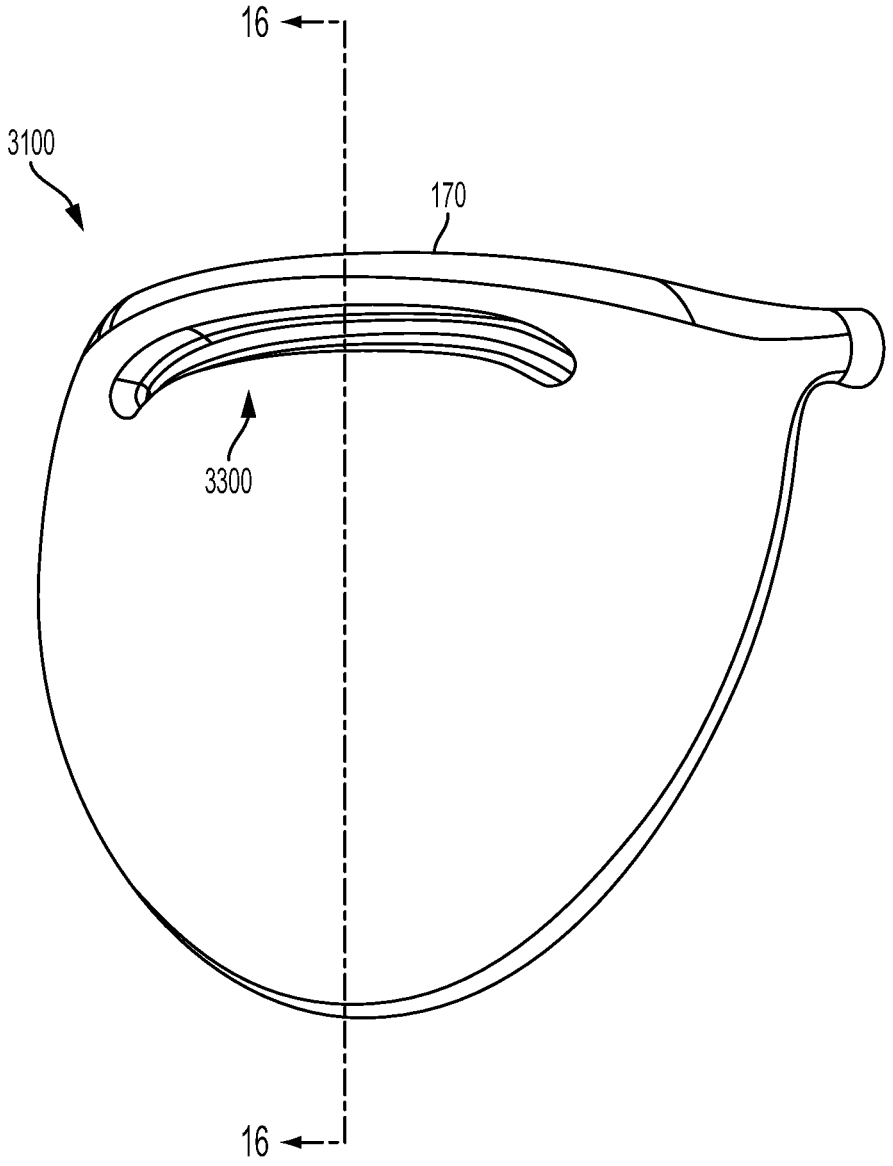
FIG. 15 is a bottom perspective view of a golf club head in accord with one embodiment of the current disclosure.

A golf club head 3100 includes a BCF 3300 as shown with reference to FIG. 15. The BCF 3300 is similar in general shape to the CORF 300 (also a BCF) disclosed previously in this disclosure. However, some notable differences exist. The BCF 3300 is larger than the CORF 300 in dimensions.

Figure 16:
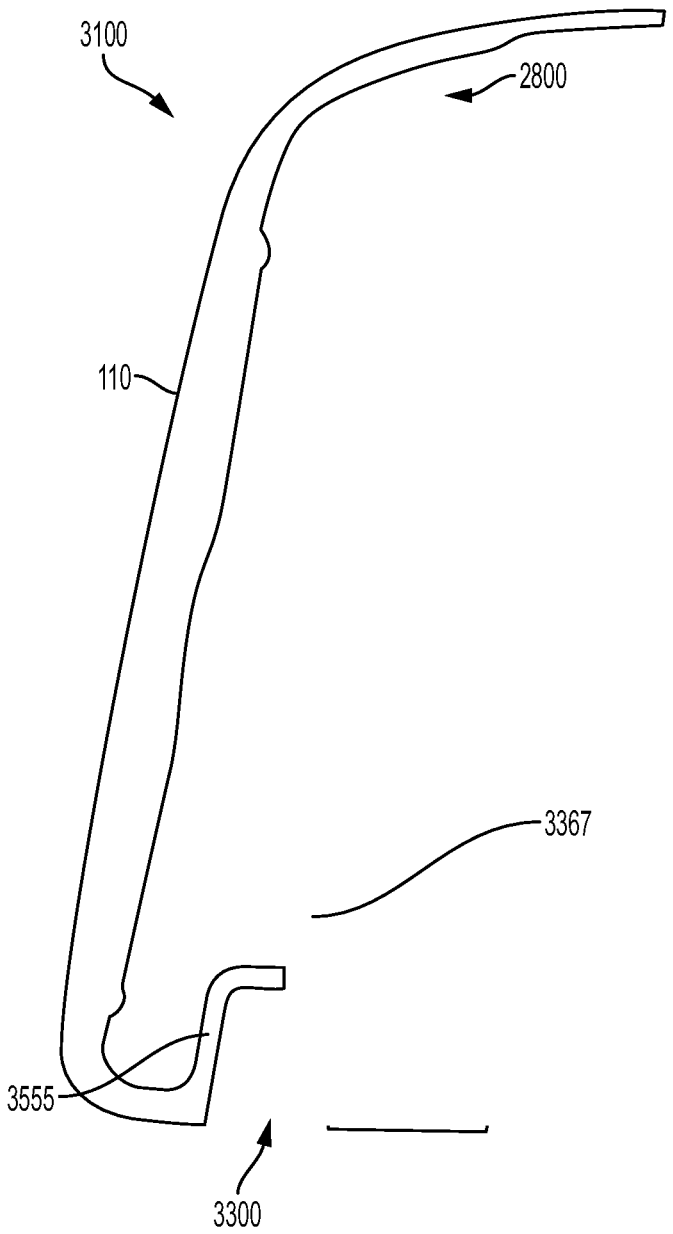
FIG. 16 is a cross-sectional view of the golf club head taken in the plane indicated by line 16-16 in FIG. 15.

As can be seen in the view of FIG. 16, the BCF 3300 includes an overhang portion 3367 that extends rearwardly from a lip feature 3555 which is similar to lip feature 1555 except that the overhang portion 3367 extends rearwardly from lip feature 3555. The overhang portion 3367 is connected to the lip feature 3555 as a further stress reduction feature to reduce the concentration of stress on particular elements of the BCF 3300. As can be seen with further review of FIG. 15, the BCF 3300 generally follows the contour of the leading edge 170 as with embodiments elsewhere in this disclosure and in the disclosure of application for U.S. patent bearing Ser. No. 13/839,727.

Figure 17:
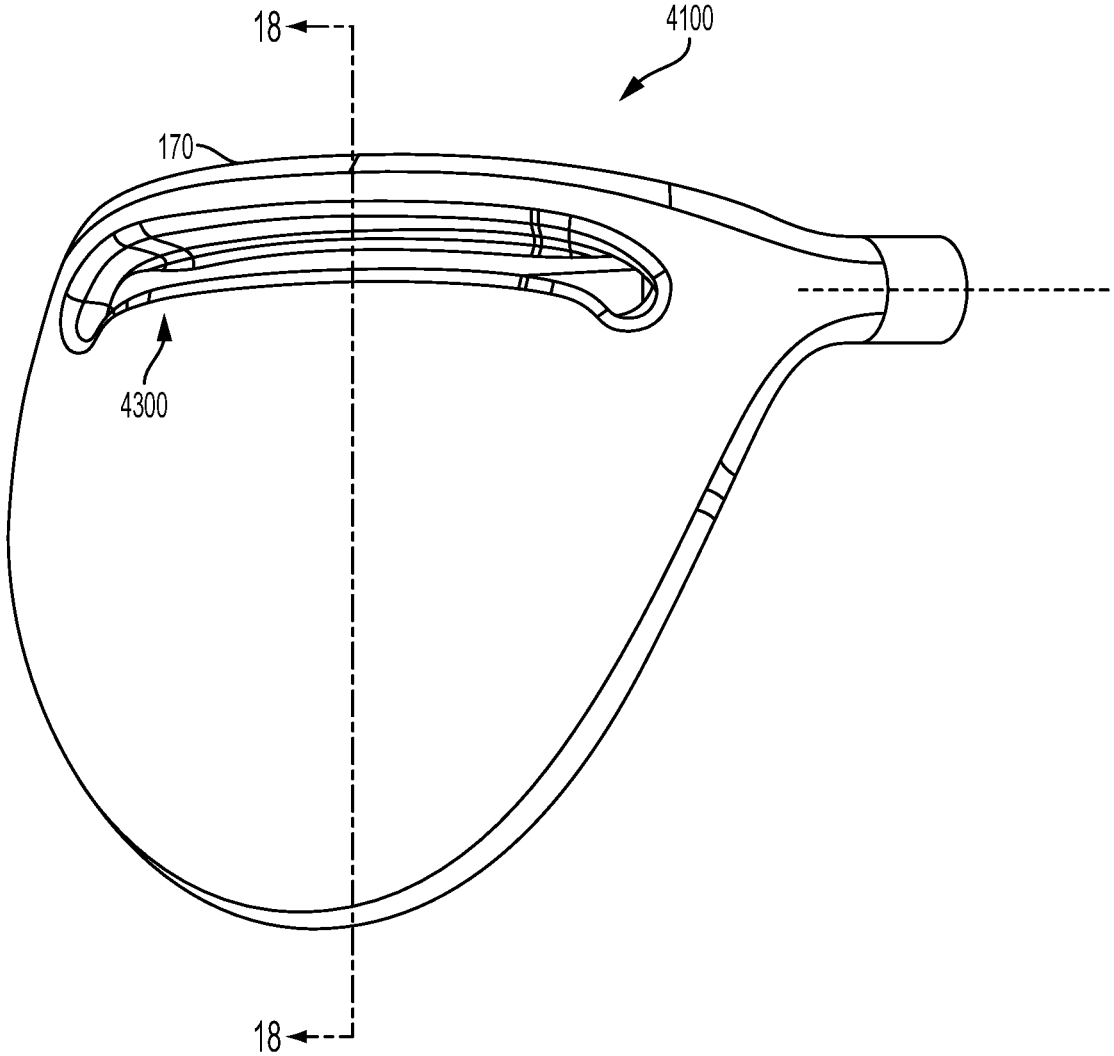
FIG. 17 is a bottom perspective view of a golf club head in accord with one embodiment of the current disclosure.
Figure 18:
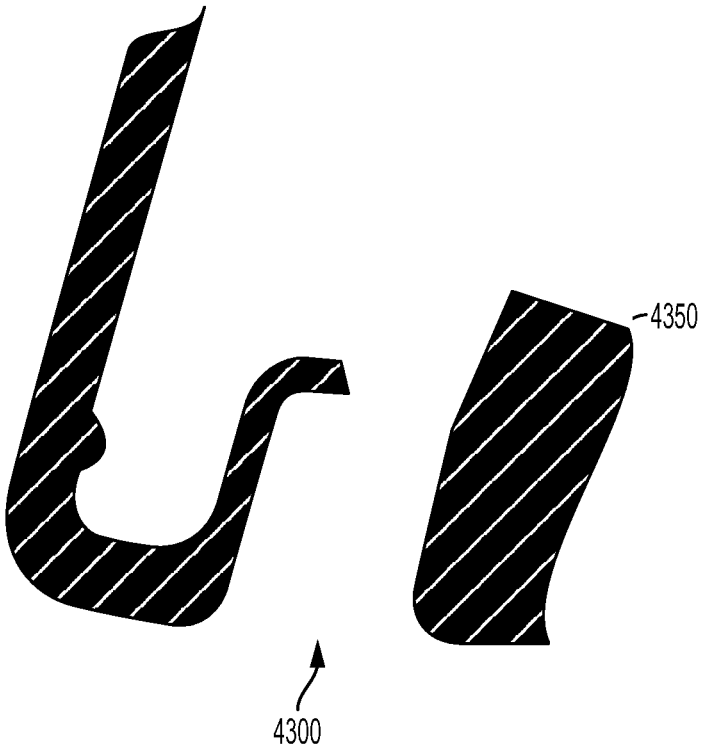
FIG. 18 is a detail cross-sectional view of the golf club head taken in the plane indicated by line 18-18 in FIG. 17.
Figure 19:
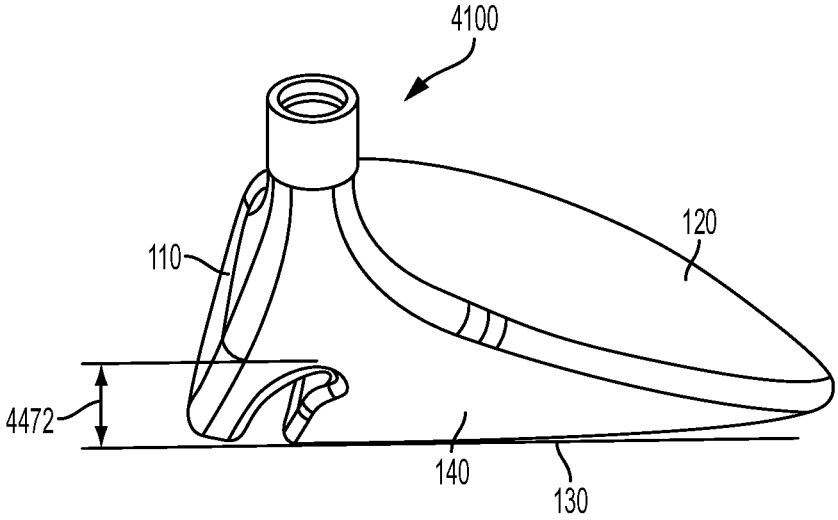
FIG. 19 is a heel side view of the golf club head of FIG. 17.

A golf club head 4100 includes a BCF 4300 as shown with reference to FIG. 17. With reference to FIG. 18, the BCF 4300 includes an overhang portion 4367 that extends rearwardly from a lip feature 4555 which is similar to lip feature 3555. The overhang portion 4367 is connected to the lip feature 4555 as a further stress reduction feature to reduce the concentration of stress on particular elements of the BCF 4300. As can be seen with further review of FIG. 17, the BCF 4300 generally follows the contour of the leading edge 170 as with embodiments elsewhere in this disclosure and in the disclosure of application for U.S. patent bearing Ser. No. 13/839,727. A weight pad 4350 can be seen partially in the view of FIG. 18 and is similar in shape and size to the weight pad 1350 as described previously within this disclosure. As seen with reference to FIG. 19, the BCF 4300 extends to a height 4472 above the GP that is about 14.0 mm in the current embodiment. The height 4472 is about the same as the height 2472, and one of skill in the art would understand that the dimension variants of height 2472 would apply to height 4472 as well.

As noted previously in this disclosure, the BCFs disclosed herein manipulate the boundary conditions to provide altered spin profiles for golf shots in accord with the current disclosure.

The distances as measured in various tests as described in the current disclosure are based on finite element analysis (FEA) simulations. In general, test parameters for both FEA and robot testing are set up the same. For fairway wood-type and hybrid-type golf club head testing and analysis, the test is setup having impact conditions of 107 mph club head speed, 4° de-lofting at impact, 0.5° downward path, and 0° scoreline relative to ground (score lines parallel to ground plane). This is experimentally verified with similar setup conditions in the methodology as follows. Utilizing a robot and a head tracker to set up the club for a center face shot. The impact conditions are 107±1 mph club head speed, 4±1° de-lofting, 0±1° scoreline lie angle relative to ground, 2±1° open face angle relative to target line, 2±1° inside-to-outside head path, and 0.5±1° downward path. For driver-type golf club head testing and analysis, target club head speed is 107 mph, 0° delofting, 0.5° downward path, and 0° scoreline relative to ground. For robot testing related to driver-type golf club head testing, impact conditions are 107±1 mph club head speed, 0±1° delofting, 0±0.5° scoreline relative to ground, face angle to target of 1.5°-2.0°, head path 1.5°-2.0° inside-to-outside, and −1°-0° downward path. For the purposes of this disclosure, the term "impact loft" can be described as head static loft minus delofting. As such, for a fairway wood type golf club head of about 15° static loft with about 4° delofting in FEA analysis, the impact loft is about 11°. Similarly, for a driver-type golf club head having 11° static loft and 0° delofting, the impact loft is about 11°. For the sake of robotic testing, impact loft is the loft of the golf club head as measured at impact. In various testing, dynamic lofting may occur. Depending on how far the CG of the golf club head is from the SA, dynamic loft may have a material impact on the impact loft of the test. For example, in various embodiments, if the golf club head is of about 15° static loft with about 4° delofting for the test conditions specified above, dynamic lofting may cause variance in the impact loft of the golf club head such that the impact loft of the test is greater than 11°. For example, if dynamic lofting added 2°, the net impact loft would be 13° instead of 11°. As such, for FEA testing, dynamic lofting is not considered, and impact loft is merely the static loft minus delofting. For robot testing, impact loft is the actual loft at impact factoring in static loft, test protocol delofting, and dynamic lofting.

Once the robot is set up to achieve the desired head impact conditions, the ball is placed on a tee for center face impact within ±1 mm. At least 10 shots are taken at the center face, and the average distance is measured (both carry and total). The average carry for center face is called $DC_{CF}$ and the average total distance for center face is called $DT_{CF}$. Next, the tee is moved to another impact location (i.e., 5±1 mm heel of center face), and 10 more shots are taken with the average carry and total distance measured. The average carry for 5 mm heel is called $DC_{5H}$ and the average total distance for center face is called $DT_{5H}$. This is repeated for each of the other impact locations where the average carry and total distance are measured based on at least 10 shots from each of these tee positions and the same head presentation as for the center face shot. These are called $DC_{5T}$ and $DT_{5T}$ for 5 mm toe, $DC_{5A}$ and $DT_{5A}$ for 5 mm above center face, and $DC_{5B}$ and $DT_{5B}$ for 5 mm below center face). After measuring average distances for each of the impact locations, the carry range, $DC_{RANGE}$, (maximum average carry—minimum average carry) are determined, and the total distance range, $DT_{RANGE}$, (maximum average total—minimum average total) are calculated. Furthermore, the standard deviation of carry, $DC_{SDEV}$, is calculated from $DC_{CF}$, $DC_{5H}$, $DC_{5T}$, $DC_{5A}$ and $DC_{5B}$; the standard deviation of total distance, $DT_{SDEV}$, is calculated from ($DT_{CF}$, $DT_{5H}$, $DT_{5T}$, $DT_{5A}$ and $DT_{5B}$). In various tests, such analysis and testing can be performed starting from the balance point instead of center face if the two are different. In various embodiments, various tests may follow the same protocol from the balance point—the projection of the CG onto the face. However, unless noted otherwise, data in this disclosure is measured using the test protocol with respect to the CF and not the balance point.

A suitable robot may be obtained from Golf Laboratories, Inc., 2514 San Marcos Ave. San Diego, California, 92104. A suitable head tracker is GC2 Smart Tracker Camera System from Foresight Sports, 9965 Carroll Canyon Road, San Diego, California 92131. Other robots or head tracker systems may also be used and may achieve these impact conditions. A suitable testing golf ball is the TaylorMade Lethal golf ball, but other similar commercially available urethane covered balls may also be used. In general, similar commercially available golf balls are within similar specifications. As such, similar commercially available urethane covered balls include a polyurethane outer cover of a thickness between 0.02-0.05 inches and a Shore D hardness between 50 and 65; at least two layers, wherein at least one layer is a core; a PGA compression of 75-100; a diameter between 1.670-1.690 inches; and a mass between 45-46 grams, all ranges being inclusive. In various embodiments, the COR of the ball at 125 feet per second $V_{in}$ is 0.800-0.820 inclusive, although such COR need not be within the range cited above for all test ball embodiments. In various embodiments, COR of the ball may be different from the range noted above. In most embodiments, at least one layer is an ionomer mantle layer; in most embodiments, the core is a polybutadiene core, although various resin-based core materials may perform similarly to polybutadiene core materials. All balls used for test must be commercially available and USGA conforming. The preferred landing surface for total distance measurement is a standard fairway condition. Also, the wind should be less than 4 mph average during the test to minimize shot to shot variability.

Table 1 includes FEA simulation data as indicated above. The data of Table 1 analyzes the golf club heads of the current disclosure as compared to golf club heads in the industry, particularly one embodiment of application for U.S. patent bearing Ser. No. 13/839,727 as implemented into the TaylorMade JetSpeed fairway wood. Each golf club head of Table 1 was set up with a loft of 14.6°, face angle of 1.0° open, club head speed of 107.0 mph. Data were measured at center face, 5 mm above center face, and 5 mm below center face.

TABLE 1

| | COR | Ball Speed [mph] | Launch Angle [deg] | Spin [rpm] | Carry (yds) | Total (yds) |
|---|---|---|---|---|---|---|
| JetSpeed @ CF | 0.82 | 149.62 | 10.57 | 2808 | 237.68 | 257.8 |
| JetSpeed 5 mm low | 0.789 | 150.01 | 9.13 | 3638 | 232.34 | 248.62 |
| JetSpeed 5 mm high | 0.8 | 146.08 | 11.61 | 2543 | 233.15 | 254.79 |
| Golf Club Head 1100 @ CF | 0.823 | 150.12 | 10.55 | 2707 | 238.84 | 259.8 |
| Golf Club Head 1100 5 mm low | 0.804 | 151.19 | 8.92 | 3567 | 234.76 | 251.5 |
| Golf Club Head 1100 5 mm high | 0.8 | 146.32 | 11.7 | 2403 | 233.7 | 256.5 |
| Golf Club Head 4100 @ CF | 0.832 | 150.9 | 10.61 | 2448 | 240 | 263.5 |
| Golf Club Head 4100 5 mm low | 0.814 | 152.03 | 9.23 | 3145 | 238.8 | 257.7 |
| Golf Club Head 4100 5 mm high | 0.804 | 146.78 | 11.62 | 2314 | 233.9 | 257.8 |

As can be seen, each of the golf club heads of the current disclosure decreased spin on all comparable shots. Additionally, COR was higher at most locations, resulting in increased ball speed. As a result, shots struck with the various golf club heads traveled longer total distance than the comparable JetSpeed golf club head.

Table 2 includes robot test data setup as indicated above. Golf club head 1100 was of 15° loft angle. Golf club head 4100 was of 15° loft angle. The reference club—a TaylorMade JetSpeed fairway wood—was of 14.5° loft angle. All head speeds were between 106.5 mph and 107.9 mph at testing.

TABLE 2

| | Ball Speed [mph] | Launch Angle [deg] | Spin [rpm] | Carry (yds) | Total (yds) |
|---|---|---|---|---|---|
| JetSpeed @ CF | 151.6 | 11.6 | 3915 | 236.6 | 248.3 |
| JetSpeed 5 mm low | 150.0 | 9.49 | 4419 | 226.9 | 238.9 |
| JetSpeed 5 mm high | 150.7 | 13.2 | 3232 | 244.1 | 257.6 |
| JetSpeed 5 mm heel | 147.8 | 11.6 | 4101 | 226.7 | 238.3 |
| JetSpeed 5 mm toe | 147.4 | 12.2 | 4141 | 226.4 | 237.4 |
| Golf Club Head 1100 @ CF | 152.5 | 11.1 | 3239 | 244.1 | 259.4 |
| Golf Club Head 1100 5 mm low | 152.0 | 8.93 | 3696 | 236.5 | 251.7 |
| Golf Club Head 1100 5 mm high | 151.0 | 12.4 | 2646 | 246.3 | 264.8 |
| Golf Club Head 1100 5 mm heel | 147.9 | 11.1 | 3333 | 235.2 | 250.7 |
| Golf Club Head 1100 5 mm toe | 150.6 | 11.4 | 3034 | 237.8 | 254.6 |
| Golf Club Head 4100 @ CF | 152.44 | 11.1 | 3103 | 244.4 | 260.7 |
| Golf Club Head 4100 5 mm low | 152.0 | 12.3 | 3454 | 238.0 | 254.6 |
| Golf Club Head 4100 5 mm high | 151.9 | 9.04 | 2588 | 245.6 | 264.5 |
| Golf Club Head 4100 5 mm heel | 147.1 | 10.7 | 3294 | 233.0 | 249.5 |
| Golf Club Head 4100 5 mm toe | 151.6 | 10.7 | 3107 | 237.3 | 254.4 |

In various live player tests, a group of ten golfers, each having a USGA handicap index of 0.0-5.0, stuck shots with the golf club heads of the current disclosure and with at least one reference golf club head. Each golfer struck ten total shots with each golf club head and each reference golf club head. The test was performed by striking 5 shots with the same golf club head at a time, then striking 5 shots with another golf club head chosen at random.

In the test of the current example, two reference clubs were used and included the TaylorMade Burner fairway wood from 2008 (Burner '08) and the TaylorMade JetSpeed fairway wood along with golf club head 1100 and golf club head 4100.

Averages were determined as reproduced in Table 3.

TABLE 3

| | Initial Ball Speed (mph) | Backspin (rpm) |
|---|---|---|
| Burner '08 | 142.6 | 4361 |
| JetSpeed | 148.3 | 3373 |
| Golf Club Head 1100 | 148.6 | 2567 |
| Golf Club Head 4100 | 149.7 | 2595 |

A similar player test was performed with driver-type golf club heads of the current disclosure, including golf club heads 2100 and 3100, as compared to the JetSpeed driver as a reference club. The player test was set up as indicated previously with respect to golf club heads 1100 and 4100. All driver-type golf club heads tested were of static loft of 10.7°. Averages were determined as reproduced in Table 4.

TABLE 4

| | Initial Ball Speed (mph) | Backspin (rpm) |
|---|---|---|
| JetSpeed | 153.0 | 2601 |
| Golf Club Head 2100 | 153.1 | 2576 |
| Golf Club Head 3100 | 153.8 | 2136 |

As can be seen from simulation, robot, and player testing data, BCFs of the current disclosure substantially decreased spin rates for similar shots in similar conditions. In various embodiments, COR increased as compared to reference clubs. In various embodiments, ball speed increased as compared to reference clubs. In the measurements of Table 4, impact loft was about 11±1°.

The golf club heads were tested for COR as indicated below with reference to Table 5. COR data was gathered at the balance point (projection of CG onto the face 110). Then data was taken at points moving out from the balance point. The data set includes points ±7.5 mm and ±15 mm heelward and toeward from the balance point wherein heelward is positive and toeward is negative. The data set includes points ±5 mm from the balance point and −10 mm from the balance point wherein crownward is positive and soleward is negative. Additionally, the data set includes points that are located ±10 mm heelward and toward from the balance point and ±5 mm crownward and soleward of the balance point. Measurements were made on the TaylorMade JetSpeed fairway wood as a reference club as compared to golf club heads 1100 and 4100. The data is summarized below with reference to Table 5.

TABLE 5

| COR at x-axis, z-axis (as measured from BP) | JetSpeed/ Reference | Golf Club Head 1100 | Golf Club Head 4100 |
|---|---|---|---|
| Balance Point (0, 0) | 0.809 | 0.817 | 0.819 |
| +7.5, 0 | 0.787 | 0.799 | 0.786 |
| −7.5, 0 | 0.788 | 0.800 | 0.795 |
| +15, 0 | 0.743 | 0.731 | 0.743 |
| −15, 0 | 0.742 | 0.768 | 0.745 |
| 0, +5 | 0.788 | 0.789 | 0.813 |
| 0, −5 | 0.784 | 0.806 | 0.806 |
| 0, −10 | 0.761 | 0.788 | 0.780 |
| +10, +5 | 0.745 | 0.765 | 0.752 |
| −10, +5 | 0.747 | 0.766 | 0.760 |
| +10, −5 | 0.737 | 0.760 | 0.764 |
| −10, −5 | 0.738 | 0.777 | 0.766 |

Although various points are taken for the data of Table 5, more or fewer points may be taken as needed to determine more with more specificity the COR data for any golf club head. COR data for various golf club heads of the current disclosure is also seen with reference to FIG. 20A. Similar to the data of Tables 1 and 2, the data for FIG. 20A covered a reference club; the reference club was a TaylorMade JetSpeed fairway wood of about 15° static loft. Similarly, data was gathered for golf club head 1100 and golf club head 4100. Golf club head 1100 is covered in the data of FIG. 20B. Golf club head 4100 is covered in the data of FIG. 20C. All clubs tested with respect to FIGS. 20A-20C were of about 15° static loft.

Figure 20A:
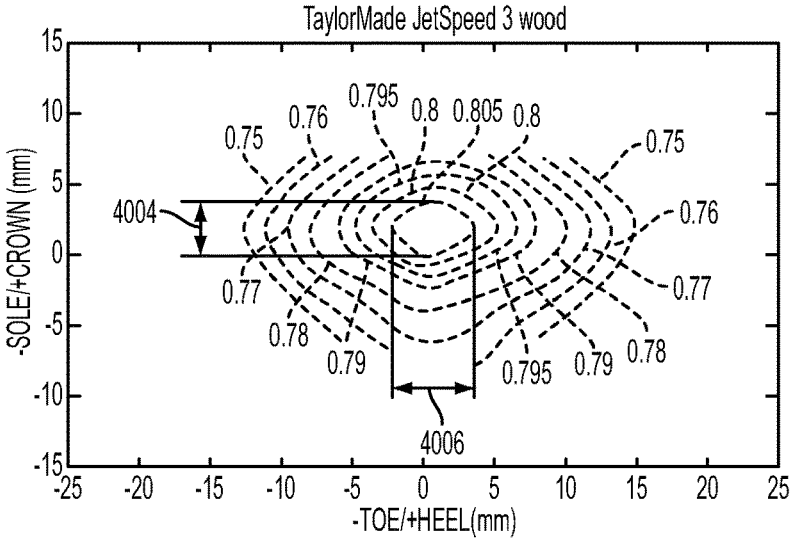
FIG. 20A is a plot showing COR values related to a reference club.
Figure 20B:
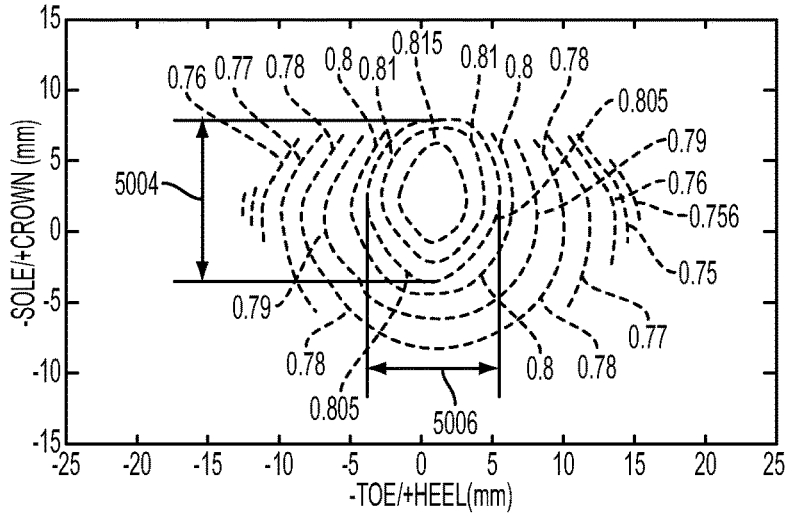
FIG. 20B is a plot showing COR values related to a golf club head in accord with one embodiment of the current disclosure.
Figure 20C:
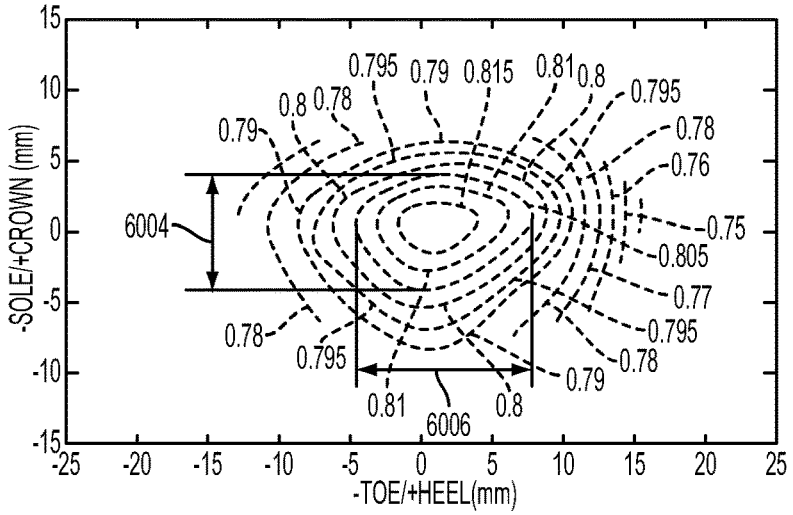
FIG. 20C is a plot showing COR values related to a golf club head in accord with one embodiment of the current disclosure.

Data regarding COR of the various golf club heads is aggregated with reference to FIGS. 20A-20C. For any area of the face 110, golf club heads 1100 and 4100 tend to have higher COR as compared to the JetSpeed reference club. Each band of FIGS. 20A-20C represents the approximate margin of the COR annotated. For example, for all area inside a band annotated as "0.8," the COR of the golf club head is at least 0.800. Understanding the size of each COR band aids in understanding the area of the golf club face that is above a certain COR.

However, the shapes of the COR bands are not perfectly circular. Although COR area can likely be calculated by interpolation software, an exact measure of the face area above a certain COR may be difficult to accomplish. As such, an approximation of COR area can be taken.

In order to determine an approximation of the COR area for any band, a first extent of the band is taken parallel to the z-axis, and a second extent of the band is taken parallel to the x-axis. The first extent and second extent are maximum dimensions of the shape for which the COR is at least the required number. From each of the first extent and the second extent, a circle is made using each extent as a diameter. The area of each circle is calculated, and an average of the areas of the two circles provides an approximation of the area within the band, also known as an equivalent area and represented as $Area_{Equivalent}$. Formulas representing the procedure above are provided below. For the sake of the formulas, the first extent is annotated as $Z_{Extent}$ and the second extent is annotated as $X_{Extent}$.

$$Area_{Equivalent} = \frac{Area_{Z-Extent} + Area_{X-Extent}}{2}$$

wherein $$Area_{Z-Extent} = \pi\left(\frac{z_{Extent}}{2}\right)^2$$

$$Area_{X-Extent} = \pi\left(\frac{x_{Extent}}{2}\right)^2$$

As seen with particular reference to FIG. 20A, a first extent 4004 and a second extent 4006 are seen for the COR having a value of at least 0.805. For the embodiment of the JetSpeed reference club, the first extent 4004 is about 3.8 mm and the second extent 4006 is about 4.7 mm for a COR of at least 0.805. The circular area relative to the first extent 4004 is about 11.3 $mm^2$ and the circular area relative to the second extent 4006 is about 17.3 $mm^2$. An average of the two areas representing an equivalent area is about $Area_{Equivalent}$=14.3 $mm^2$. Because such numbers are approximations, it is understood that a difference of up to 5% is within reasonable error of the measurement and calculation methodology. Similarly, if actual COR area is known, it will be understood that a calculation error of up to 10% is reasonable given the error of the measurements and calculation methodology.

With reference to FIG. 20B—which represents golf club head 4100—a first extent 5004 of an area for which the COR is at least 0.805 is about 11.3 mm and a second extent 5006 is about 9.3 mm. The circular area relative to the first extent 5004 is about 100.3 $mm^2$ and the circular area relative to the second extent 5006 is about 67.9 $mm^2$. As such, an average of the two areas representing an equivalent area is about $Area_{Equivalent}$=84.1 $mm^2$.

Similarly, with reference to FIG. 20C—which represents golf club head 1100—a first extent 6004 of an area for which the COR is at least 0.805 is about 8.0 mm and a second extent 6006 is about 12.2 mm. The circular area relative to the first extent 6004 is about 50.3 $mm^2$ and the circular area relative to the second extent 6006 is about 116.9 $mm^2$. As such, an average of the two areas representing an equivalent area is about $Area_{Equivalent}$=83.6 $mm^2$.

With respect to the various measurements, Table 6 reproduces data of the interpolation charts for the first and second extents of each COR for each club, as shown.

TABLE 6

| | JetSpeed reference | | | 4100 | | | 1100 | | |
|---|---|---|---|---|---|---|---|---|---|
| COR | $Z_{Extent}$ | $X_{Extent}$ | $A_{Equivalent}$ | $Z_{Extent}$ | $X_{Extent}$ | $A_{Equivalent}$ | $Z_{Extent}$ | $X_{Extent}$ | $A_{Equivalent}$ |
| 0.815 | 0 | 0 | 0 | 7.1 | 4.9 | 29.2 | 3.8 | 5.8 | 18.7 |
| 0.810 | 0 | 0 | 0 | 10.9 | 8.7 | 76.1 | 6.0 | 9.6 | 50.0 |
| 0.805 | 3.8 | 4.7 | 14.3 | 11.3 | 9.3 | 84.6 | 8.0 | 12.2 | 83.8 |
| 0.800 | 5.6 | 8.9 | 43.1 | 13.1 | 11.6 | 119.9 | 10.4 | 15.3 | 135.2 |
| 0.795 | 7.3 | 11.6 | 73.6 | ND | ND | ND | 12.4 | 17.6 | 181.8 |
| 0.790 | 8.9 | 13.8 | 105.6 | ND | ND | ND | 14.7 | 19.3 | 231.3 |
| 0.780 | 11.6 | 18.2 | 182.8 | ND | ND | ND | ND | ND | ND |

For Table, data points indicated with "ND" are meant to indicate that no data is collected for the data point. For the JetSpeed reference club, "0" is included wherein no area exists wherein the COR is above 0.810 as tested.

In testing, one methodology involves first finding the balance point of the club. Following such a determination, additional impact points that are coaxial with the balance point can be used as measured parallel to the x-axis and parallel to the z-axis. Tests may be performed along each of these axes to determine most closely the extent of a range having the desired COR. When the desired COR is determined in the ±x-axis and ±z-axis directions, these values may be substituted for the $Z_{Extent}$ and $X_{Extent}$ values to determine $A_{Equivalent}$. In many embodiments, the determined value will be within 10% measurement and calculation error of the actual value.

Figure 21:
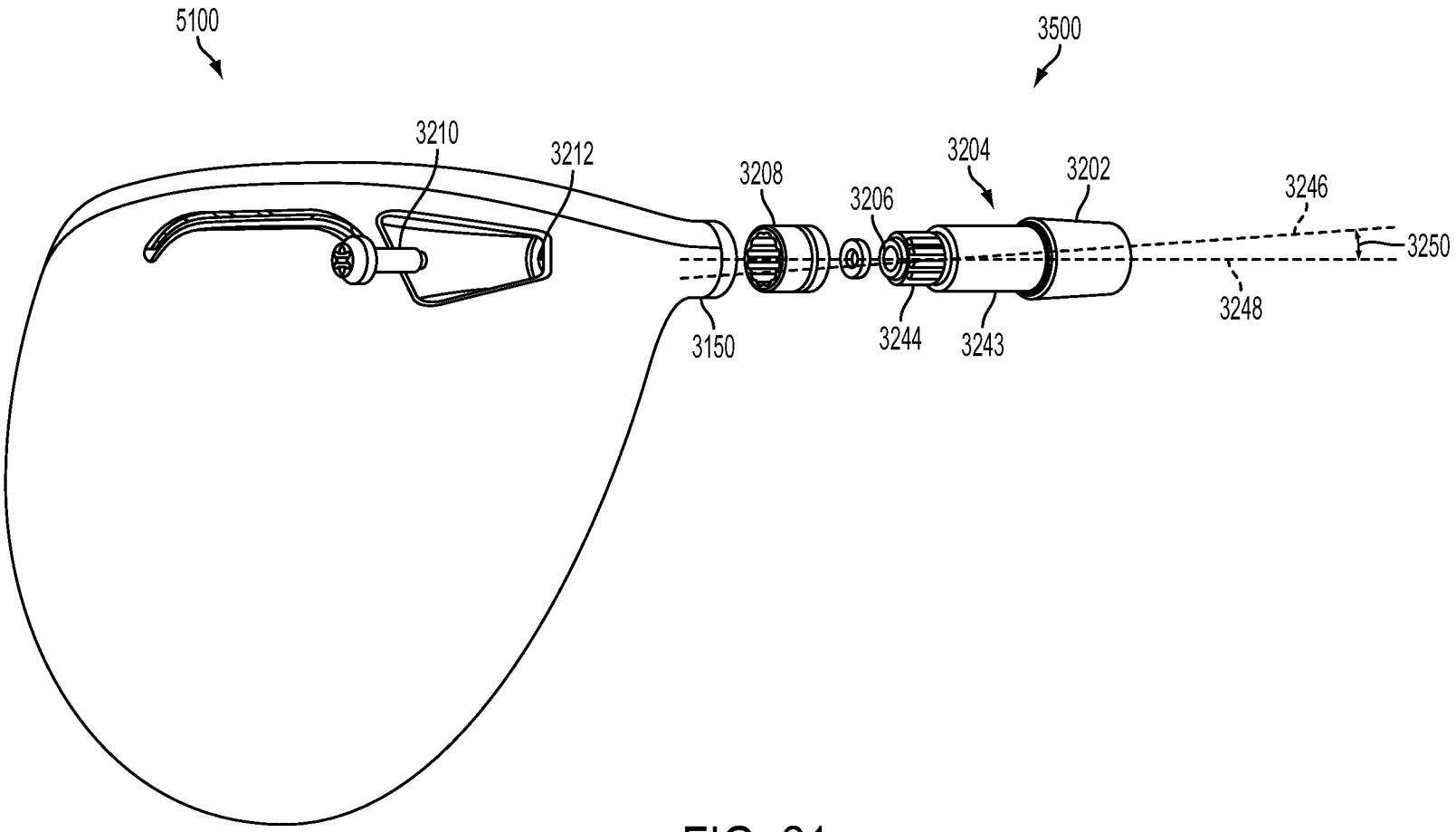
FIG. 21 is a golf club head in accord with one embodiment of the current disclosure including a loft sleeve.
Figure 22A:
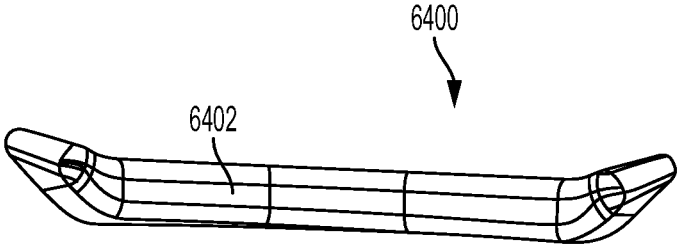
FIG. 22A is a top side view of a plug in accord with one embodiment of the current disclosure.
Figure 22C:
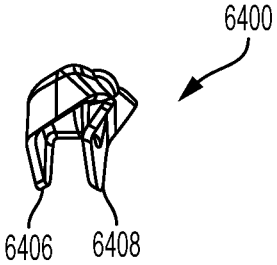
FIG. 22C is a left side view of the plug of FIG. 22A.
Figure 22B:
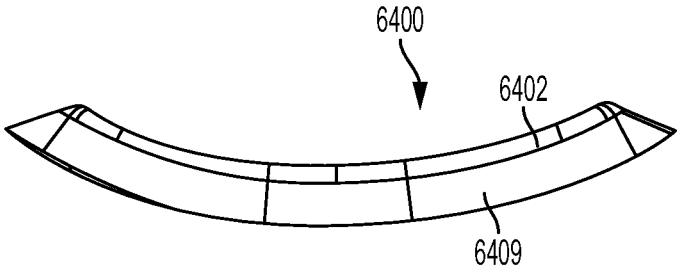
FIG. 22B is a front side view of the plug of FIG. 22A.
Figure 22D:
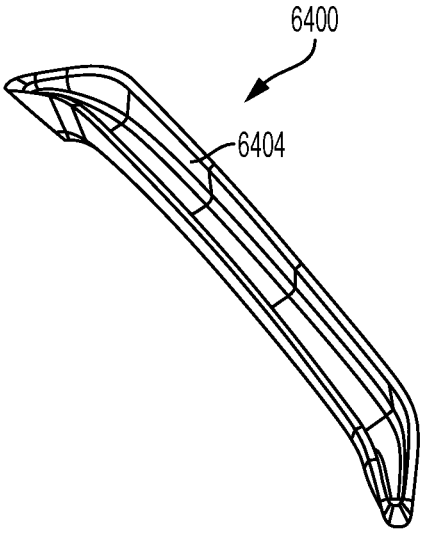
FIG. 22D is a perspective view of the plug of FIG. 22A.

The embodiment shown in FIG. 21 includes an adjustable loft, lie, or face angle system that is capable of adjusting the loft, lie, or face angle either in combination with one another or independently from one another as described in detail in U.S. Pat. No. 7,887,431, entitled "GOLF CLUB," filed Dec. 30, 2008, which is incorporated by reference herein it its entirety. A shaft (not shown) is inserted into the sleeve bore and is mechanically secured or bonded to the sleeve 3204 for assembly into a golf club using a golf club head 5100, which may be a golf club head of the current disclosure (golf club head 100, 1100, 2100, 3100, 4100). The sleeve 3204 further includes an anti-rotation portion 3244 at a distal tip of the sleeve 3204 and a threaded bore 3206 for engagement with a screw 3210 that is inserted into a sole opening 3212 defined in the golf club head 5100. The anti-rotation portion 3244 of the sleeve 3204 engages with an anti-rotation collar 3208 which is bonded or welded within a hosel 3150 of the golf club head 5100. Although not shown, the shaft and a grip may be included as part of the golf club assembly 3500. For example, a first portion 3243 of the sleeve 3204, the sleeve bore 3242, and the shaft collectively define a longitudinal axis 3246 of the assembly. The sleeve 3204 is effective to support the shaft along the longitudinal axis 3246, which is offset from a longitudinal axis 3248 of the by offset angle 3250. The longitudinal axis 3248 is intended to align with the SA (seen in FIG. 7, for example). The sleeve 3204 can provide a single offset angle 3250 that can be between 0 degrees and 4 degrees, in 0.25 degree increments. For example, the offset angle can be 1.0 degree, 1.25 degrees, 1.5 degrees, 1.75 degrees, 2.0 degrees or 2.25 degrees. The sleeve 3204 can be rotated to provide various adjustments to the golf club assembly 3500. In various embodiments, the sleeve 3204 may be mechanically fastenable to the golf club head 5100 to secure the shaft in a variety of positions relative to the golf club head 5100, thereby altering at least one of the loft angle, lie angle, and face angle of the golf club head 5100. In various embodiments, the sleeve 3204 may be secured to the hosel or to another portion of the golf club head 5100 depending on arrangement. One of skill in the art would understand that using mechanical methods would be considered fastening to the hosel. In various embodiments, mechanical fastening may include, a variety of connection mechanisms, including screws, various threading arrangements, velcros and similar systems, and the use of glues and various other permanent fastening methods, among others. One of skill in the art would understand that the system described with respect to the current golf club assembly 3500 can be implemented the various embodiments of golf club heads (1100, 2100, 3100, 4100) of the current disclosure.

Because the BCFs of the current embodiment include through-slot embodiments (providing a void in the golf club body), it is advantageous to fill the BCFs with a plugging material to prevent introduction of debris and to provide separation between the interior and the exterior of the various golf club heads of the various embodiments. The plugging materials disclosed in application for U.S. patent bearing Ser. No. 13/839,727 are generally suitable for BCFs of the current embodiments and are incorporated herein by reference.

In various embodiments, the plugging material may be replaced with a plug such as plug 6400, shown in FIGS. 22A-22D. As seen, the plug 6400 includes an inner side 6402 and an outer side 6404. Although the outer side 6404 appears to be concave, the plug 6400 is arranged in a golf club head such as golf club heads 1100 and 2100 such that the outer side 6404 is in communication with the outside and the inner side 6402 is bonded within the BCF 1300 and 2300, respectively. The plug 6400 includes a first wall 6406 and a second wall 6408. The second wall 6408 is spaced from the first wall 6406. An outer surface 6409 is designed to be bonded to the vertical surface 385 in the BCFs 1300,2300 using DP-420 adhesive, although various types of adhesives may be used and would be known to one of skill in the art. Although the plug 6400 that is shown in the current embodiment is designed for use with BCFs 1300, 2300 of golf club heads 1100,2100, one of skill in the art would understand that minor modifications could be made for use with the various BCFs of the current disclosure and with various embodiments of CORFs in related disclosures that are incorporated by reference herein.

The plug 6400 of the current embodiment is made of a polyurethane material. In various embodiments, thermoset or thermoplastic polyurethane may be used for the plug 6400. In various embodiments, multi-material construction may be used. In various embodiments, various plastics, rubbers, foams, and other similarly pliable material may be used. Similar to previously noted for plugging materials, the plug 6400 is designed to provide minimal interference with the deflection and movement of the BCFs of the current disclosure. In various embodiments, simply filling BCFs of the current disclosure with plugging materials may have a material impact on COR of the golf club head, providing adverse response as compared to a golf club head including a BCF that does not include a plugging material. The construction and material composition of the plug 6400 allows the plug 6400 to deform substantially without significant load being placed on the BCFs or golf club heads of the current disclosure when deformation occurs upon impact with a golf ball. As such, the plug 6400 does not significantly restrict the COR of the golf club heads of the current disclosure.

In various embodiments, golf club heads and golf clubs of the current disclosure may include features allowing modifiable boundaries. In various embodiments, boundary conditions may be adjustable during manufacturing or capable of alteration post-manufacture to provide selectable spin and COR modifications. In various embodiments, boundary conditions may be modifiable by utilizing a separate apparatus to provide varying boundary conditions. In various embodiments, boundary conditions may be user-selectable such that the boundaries are capable of being modified by user-selection.

Figure 23B:
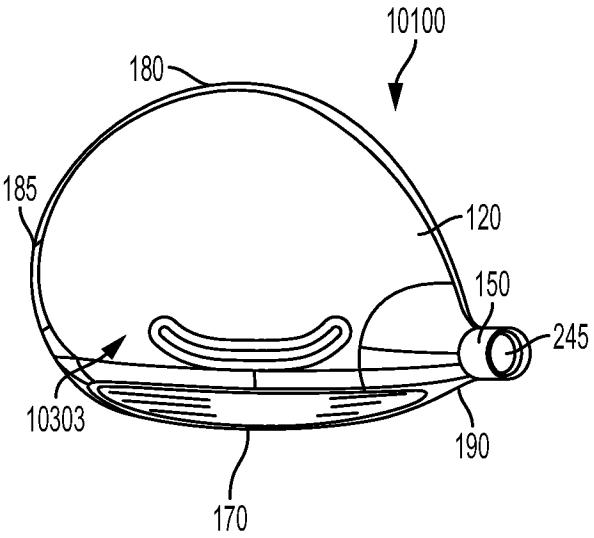
FIG. 23B is a bottom view of the golf club head of FIG. 23A.
Figure 23A:
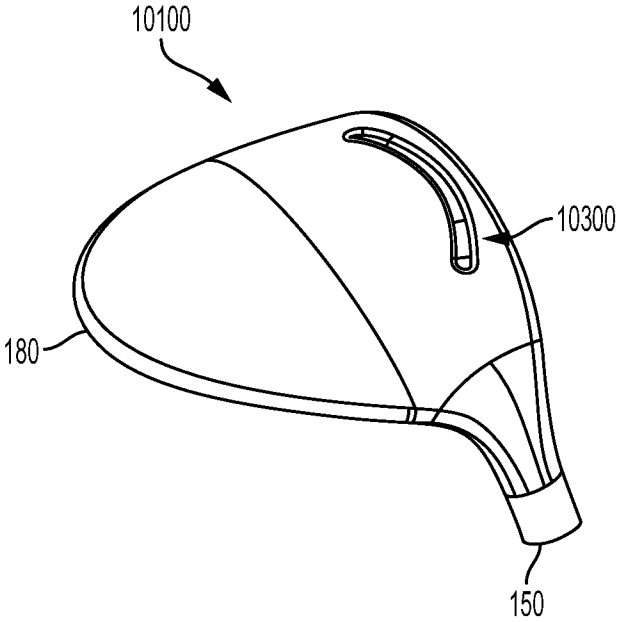
FIG. 23A is a perspective view of the golf club head in accord with one embodiment of the current disclosure.

As described and disclosed in further detail below with reference to FIGS. 23A-23B, a golf club head 10100 of the current disclosure includes features and elements capable of allowing adjustment to the boundary condition. In various embodiments, boundary condition features such as those disclosed with reference to golf club head 10100 and those disclosed elsewhere in the current disclosure may be modified to create desirable boundary conditions. In accord with the current disclosure, it may be valuable to modify boundary conditions to alter COR, spin, or varying other elements of resultant golf shots as disclosed elsewhere herein. In various embodiments, boundary conditions may be modifiable through manufacturing processes allowing closer tuning of the COR through boundary condition manipulation. In various embodiments, post-manufacture methods and apparatus may be utilized to provide altered boundary conditions to alter club performance and attain a targeted playing characteristic. In various embodiments, adjustment mechanisms may be user-selectable to provide adjustment of playing conditions through on-course or pre-round adjustment. In various embodiments, adjustment may be made automatically, such as through the use of variable springs, dampers, or through electronic or other automated apparatus and/or mechanisms. In various embodiments, adjustment mechanisms may include varying inserts, including inserts into boundary condition features having varying durometer materials to provide altered boundary conditions in user-selectable performance. In various embodiments, adjustment mechanism may include inserts having mechanical features or constructions allowing variation in boundary condition. For example, in various embodiments, inserts may perform similarly to springs, helical springs, leaf springs, or various other constructions allowing variation in fixedness without variation in material. In various embodiments, modifying boundary condition features may include removing or otherwise altering some stiffening BCFs to provide a softer playing condition in that area. Through use of the methods and apparatus described herein, golf club heads of the current disclosure may achieve favorable combination of launch, spin, and COR.

One embodiment of is golf club head 10100. As can be seen, the golf club head 10100 includes a sole-located BCF 10300 and a crown located BCF 10303. In the current embodiment, both BCFs 10300,10303 are softening BCFs, although various embodiments may replace softening BCFs with stiffening BCFs for alteration as desired. In the current embodiment, both BCFs 10300,10303 are consistent with the construction of CORF 300, although this is not necessary for all embodiments. Other BCFs disclosed herein may be interchanged with the BCFs 10300,10303 of the current embodiment. In the current embodiment, BCF 10300 is similar in structure to BCF 10303, although these two structures need not be similar in appearance or construction in various embodiments.

Figure 24:
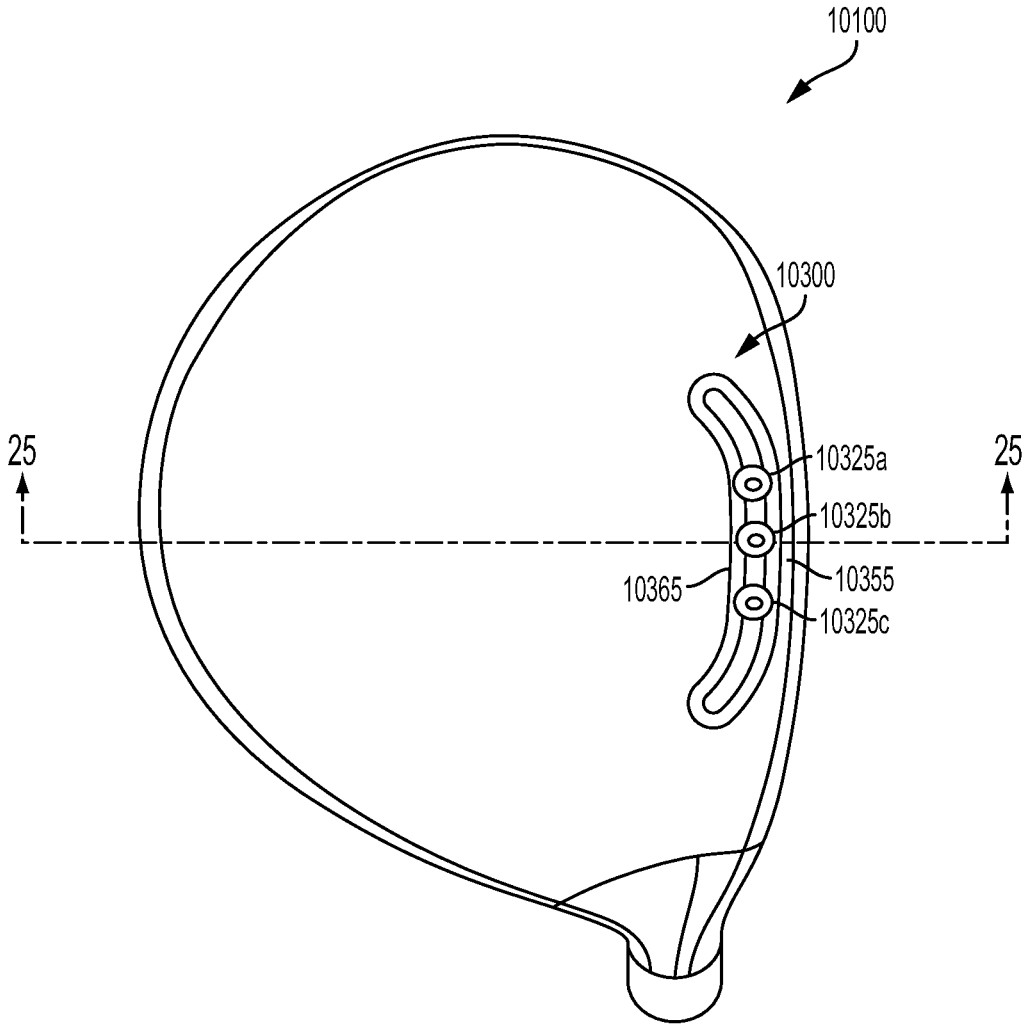
FIG. 24 is a bottom view of the golf club head of FIG. 23A including a BCF insert in accord with one embodiment of the current disclosure.

As seen in FIG. 24, the golf club head 10100 may include a BCF modifier in the form of at least one BCF insert 10325*a,b,c*. In the current embodiment, each BCF insert 10325*a,b,c* is a fastener assembly. The fastener assembly BCF inserts 10325*a,b,c* provide a connection that bridges over the BCF 10300, mechanically connecting a first sole portion 10355 to a weight pad portion 10365 of the golf club head 10100. One of skill in the art would understand that fasteners may be made of a variety of materials and constructions. In the current embodiment, the fastener assembly BCF inserts 10325*a,b,c* are of a rigid material being made of metal or other similarly rigid material. However, in varying embodiments, the construction of fasteners and the arrangement of BCF inserts may be altered as desired. Because of the rigid nature of the fastener assembly BCF inserts 10325*a,b,c*, the inclusion of each fastener assembly BCF insert 10325*a,b,c* provides a more rigid zone in the location of that particular BCF insert 10325*a,b,c*. As such, the BCF 10300 may be selectively modified by including more or fewer BCF inserts 10325 across the BCF 10300. In the current embodiment, BCF inserts 10325*a,b,c* are shown along more than one portion of the BCF 10300, but various embodiments may have fewer or more BCF inserts 10325 in varying locations.

BCF inserts 10325*a,b,c* provide a rigid attached by virtue of being rigid assemblies made of metal. As seen with reference to FIG. 25, the fastener assembly of the BCF insert 10325 includes a threaded fastener 10326 and a nut 10327. One of skill in the art would understand that the fastener 10326 and nut 10327 are but one representation of a mechanical fastener. For example, similar mechanical fastening apparatus may be employed in a slideable fastener arrangement such as those disclosed in application for U.S. patent bearing Ser. No. 13/841,325, entitled "GOLF CLUB HEAD," filed Mar. 15, 2013, application for U.S. patent bearing Ser. No. 13/946,918, entitled "GOLF CLUB HEAD," filed Jul. 19, 2013, and U.S. Pat. No. 7,775,905, entitled "GOLF CLUB HEAD WITH REPOSITIONABLE WEIGHT," filed Dec. 19, 2006. In varying embodiments, the nut 10327 may be permanently attached or integrally formed as a threaded opening in one of the first sole portion 355 or the mass pad portion 365. For example, in various embodiments of the current disclosure and of the disclosure of application for U.S. patent bearing Ser. No. 13/839,727, varying overhang portions may be included into which a threaded fastener may be inserted or included.

Figure 25:
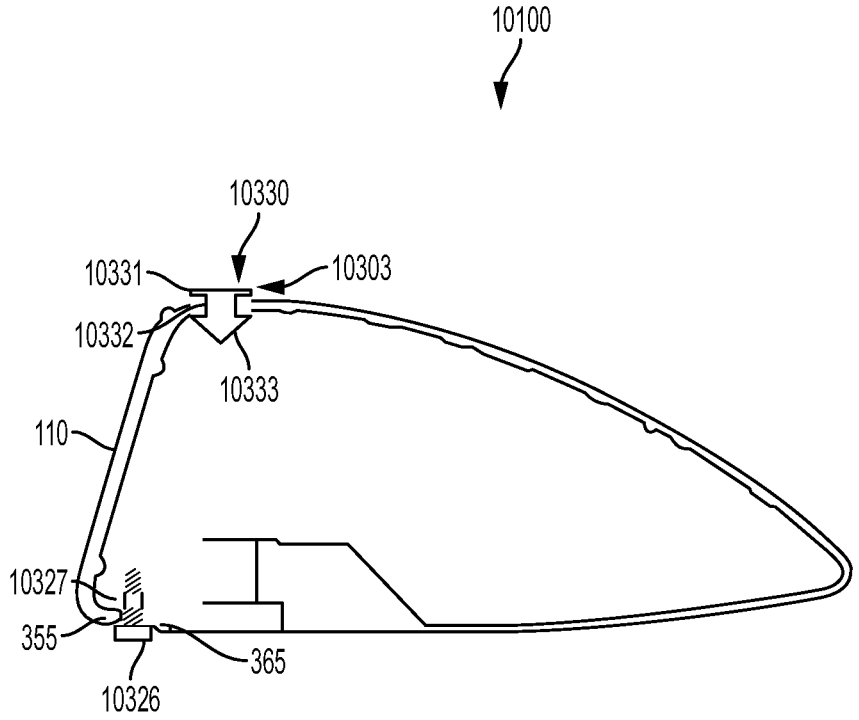
FIG. 25 is a cross-sectional view of the golf club head assembly of FIG. 24 as seen in the plane indicated by line 25-25 in FIG. 24.

However, another embodiment of a BCF insert 10330 is seen with reference to FIG. 25. As can be seen, the BCF insert 10330 is a plug apparatus that spans the gap defined by BCF 10303. In the current embodiment, the BCF insert 10330 is made of a deformable or compressible material such as various plastics, polymers, elastomers, urethanes, foams, rubbers, or combinations thereof, among other possibilities. In the current embodiment, the BCF insert 10330 is generally about the same size and shape as the BCF 10303. The BCF insert 10330 includes an outer portion 10331, a neck portion 10332, and an insert portion 10333. Because the material is at least one of deformable and compressible, it is possible to insert the BCF insert 10330 into the BCF 10303 using mechanical force. In various embodiments, the BCF insert 10330 may be molded into place, fastened into place, or otherwise fixed in the location inside the BCF 10303.

In various embodiments, the BCF insert 10330 may be of varying hardness and of various durometer ratings. For example, in some embodiments, the BCF insert 10330 may be of a soft durometer rating, whereas the BCF insert 10330 may be of a relatively hard durometer rating in other embodiments.

Because the BCF insert 10330 generally fills the gap formed by the BCF 10303, it provides a mechanical connection between portions of the BCF 10303 that are proximate the face 110 and portions of the BCF 10303 that are more distal to the face 110. However, because the BCF insert 10330 is generally not made of highly rigid material, the mechanical connection achieved may be more closely tuned to the requirements of the particular player. For example, by using a relatively softer durometer material, the BCF 10303 including BCF insert 10330 may respond similarly to an open BCF 10303; in contrast, using a relatively hard durometer material, the BCF 10303 including BCF insert 10330 respond more similarly to a golf club head that did not include the BCF 10303; selecting an intermediate durometer may allow the golf club head 10100 to respond materially differently from both a golf club having an open or unrestricted BCF 10303 and a golf club having no BCF 10303.

Figure 26:
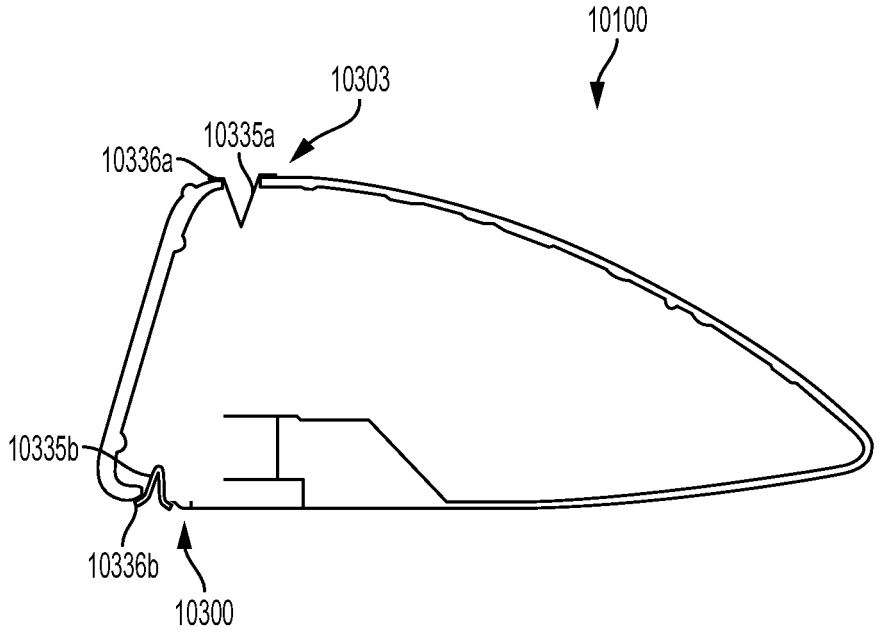
FIG. 26 is a cross-sectional view of the golf club head of FIG. 23A including BCF inserts in accord with an embodiment of the current disclosure.

As seen with reference to FIG. 26, various embodiments of BCF inserts 10335*a,b* may be utilized as well. As seen, BCF inserts 10335*a,b* of the current embodiment are arranged similarly to leaf springs, the BCF inserts 10335*a,b* being of a material having a sufficient modulus to provide some resistance to deformation—such as various metals, some high modulus plastics, reinforced composites, and varying other similar materials. In the current embodiment, the shape and thickness of each BCF insert 10335*a,b* may help provide a variation in deformation under force. For example, the thicker construction of BCF insert 10335*b* as compared to BCF insert 10335*a* would result in BCF insert 10335*b* being stiffer and more resistive to deformation than BCF insert 10335*a* if the two were made of the same material. In general, the bending stiffness of the BCF insert 10335*a,b* can determine the flexibility of the boundary condition at the location of the BCF 10300,10303.

In the current embodiment, BCF inserts 10335*a,b* are formed of metal and generally follow the shape of the respective BCF 10300,10303. The BCF inserts 10335*a,b* include bond interface portions 10336*a,b* that may be bonded to the golf club head 10100. In the current embodiment, bonding may be along an outer surface of the golf club head. Bonding, as referred in this portion of the disclosure, may include adhesive bonding, mechanical attachment, permanent attachment such as welding or co-molding, or a variety of other interfaces as would be understood by one of skill in the art. Although BCF inserts 10335*a,b* of the current embodiment include bond interface portions 10336*a,b*, other similar inserts may omit these portions in view of a different type of interface between the particular insert and the particular BCF.

Figure 27:
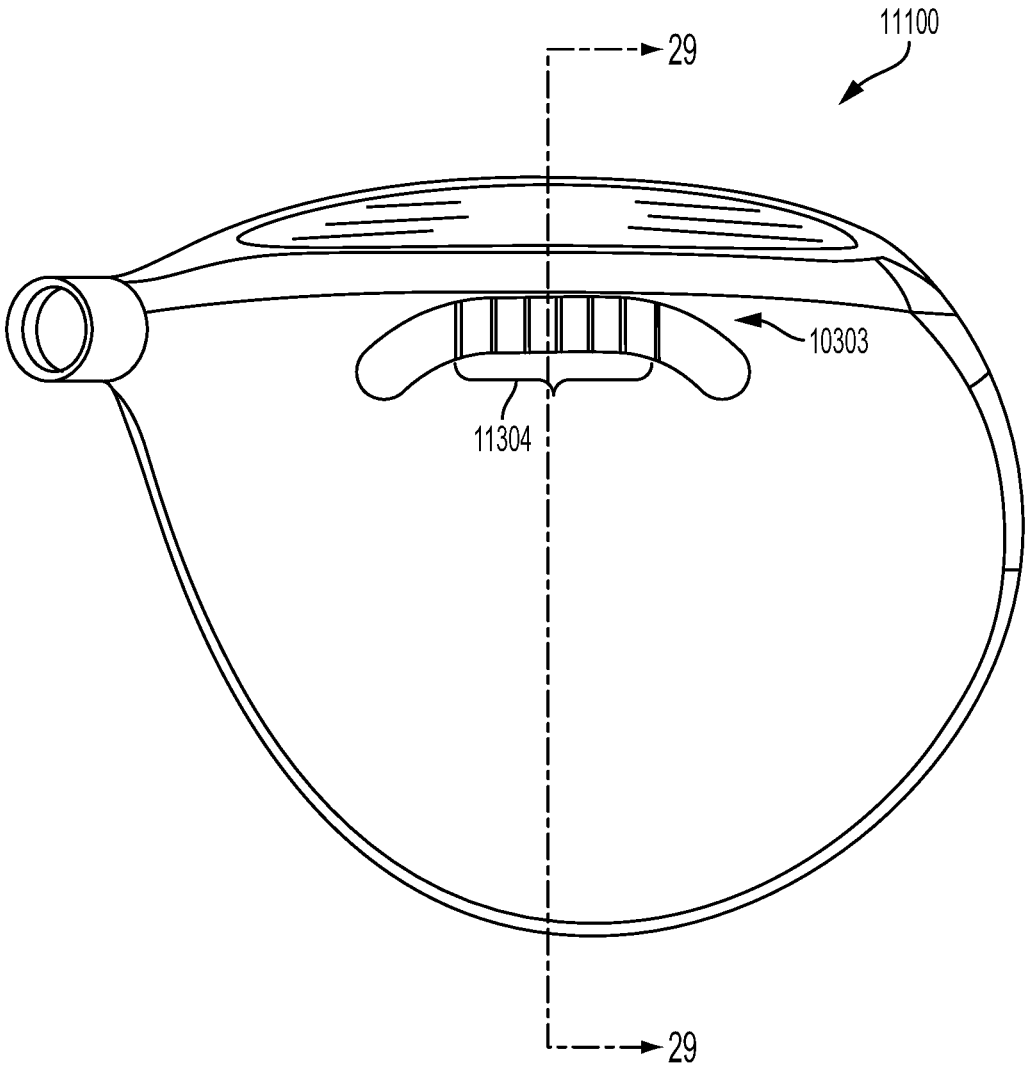
FIG. 27 is a top view of a golf club head in accord with one embodiment of the current disclosure.
Figure 28:
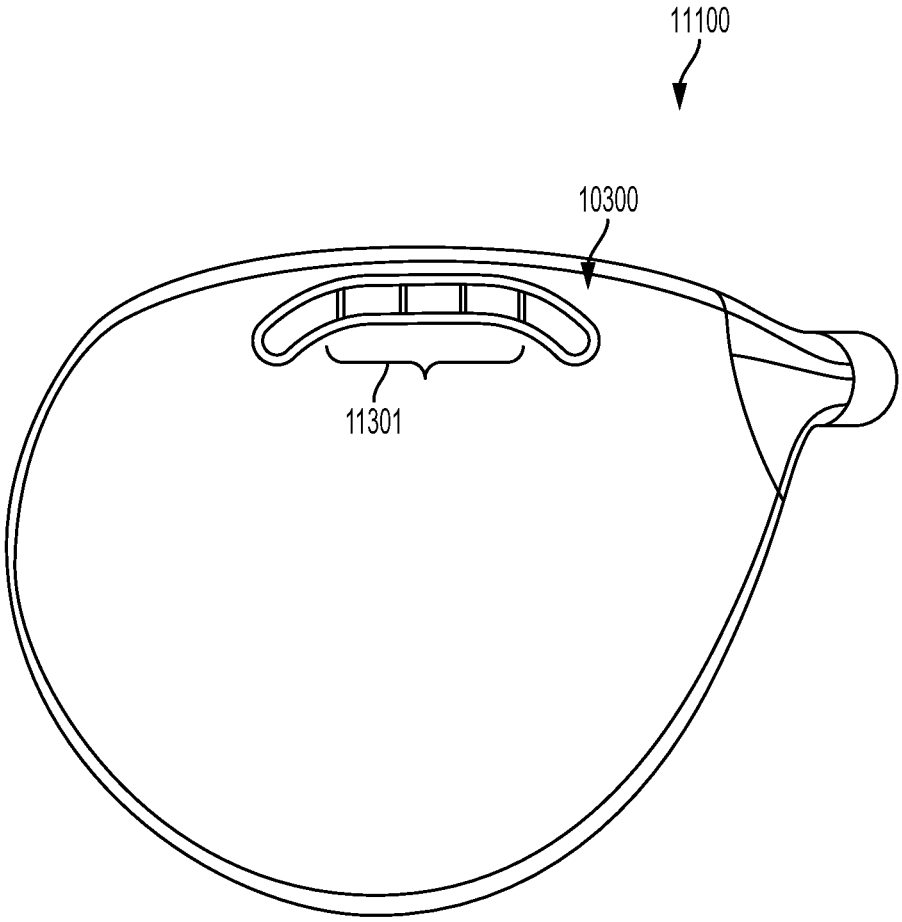
FIG. 28 is a bottom view of the golf club head of FIG. 27.

Post-production modification of the boundary conditions may also be achieved against stiffening BCFs. As seen with reference to FIGS. 27-28, a golf club head 11100 includes the BCFs 10300, 10303 as disclosed with respect to prior embodiments. However, in the current embodiment, each BCF 10300,10303 includes a plurality of linking ribs 11301, 11304 that mechanically link across the BCF 10300,10303, respectively. In the current embodiment, seven linking ribs 11304 are shown and four linking ribs 11301 are shown. In the current embodiment, the linking ribs 11301,11304 are of consistent thickness, although consistent thickness need not be present in all embodiments.

Figure 29:
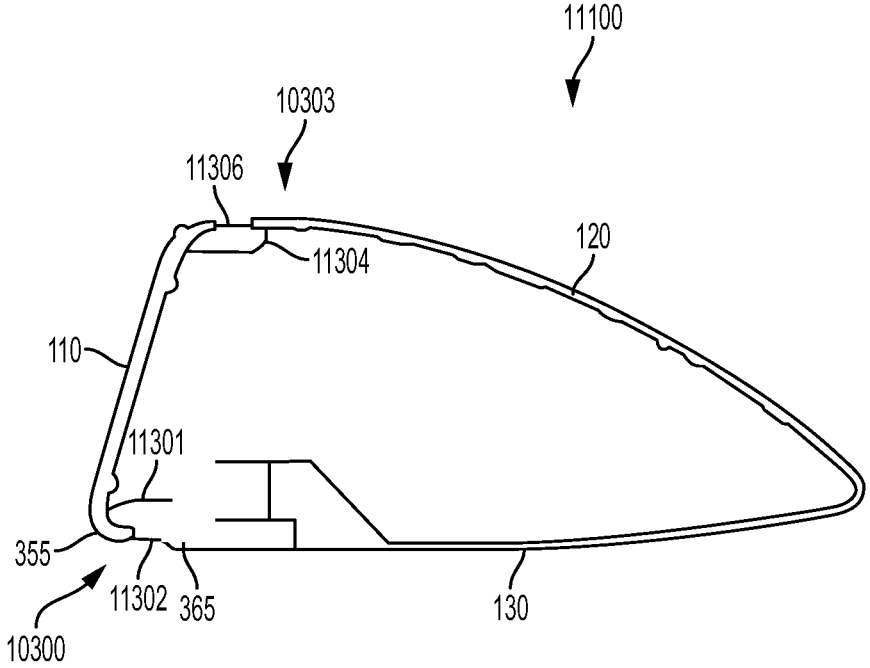
FIG. 29 is a cross-sectional view of the golf club head of FIG. 27 taken in the plane indicated by line 29-29 in FIG. 27.

In various embodiments, the linking ribs 11301,11304 behave as stiffening BCFs as disclosed elsewhere in this disclosure. As seen with reference to FIG. 29, the linking ribs 11301,11304 provide a mechanical linkage between portions of the golf club crown 120 and sole 130 that are more proximate the face 110 and portions of the crown 120 and sole 130 that are distal to the face 110. For example, linking ribs 11301 provide a connection between the first sole portion 355 and the weight pad portion 365. Such a link provides a stiffening element over the BCF 10300.

As shown, an outermost edge 11302,11306 of the linking ribs 11301,11304, respectively, is recessed from the outer surface of the golf club head 11100. In various embodiments, BCFs 10300,10303 may be filled with a filling material. The recessed outermost edges 11302,11306 allows the filling material to be placed over the linking ribs 11301, 11304, effectively hiding the linking ribs 11301,11304 from view. As described elsewhere in this disclosure and in the disclosure of application for U.S. patent bearing Ser. No. 13/839,727, apertures from the exterior to the interior of the golf club head 11100 are required to be covered according to USGA rules. As such, filling materials such as those disclosed herein and in the various disclosures of reference herein may be utilized to provide a cover over the aperture. In various embodiments, a cap, cover, or other surface may be utilized instead of a filling or plugging material. Such cover may be bonded to an outer surface of the golf club head 11100. In various embodiments, various covers may be utilized.

Figure 30:
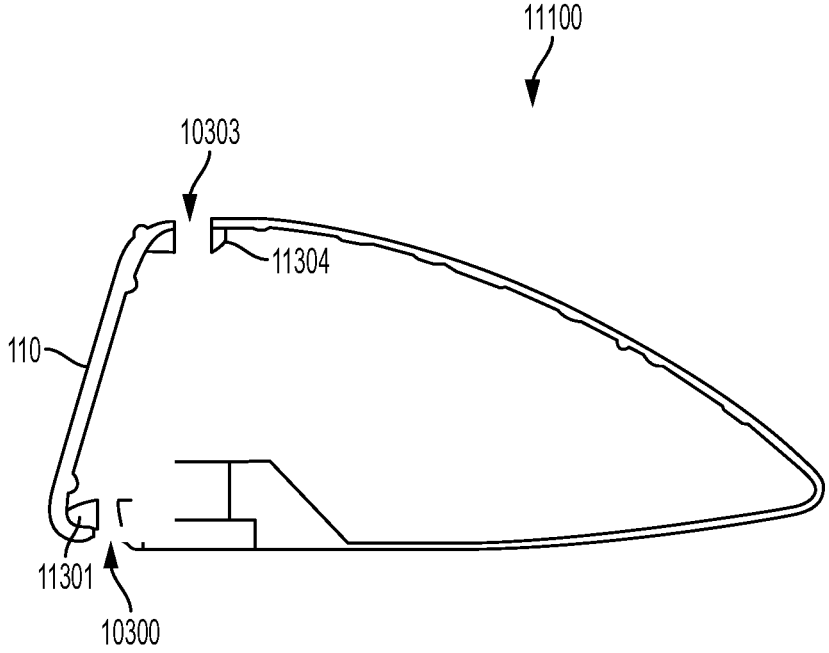
FIG. 30 is a cross-sectional view of the golf club head of FIG. 27 with modifications to BCFs.

As seen with reference to FIG. 30, the golf club 11100 may be modified by removal of portions of the linking ribs 11301,11304. In various embodiments, linking ribs 11301, 11304 may be machined within the BCF 10300,10303, respectively, to selectively remove individual ribs amongst the plurality of linking ribs 11301,11304. One or more of the linking ribs 11301,11304 may be removed to provide modified boundary conditions.

It is common in manufacturing golf club heads to polish away imperfections using hand processes. For example, to provide a surface finish on a face of a golf club head, it may be necessary to remove imperfections from casting, forging, or various other processes. When hand polishing occurs, it provides a relatively large range of tolerance for the thickness of the face of the golf club head that is being polished. Because of this, COR and contact time may be different between various golf club heads that are subject to hand-polishing or other post-production work done by hand. In some of these cases, COR may become out of the range for maximum COR required by United States Golf Association (USGA) rules. Such heads are often destroyed, leading to increased production costs. Sometimes, to address this variance, golf club designers will intentionally design golf club heads to COR lower than USGA rules allow, thus allowing for variance in hand polishing to stay below USGA limits. However, this results in the vast majority of golf clubs having a COR that is below USGA maximum. As such, when tested, these golf club heads will have COR that is lower than prior designs or competitor club heads that have achieved USGA maximum—for example, those that have designed to USGA limits and have scrapped heads per the process described above.

Inclusion of a modifiable BCF such as those disclosed herein allows designers to design close to the USGA limit while maintaining the ability to change COR at a later date. For example, the modifiable stiffening BCF described as linking ribs 11301,11304 are modifiable by selectively removing individual linking ribs 11301,11304 from the plurality. Such a removal will increase COR by a marginal amount. For example, COR may increase by 0.008 by removal of a particular linking rib 11301,11304. As such, removal of that particular rib 11301,11304 may be appropriate if a golf club head 11100 is tested after hand-polishing to have a COR of 0.822, thus allowing the golf club head 11100 to reach the USGA limit of 0.830 COR.

Additionally—and as discussed elsewhere in this disclosure—modifying boundary conditions affects the spin rates. As such, selective modification of the boundary condition may allow for tuning of the COR and spin rates by user selection. In various embodiments, BCFs may be modifiable through a variety of methods. For example, the stiffening BCFs of linking ribs 11301,11304 may include ribs that are bonded across the BCF 10300,10303; removing the bonding may allow the ribs to be removed without machining. It may also be possible to re-bond ribs into place to stiffen the boundary condition. Additionally, stiffer plugging or filling material may be used to provide modified stiffness of the boundary condition as would be understood by one of skill in the art as a modification combining multiple elements of multiple embodiments of the current disclosure.

The embodiment of golf club head 11100 may be modified in various embodiments. For example, in some embodiments, a golf club head similar to golf club head 11100 may include mechanical connectors such as linking ribs 11301, 11304 without a BCF 10300,10303. In such circumstances, it may be possible to machine away the linking ribs from the exterior to provide a softer boundary condition without including a BCF 10300,10303 explicitly. In such embodiments, machining holes may be covered with filler, plugging material, or a cover or insert in accord with various other embodiments of the current disclosure.

In various embodiments of the current disclosure, boundary conditions may be user-modifiable. In various embodiments, boundary conditions may be temporarily modifiable. In various embodiments, boundary condition modifications may be permanent or semi-permanent. Various methods and apparatus would be understood by one of skill in the art to be inherent to the functionality of the disclosure and would be known to one of skill in the art. Modification to embodiments herein that do not substantially deviate from the spirit of the disclosure are intended to be included as variations to the disclosed embodiments and covered within this disclosure.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A golf club head, comprising:

a body, comprising a face, a crown having a crown height no less than 30 mm and no more than 50 mm with the golf club head in an address position, a sole, a skirt region, and a body interior surface defining an interior cavity;

the body defining a trailing edge being a rearward most edge of the body and the body defining a leading edge being a forwardmost edge of the body, wherein a distance from the leading edge to the trailing edge is no less than 38 mm and no more than 97 mm;

the face including a geometric center defining an origin of a coordinate system, the coordinate system including:

an x-axis tangential to the face and generally parallel to a ground plane when the golf club head is in the address position where a positive x-axis extends towards a heel portion;

a y-axis extending perpendicular to the x-axis and generally parallel to the ground plane when the golf club head is in the address position where a positive y-axis extends from the face and through a rearward portion of the body; and a z-axis extending perpendicular to the ground plane, to the x-axis and to the y-axis when the golf club head is in the address position where a positive z-axis extends from the origin and generally upward;

wherein:

the golf club head has a center of gravity with a y-axis coordinate ($CG_y$) measured from the origin of the coordinate system to the center of gravity of the golf club head along the y-axis when the golf club head is in the address position and $CG_y$ is no less than 18 mm and no more than 32 mm, and the golf club head has a $\Delta_z$ value measured from the ground plane to the center of gravity of the golf club head along the z-axis when the golf club head is in the address position; and a weight pad formed in the body along the sole of the body, wherein the weight pad has a weight pad interior surface that partially defines the interior cavity of the body;

wherein:

the weight pad has a length along of the y-axis;

the weight pad has a forward portion and a rearward portion, wherein the forward portion of the weight pad is forward of the center of gravity of the golf club head and the rearward portion of the weight pad is rearward of the center of gravity of the golf club head;

the forward portion of the weight pad has a first height ($h_1$) measured from the ground plane to a forwardmost end of the weight pad along the z-axis when the golf club head is in the address position, and the rearward portion of the weight pad has a second height ($h_2$) measured from the ground plane to a rearwardmost end of the weight pad along the z-axis when the golf club head is in the address position, and the first height is greater than the second height;

a first portion of the weight pad includes an overhang portion that extends forward from the weight pad toward the face such that the overhang portion of the weight pad overhangs an interior bottom portion surface, thereby creating a recess under the overhang portion, wherein a lower surface of the overhang portion and the interior bottom portion surface are spaced apart by an offset distance and the offset distance is at least 0.2 mm, a minimum distance from the ground plane to an underside surface of the overhang portion is no more than 10 mm, a thickness of the overhang portion ranges between 2-10 mm, and a forwardmost portion of the weight pad is offset from the face no more than 12.5 mm;

a central portion of the overhang portion is cantilevered from the weight pad such that the central portion of the overhang portion is disconnected from the interior bottom portion;

the $\Delta_z$ value is from 8 mm to 16 mm, inclusive, the second height is less than the $\Delta_z$ value, and the first height is from 6 mm to 15 mm, inclusive; and a loft of the golf club head is at least 14.5 degrees.

2. A golf club head, comprising:

a body, comprising a face, a crown having a crown height no less than 30 mm and no more than 50 mm with the golf club head in an address position, a sole, a skirt region, and a body interior surface defining an interior cavity;

the body defining a trailing edge being a rearward most edge of the body and the body defining a leading edge being a forwardmost edge of the body, wherein a distance from the leading edge to the trailing edge is no less than 38 mm and no more than 97 mm;

the face including a geometric center defining an origin of a coordinate system, the coordinate system including:

an x-axis tangential to the face and generally parallel to a ground plane when the golf club head is in the address position where a positive x-axis extends towards a heel portion;

a y-axis extending perpendicular to the x-axis and generally parallel to the ground plane when the golf club head is in the address position where a positive y-axis extends from the face and through a rearward portion of the body; and a z-axis extending perpendicular to the ground plane, to the x-axis and to the y-axis when the golf club head is in the address position where a positive z-axis extends from the origin and generally upward;

wherein:

the golf club head has a center of gravity with a y-axis coordinate ($CG_y$) measured from the origin of the coordinate system to the center of gravity of the golf club head along the y-axis when the golf club head is in the address position and $CG_y$ is no less than 18 mm and no more than 32 mm, and the golf club head has a $\Delta_z$ value measured from the ground plane to the center of gravity of the golf club head along the z-axis when the golf club head is in the address position; and a weight pad formed in the body along the sole of the body, wherein the weight pad has a weight pad interior surface that partially defines the interior cavity of the body;

wherein:

the weight pad has a length along of the y-axis;

the weight pad has a forward portion and a rearward portion, wherein the forward portion of the weight pad is forward of the center of gravity of the golf club head and the rearward portion of the weight pad is rearward of the center of gravity of the golf club head;

the forward portion of the weight pad has a first height ($h_1$) measured from the ground plane to a forwardmost end of the weight pad along the z-axis when the golf club head is in the address position, and the rearward portion of the weight pad has a second height ($h_2$) measured from the ground plane to a rearwardmost end of the weight pad along the z-axis when the golf club head is in the address position, and the first height is greater than the second height;

a first portion of the weight pad includes an overhang portion that extends forward from the weight pad toward the face such that the overhang portion of the weight pad overhangs an interior bottom portion surface, thereby creating a recess under the overhang portion, wherein a lower surface of the overhang portion and the interior bottom portion surface are spaced apart by an offset distance and the offset distance is at least 0.2 mm, a minimum distance from the ground plane to an underside surface of the overhang portion is no more than 10 mm, a thickness of the overhang portion ranges between 2-10 mm, and a forwardmost portion of the weight pad is offset from the face no more than 12.5 mm;

a central portion of the overhang portion is cantilevered from the weight pad such that the central portion of the overhang portion is disconnected from the interior bottom portion;

the $\Delta_z$ value is from 8 mm to 16 mm, inclusive, the second height is less than the $\Delta_z$ value, and the first height is from 6 mm to 15 mm, inclusive; and a loft of the golf club head is at least 14.5 degrees; and a through-slot in the sole providing a port from a sole exterior surface of the golf club head to the interior cavity, wherein the through-slot is positioned forward of the weight pad.

3. The golf club head according to claim 2, wherein the through-slot is plugged with a plugging a material.

4. The golf club head according to claim 3, wherein a toeward portion of the through-slot extends further rearward on a toe end compared to a middle portion of the through-slot proximate the y-axis as measured in the direction of the y-axis.

5. The golf club head according to claim 4, wherein the middle portion of the through-slot has a front to back dimension from 4 mm to 10 mm, inclusive, as measured in the direction of the y-axis.

6. The golf club head according to claim 5, wherein the toeward portion of the through-slot has a front to back dimension from 7 mm to 20 mm, inclusive, as measured in the direction of the y-axis.

7. The golf club head according to claim 5, wherein the through-slot has a through-slot length as measured in the direction of the x-axis from a through-slot toeward end to a through-slot heelward end, and the through-slot length is between 70% and 95%, inclusive, of a heel-to-toe length (Clubhead Length) of the golf club head as measured according to methods of the USGA "Procedure for Measuring the Club Head Size of Wood Clubs," Revision 1.0.0, Nov. 21, 2003.

8. The golf club head according to claim 1, wherein the weight pad has at least three separate heights as measured along the y-axis.

9. The golf club head according to claim 1, wherein the weight pad is a separate part of the golf club head and welding, gluing, epoxy, or mechanical fixing joins the weight pad to the body.

10. The golf club head according to claim 9, wherein the weight pad is formed from a greater density material than the body.

11. The golf club head according to claim 1, wherein the body includes a port for receiving a weight.

12. The golf club head according to claim 1, wherein the weight pad includes a port for receiving a weight.

13. The golf club head according to claim 1, wherein the body includes a port for receiving a weight and the port is located forward of the center of gravity of the golf club head.

14. The golf club head according to claim 1, further comprising an adjustable head-shaft connection assembly for coupling the golf club head to a shaft at different angles.

15. The golf club head according to claim 1, wherein the weight pad extends at least 7 mm rearward of the center of gravity.

16. The golf club head according to claim 1, further comprising an adjustable head-shaft connection assembly for coupling the golf club head to a shaft at different angles, and the body includes a port for receiving a weight and the face has a variable face thickness.

17. The golf club head according to claim 2, further comprising an adjustable head-shaft connection assembly for coupling the golf club head to a shaft at different angles, and the body includes a port for receiving a weight and the face has a variable face thickness.

18. The golf club head according to claim 2, wherein at least a portion of the overhang portion extends overtop of the through-slot.

19. The golf club head according to claim 1, wherein a rearward sole thickness located rearward of the rearward-most end of the weight pad is less than a weight pad thickness proximate the rearwardmost end of the weight pad.

20. The golf club head according to claim 19, wherein the rearward sole thickness is less than a forward sole thickness forward of the forwardmost end of the weight pad.

21. The golf club head according to claim 2, further comprising an adjustable head-shaft connection assembly for coupling the golf club head to a shaft at different angles.

22. The golf club head according to claim 21, wherein the body includes a port for receiving a weight.

* * * * *